US010087922B2

(12) United States Patent
Cai et al.

(10) Patent No.: US 10,087,922 B2
(45) Date of Patent: Oct. 2, 2018

(54) FOUR-COMPRESSION-CHAMBER DIAPHRAGM PUMP WITH DIAPHRAGM POSITIONING STRUCTURES TO REDUCE VIBRATION

(71) Applicants: Ying Lin Cai, Guangdong (CN); Chao Fou Hsu, Kaohsiung (TW)

(72) Inventors: Ying Lin Cai, Guangdong (CN); Chao Fou Hsu, Kaohsiung (TW)

( * ) Notice: Subject to any disclaimer, the term of this patent is extended or adjusted under 35 U.S.C. 154(b) by 178 days.

(21) Appl. No.: 14/714,559

(22) Filed: May 18, 2015

(65) Prior Publication Data

US 2015/0337827 A1 Nov. 26, 2015

Related U.S. Application Data

(60) Provisional application No. 62/000,611, filed on May 20, 2014.

(51) Int. Cl.

| | |
|---|---|
| ***F04B 43/00*** | (2006.01) |
| ***F04B 9/04*** | (2006.01) |
| ***F04B 43/02*** | (2006.01) |
| ***F04B 53/16*** | (2006.01) |
| *F04B 43/04* | (2006.01) |

(52) U.S. Cl.

CPC ..... *F04B 43/0054* (2013.01); *F04B 9/042* (2013.01); *F04B 43/026* (2013.01); *F04B 53/16* (2013.01); *F04B 43/04* (2013.01)

(58) Field of Classification Search

CPC ..... A61B 5/02141; F04B 1/148; F04B 9/042; F04B 43/02; F04B 43/026; F04B 43/04; F04B 43/06; F04B 43/0054; F04B 45/043; F04B 45/047; F04B 53/16

USPC ..... 417/395, 413.1

See application file for complete search history.

(56) References Cited

U.S. PATENT DOCUMENTS

| | | | | |
|---|---|---|---|---|
| 2,185,784 A * | 1/1940 | Corydon | F04B 43/0054 92/103 F |
| 5,015,159 A * | 5/1991 | Mine | F02M 37/08 123/41.31 |
| 6,295,918 B1 * | 10/2001 | Simmons | F04B 43/0054 92/98 R |
| 6,840,745 B1 | 1/2005 | Macauley et al. | |

(Continued)

*Primary Examiner* — Devon Kramer
*Assistant Examiner* — Joseph Herrmann
(74) *Attorney, Agent, or Firm* — Bacon & Thomas, PLLC

(57) ABSTRACT

A four-compression-chamber diaphragm pump with multiple effects includes an eccentric roundel mount with four cylindrical eccentric roundels, a pump head body with four operating holes, and a diaphragm membrane with four annular positioning protrusions. A basic curved groove or other vibration-reducing first positioning structure is circumferentially disposed around each operating hole while a basic curved protrusion or other second vibration-reducing second positioning structure is provided in the diaphragm membrane for suitably coupling with the corresponding groove or other first positioning structure upon assembly, resulting in a shortened length of moment arm from the basic curved protrusions or other vibration-reducing positioning structures to respective downwardly-extending annular positioning protrusions in the diaphragm membrane, and consequently reduced vibration noise and resonant shaking in comparison with a conventional four-compressing-chamber diaphragm pump.

26 Claims, 71 Drawing Sheets

(56) References Cited

U.S. PATENT DOCUMENTS

| | | | | |
|---|---|---|---|---|
| 7,424,847 | B2 | 9/2008 | Hart | |
| 2015/0337827 | A1* | 11/2015 | Cai | F04B 45/043<br>417/395 |

* cited by examiner

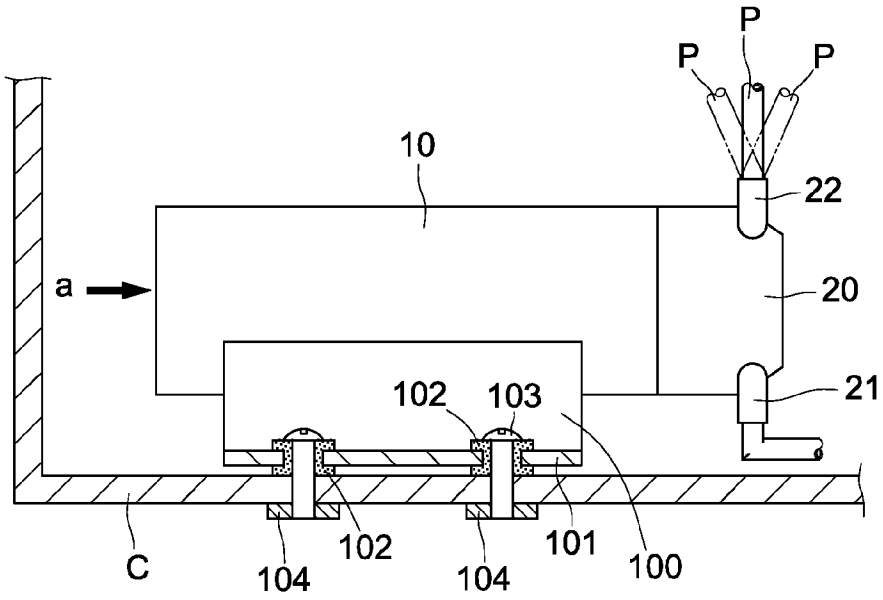
FIG.16 (PRIOR ART)
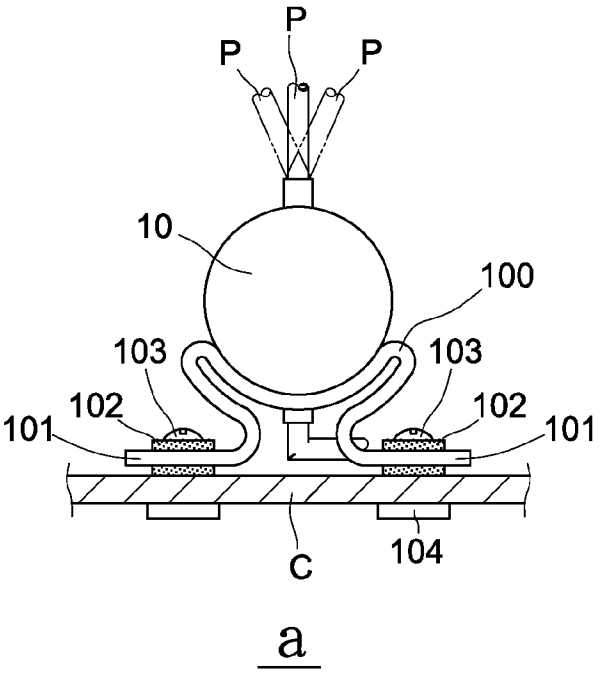

FOUR-COMPRESSION-CHAMBER DIAPHRAGM PUMP WITH DIAPHRAGM POSITIONING STRUCTURES TO REDUCE VIBRATION

This application claims the benefit of provisional U.S. Patent Application No. 62/000,611, filed May 20, 2014, and incorporated herein by reference.

FIELD OF THE PRESENT INVENTION

The present invention relates to a four-compression-chamber diaphragm pump with multiple effects used in a reverse osmosis (RO) purifier or RO water purification system, which is commonly installed in the water supplying apparatus of either a house, recreational vehicle or mobile home, and particularly to a four-compression-chamber diaphragm pump having an innovative mating means for the pump head body and diaphragm membrane to reduce unwanted noise and shaking caused by resonant vibrations in the conventional four-compression-chamber diaphragm pump, as well as a sloped top ring in the eccentric roundel mount that can eliminate the oblique pulling and squeezing phenomena of the pump so that the service lifespan of the four-compression-chamber diaphragm pump and the durability of key components therein are prolonged.

BACKGROUND OF THE INVENTION

Currently, the conventional four-compression-chamber diaphragm pumps exclusively used with RO (Reverse Osmosis) purifiers or RO water purification systems installed in the water supplying apparatus of either a house, recreational vehicle or mobile home, come in various types. The majority of four-compression-chamber diaphragm pumps, other than the specific type disclosed in U.S. Pat. No. 6,840,745, can be categorized as similar in design to the conventional four-compression-chamber diaphragm pump shown in FIGS. 1 through 11. This example of a conventional four-compression-chamber diaphragm pump essentially comprises a brushed motor 10 with an output shaft 11, a motor upper chassis 30, a wobble plate with an integral protruding cam-lobed shaft 40, an eccentric roundel mount 50, a pump head body 60, a diaphragm membrane 70, four pumping pistons 80, a piston valvular assembly 90 and a pump head cover 20.

The motor upper chassis 30 includes a bearing 31 through which an output shaft 11 of the motor 10 extends. The motor upper chassis 30 also includes an upper annular rib ring 32 with several fastening bores 33 evenly and circumferentially disposed in a rim of the upper annular rib ring 32

The wobble plate 40 includes a shaft coupling hole 41 through which the corresponding motor output shaft 11 of the motor 10 extends.

The eccentric roundel mount 50 includes a central bearing 51 at the bottom thereof for receiving the corresponding wobble plate 40. Four tubular eccentric roundels 52 are evenly and circumferentially disposed on the eccentric roundel mount 50. Each tubular eccentric roundel 52 has a horizontal top face 53, a female-threaded bore 54 and an annular positioning groove 55 formed in the top face thereof, as well as a rounded shoulder 57 created at the intersection of the horizontal top face 53 and a vertical flank 56 (as shown in FIGS. 3 and 4).

The pump head body 60 covers the upper annular rib ring 32 of the motor upper chassis 30 to encompass the wobble plate 40 and eccentric roundel mount 50 therein, and includes four operating holes 61 evenly and circumferentially disposed therein. Each operating hole 61 has an inner diameter that is slightly bigger than the outer diameter of the corresponding tubular eccentric roundel 52 in the eccentric roundel mount 50 for receiving each corresponding tubular eccentric roundel 52 respectively, a lower annular flange 62 formed thereunder for mating with corresponding upper annular rib ring 32 of the motor upper chassis 30, and several fastening bores 63 evenly disposed (as shown in FIGS. 5 through 7) around a circumference of the pump head body 60.

The diaphragm membrane 70, which is extrusion-molded from a semi-rigid elastic material and placed on the pump head body 60, includes a pair of parallel rims, the pair including outer raised rim 71 and inner raised rim 72, as well as four evenly spaced radial raised partition ribs 73 such that each end of radial raised partition ribs 73 connects with the inner raised rim 72, thereby forming four equivalent piston acting zones 74 within and partitioned by the radial raised partition ribs 73, wherein each piston acting zone 74 has an acting zone hole 75 created therein in correspondence with a respective female-threaded bore 54 in the tubular eccentric roundel 52 of the eccentric roundel mount 50, and an annular positioning protrusion 76 for each acting zone hole 75 is formed at the bottom side of the diaphragm membrane 70 (as shown in FIGS. 9 and 10).

Each pumping piston 80, which is respectively disposed in a corresponding piston acting zone 74 of the diaphragm membrane 70, has a tiered hole 81 extending therethrough. After each of the annular positioning protrusions 76 in the diaphragm membrane 70 has been inserted into a corresponding annular positioning dent 55 in the tubular eccentric roundel 52 of the eccentric roundel mount 50, respective fastening screws 1 are inserted through the tiered hole 81 of each pumping piston 80 and the acting zone hole 75 of each corresponding piston acting zone 74 in the diaphragm membrane 70, so that the diaphragm membrane 70 and four pumping pistons 80 can be securely screwed into female-threaded bores 54 of the corresponding four tubular eccentric roundels 52 in the eccentric roundel mount 50 (as can be seen in the enlarged portion of FIG. 11).

Piston valvular assembly 90 covers the diaphragm membrane 70 and includes a downwardly extending raised rim 91 for insertion between the outer raised rim 71 and inner raised rim 72 in the diaphragm membrane 70, a central dish-shaped round outlet mount 92 having a central positioning bore 93 with four equivalent sectors, each of which contains multiple evenly circumferentially-located outlet ports 95, a T-shaped plastic anti-backflow valve 94 with a central positioning shank, and four circumferentially-adjacent inlet mounts 96. Each of the circumferentially-adjacent inlet mounts 96 includes multiple evenly circumferentially-located inlet ports 97 and an inverted central piston disk 98 respectively so that each piston disk 98 serves as a valve for each corresponding group of multiple inlet ports 97. The central positioning shank of the plastic anti-backflow valve 94 mates with the central positioning bore 93 of the central outlet mount 92 such that multiple outlet ports 95 in the central round outlet mount 92 are in communication with the four inlet mounts 96, and a hermetically sealed preliminary-compression chamber 26 is formed between each inlet mount 96 and a corresponding piston acting zone 74 in the diaphragm membrane 70 upon insertion of the downwardly extending raised rim 91 between the outer raised rim 71 and inner raised rim 72 of diaphragm membrane 70, such that one end of each preliminary-compression chamber 26 is in communication with each of the corresponding inlet ports 97 (as shown in the enlarged portion of FIG. 11).

The pump head cover 20, which covers the pump head body 60 to encompass the piston valvular assembly 90, pumping piston 80 and diaphragm membrane 70 therein, includes a water inlet orifice 21, a water outlet orifice 22, and several fastening bores 23. A tiered rim 24 and an annular rib ring 25 are disposed in the bottom inside of the pump head cover 20 such that the outer rim for the assembly of diaphragm membrane 70 and piston valvular assembly 90 can be hermetically attached to the tiered rim 24 (as shown in the enlarged portion of FIG. 11). A high-compression chamber 27 is formed between the cavity formed by the inside wall of the annular rib ring 25 and the central outlet mount 91 of the piston valvular assembly 90 when the bottom of the annular rib ring 25 closely covers the rim of the central outlet mount 92 (as shown in FIG. 11).

By running each fastening bolt 2 through a corresponding fastening bore 23 of pump head cover 20 and a corresponding fastening bore 63 in the pump head body 60, and then putting a nut 3 onto each fastening bolt 2 to securely screw the pump head cover 20 to the pump head body 60 via the corresponding fastening bores 33 in the motor upper chassis 30, the whole assembly of the four-compression-chamber diaphragm pump is finished (as shown in FIGS. 1 and 11).

Please refer to FIGS. 12 and 13, which are illustrative figures for the operation of the conventional four-compression-chamber diaphragm pump of FIGS. 1-11.

Firstly, when the motor 10 is powered on, the wobble plate 40 is driven to rotate by the motor output shaft 11 so that the four tubular eccentric roundels 52 on the eccentric roundel mount 50 constantly move in a sequential up-and-down reciprocal stroke.

Secondly, in the meantime, the four pumping pistons 80 and four piston acting zones 74 in the diaphragm membrane 70 are sequentially driven by the up-and-down reciprocal stroke of the four tubular eccentric roundels 52 to move in an up-and-down displacement.

Thirdly, when the tubular eccentric roundel 52 moves in a down stroke, causing pumping piston 80 and piston acting zone 74 to be displaced downwardly, the piston disk 98 in the piston valvular assembly 90 is pushed into an open status so that tap water W can flow into the preliminary-compression chamber 26 via water inlet orifice 21 in the pump head cover 20 and inlet ports 97 in the piston valvular assembly 90 (as indicated by the arrowhead extending from W in the enlarged view of FIG. 12);

Fourthly, when the tubular eccentric roundel 52 moves in an up stroke, causing pumping piston 80 and piston acting zone 74 to be displaced upwardly, the piston disk 98 in the piston valvular assembly 90 is pulled into a closed status to compress the tap water W in the preliminary-compression chamber 26 and increase the water pressure therein up to a range of 100 psi-150 psi. The resulting pressurized water Wp causes the plastic anti-backflow valve 94 in the piston valvular assembly 90 to be pushed to an open status.

Fifthly, when the plastic anti-backflow valve 94 in the piston valvular assembly 90 is pushed to an open status, the pressurized water Wp in the preliminary-compression chamber 26 is directed into high-compression chamber 27 via the group of outlet ports 95 for the corresponding sector in the central outlet mount 92, and then expelled out of the water outlet orifice 22 in the pump head cover 20 (as indicated by arrowhead W in the enlarged portion of FIG. 13).

Finally, the sequential iterative action for each group of outlet ports 95 for the four sectors in central outlet mount 92 causes the pressurized water Wp to be constantly discharged out of the conventional four-compression-chamber diaphragm pump to be further RO-filtered by the RO-cartridge so that the final filtered pressurized water Wp can be used in a RO (Reverse Osmosis) purifier or RO water purification system of the type popularly installed in the water supplying apparatus of either house, recreational vehicle or mobile home.

Referring to FIGS. 14 and 15, a serious vibration-related drawback has long existed in the conventional four-compression-chamber diaphragm pump. As described previously, when the motor 10 is powered on, the wobble plate 40 is driven to rotate by the motor output shaft 11 so that the four tubular eccentric roundels 52 on the eccentric roundel mount 50 constantly move in a sequential up-and-down reciprocal stroke, while in the meantime the four pumping pistons 80 and four piston acting zones 74 in the diaphragm membrane 70 are sequentially driven by the up-and-down reciprocal stroke of the four tubular eccentric roundels 52 to undergo up-and-down displacement so that an equivalent force F constantly acts on the four piston acting zones 74 with a length of moment arm L1 the extends from the outer raised rim 71 to the periphery of the annular positioning protrusion 76 (as shown in FIG. 15). Thereby, a resultant torque is created by the acting force F multiplied by the length of moment arm L1 according to the formula "torque=acting force F×length of moment arm L1." The resultant torque causes the whole conventional four-compression-chamber diaphragm pump to vibrate directly. With a high rotational speed of the motor output shaft 11 in the motor 10 up to a range of 800-1200 rpm, the vibrating strength caused by the alternately acting of four tubular eccentric roundels 52 can reach a persistently unacceptable condition.

To address the drawbacks of the conventional four-compression-chamber diaphragm pump, as shown in FIG. 16 a cushion base 100 with a pair of wing plates 101 is always provided as a supplemental support, with each wing plate 101 being further sleeved by a rubber shock absorber 102 for enhancing vibration suppression. Upon installation of the conventional four-compression-chamber diaphragm pump in the water supplying apparatus of the house or mobile home, the cushion base 100 is firmly screwed onto the housing C of the reverse osmosis purification unit by means of suitable fastening screws 103 and corresponding nuts 104. However, the practical vibration suppressing efficiency of the cushion base 100 with wing plates 101 and rubber shock absorber 102 only reduces noise caused by the primary vibration without affecting noise caused by secondary vibrations that occur as a result of resonant shaking of the housing C. The secondary vibrations actually cause the overall vibration noise of the housing C for the reverse osmosis purification unit to increase.

In addition to drawback of increasing overall vibration noise of the housing C, a further drawback occurs in that the water pipe P connected to the water outlet orifice 22 of the pump head cover 20 will synchronously shake in resonance with the vibrations described above (as indicated by the broken line depictions of water pipe P in FIGS. 16 and 16*a*). This synchronous shaking of the water pipe P will result in still further drawbacks by causing other parts of the conventional four-compression-chamber diaphragm pump to simultaneously shake. As a result, after a certain period, the water leakage of the conventional four-compression-chamber diaphragm pump will occur due to gradual loosening of the connection between water pipe P and water outlet orifice 22, as well as gradual loosening of the fit between other parts affected by the shaking. The additional drawbacks of overall resonant shaking and water leakage in the conventional four-compression-chamber diaphragm pump cannot be resolved by the above-described conventional way of addressing primary vibrations using a shock-absorbing cushion base 100. Therefore, how to substantially reduce all of the drawbacks associated with the operating vibration for the four-compression-chamber diaphragm pump has become an urgent and critical issue.

As described previously, when the motor 10 is powered on, the wobble plate 40 is driven to rotate by the motor output shaft 11 so that four tubular eccentric roundels 52 on the eccentric roundel mount 50 constantly move in a sequential up-and-down reciprocal stroke, and the four piston acting zones 74 in the diaphragm membrane 70 are sequentially driven by the up-and-down reciprocal stroke of the four tubular eccentric roundels 52 to move in up-and-down displacement so that a force F constantly acts on the bottom side of each piston acting zone 74.

Meanwhile a corresponding plurality of rebounding forces Fs are created in reaction to the acting force F exerted on the bottom side of diaphragm membrane 70, with different components distributed over the entire bottom area of each corresponding piston acting zone 74 in the diaphragm membrane 70, as shown in FIG. 18, so that a squeezing phenomenon caused by the rebounding forces Fs occurs on a section of the diaphragm membrane 70.

Among all of the distributed components of the rebounding force Fs, the maximum component force is exerted at the contacting bottom position P of the diaphragm membrane 70 with the rounded shoulder 57 of the horizontal top face 53 in the tubular eccentric roundel 52 so that the squeezing phenomenon at the bottom position P is also maximum, as shown in FIG. 18.

With the rotational speed for the motor output shaft 11 of the motor 10 reaching a range of 800-1200 rpm, each bottom position P of the piston acting zone 74 of the diaphragm membrane 70 suffers from the squeezing phenomenon at a frequency of four times per second. Under such circumstances, the bottom position P of the diaphragm membrane 70 is always the first broken place for the entire conventional four-compression-chamber diaphragm pump, which not only shortens the service lifespan but also terminates the normal function of the conventional four-compression-chamber diaphragm pump.

Therefore, how to substantially reduce the drawbacks associated with the squeezing phenomenon caused by the constant application of force F to the bottom side of each piston acting zone 74 of the diaphragm membrane 70 as a result of the movement of the tubular eccentric roundel 52 four-compression-chamber diaphragm pump has also become an urgent and critical issue.

SUMMARY OF THE INVENTION

An objective of the present invention is to provide a four-compression-chamber diaphragm pump with multiple effects, including an innovative mating means for a pump head body and a diaphragm membrane, in which the pump head body includes four operating holes and a basic curved groove, slot, or perforated segment, or a curved protrusion or set of protrusions, at least partially circumferentially-disposed around the upper side of each operating hole while the diaphragm membrane includes four equivalent piston acting zones, each of which has an acting zone hole, an annular positioning protrusion for each acting zone hole, and a basic curved protrusion or set of protrusions, or a groove, slot, or perforated segment, at least partially circumferentially-disposed around each concentric annular positioning protrusion at a position corresponding to the position of a corresponding mating basic curved groove, slot, or perforated segment, or curved protrusion or set of protrusions, in the pump head body, so that the four basic curved protrusions, sets of protrusions, grooves, slots, or perforated segments are completely inserted into or received by the corresponding four basic curved grooves, slots, or perforated segments, or curved protrusions or set of protrusions, with a short length of moment arm that generates less torque, the torque being obtained by multiplying the length of the moment arm by a constant acting force. With less torque, the vibration strength of the four-compression-chamber diaphragm pump is substantially reduced.

Another objective of the present invention is to provide a four-compression-chamber diaphragm pump with multiple effects, which has an innovative mating means for a pump head body and a diaphragm membrane, in which the pump head body has four basic curved grooves, slots, or perforated segments, or curved protrusions or sets of protrusions, and the diaphragm membrane has four basic curved protrusions, sets of protrusions, grooves, slots, or perforated segments, such that the four basic curved protrusions, sets of protrusions, grooves, slots, or perforated segments are completely inserted into the corresponding four basic curved grooves, slots, or perforated segments, or curved protrusions or sets of protrusions, thereby reducing the length of the moment arm so as to generate less torque, the torque being obtained by multiplying the length of the moment arm and the constant acting force that primarily causes the adverse vibration. When the present invention is installed on the housing of a reverse osmosis purification unit of a water supplying apparatus in either a house or mobile home and cushioned by a conventional cushion base with a rubber shock absorber, the annoying noise caused by resonant shaking that occurred in the conventional four-compression-chamber diaphragm pump can be completely eliminated.

A further objective of the present invention is to provide a four-compression-chamber diaphragm pump with multiple effects, which includes a cylindrical eccentric roundel disposed in an eccentric roundel mount. The cylindrical eccentric roundel includes an annular positioning groove, a vertical flank and an annular top surface portion that is inclined relative to horizontal to form a sloped top ring between the annular positioning groove and the vertical flank. By means of the sloped top ring, the high-frequency oblique pulling and squeezing phenomena that occurs in a conventional tubular eccentric roundel are completely eliminated because the sloped top ring flatly attaches the bottom area of corresponding piston acting zone for the diaphragm membrane. Thus, not only is the durability of the diaphragm membrane enhanced to better withstand the sustained high-frequency pumping action of the eccentric roundels, but the service lifespan of the diaphragm pump is also greatly prolonged.

Yet another objective of the present invention is to provide a four-compression-chamber diaphragm pump with multiple effects, which includes a cylindrical eccentric roundel disposed in an eccentric roundel mount. The cylindrical eccentric roundel includes an annular positioning groove, a vertical flank and a sloped top ring formed between the annular positioning groove and the vertical flank. By means of the sloped top ring, all distributed components of the rebounding force for the cylindrical eccentric roundels that are generated in reaction to the acting force caused by the pumping action are substantially reduced because the sloped top ring flatly attaches to the bottom area of the corresponding piston acting zone for the diaphragm membrane.

In achieving the above-described objectives, which are not intended to be limiting, at least the following benefits are obtained:

1. The durability of the diaphragm membrane for sustaining the high-frequency pumping action of the cylindrical eccentric roundels is substantially enhanced.

2. The power consumption of the four-compression-chamber diaphragm pump is tremendously diminished due to less current being wasted as a result of the above-described high-frequency squeezing phenomena.

3. The working temperature of the four-compression-chamber diaphragm pump is tremendously reduced due to less power consumption.

4. The annoying noise of the bearings that results from aged lubricant in the four-compression-chamber diaphragm pump, which is expeditiously accelerated by the high working temperature, is mostly eliminated.

BRIEF DESCRIPTION OF THE DRAWINGS

FIG. 16 is a schematic view showing a conventional four-compression-chamber diaphragm pump installed on a mounting base in a reverse osmosis (RO) purification system, which is popularly installed on the water supplying apparatus in either the settled home, recreational vehicle or mobile home.

FIG. 120 is a cross sectional view taken against the section line 120-120 from previous FIG. 119.

FIG. 121 is a perspective assembled view showing a second modified cylindrical eccentric roundel for the ninth exemplary embodiment of the present invention.

FIG. 122 is a cross sectional view taken against the section line 122-122 from previous FIG. 121.

FIG. 123 is a cross sectional view showing the second modified cylindrical eccentric roundel for the ninth exemplary embodiment of the present invention, which is installed in a conventional four-compression-chamber diaphragm pump.

FIG. 124 illustrates the operation of the second modified cylindrical eccentric roundel for the ninth exemplary embodiment of the present invention, which is installed in a conventional four-compression-chamber diaphragm pump.

FIG. 125 is a partially enlarged view taken from circled-portion-a of previous FIG. 124.

FIG. 126 is a cross operation illustrative view showing a comparison between a modified cylindrical eccentric roundel acting on the diaphragm membrane for the conventional four-compression-chamber diaphragm pump and for the present invention in the ninth exemplary embodiment of the present invention.

DETAILED DESCRIPTION OF THE PREFERRED EMBODIMENTS

FIGS. 19 through 28 are illustrative figures of a four-compression-chamber diaphragm pump with multiple effects according to a first exemplary embodiment of the present invention.

Figure 22:
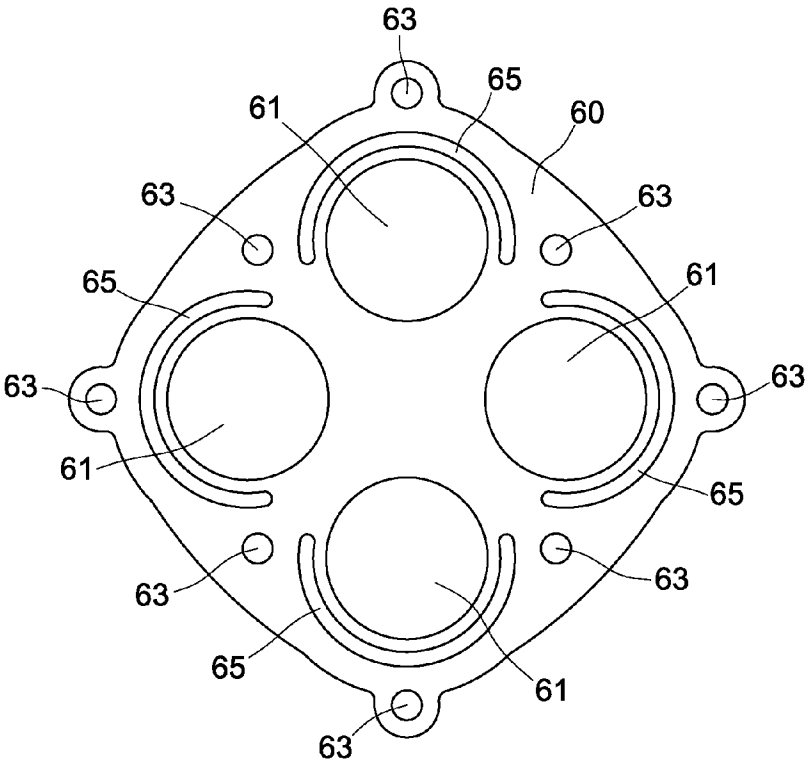
FIG. 22 is a top view of a pump head body in the first exemplary embodiment of the present invention.
Figure 20:
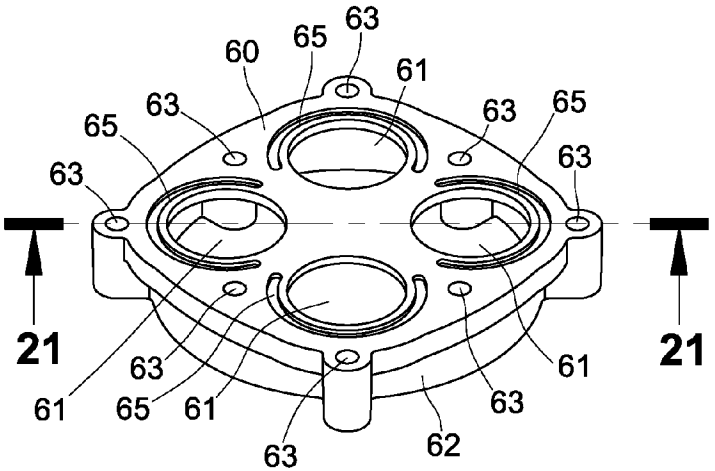
FIG. 20 is a perspective view of a pump head body in the first exemplary embodiment of the present invention.
Figure 21:
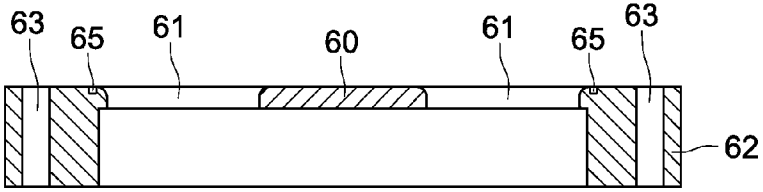
FIG. 21 is a cross sectional view taken against the section line 21-21 from previous FIG. 20.
Figure 25:
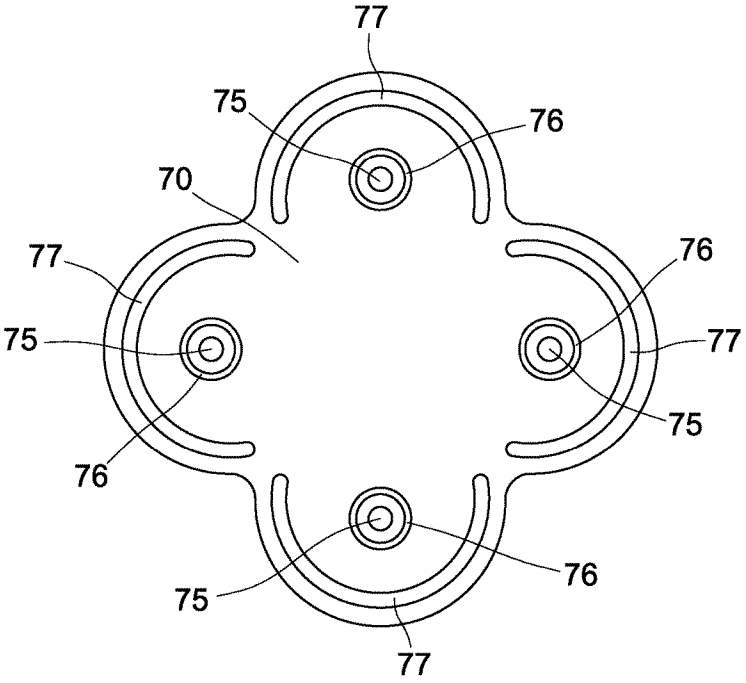
FIG. 25 is a bottom view of a diaphragm membrane in the first exemplary embodiment of the present invention.
Figure 23:
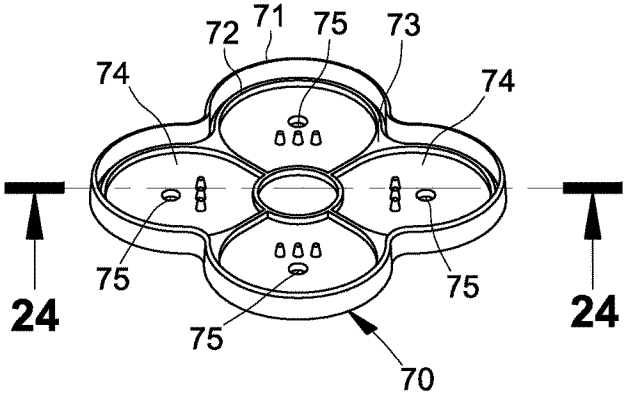
FIG. 23 is a perspective view of a diaphragm membrane in the first exemplary embodiment of the present invention.
Figure 24:
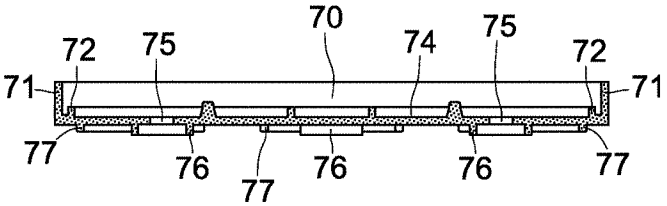
FIG. 24 is a cross sectional view taken against the section line 24-24 from previous FIG. 23.

A basic curved groove 65 is circumferentially disposed around the upper side of each operating hole 61 in the pump head body 60 (as shown in FIGS. 20 to 22) while a basic curved protrusion 77 is circumferentially disposed around each concentric annular positioning protrusion 76 (as shown in FIGS. 24 and 25) at the bottom side of the diaphragm membrane 70 at a position corresponding to the position of each mating basic curved groove 65 in the pump head body 60.

Figure 28:
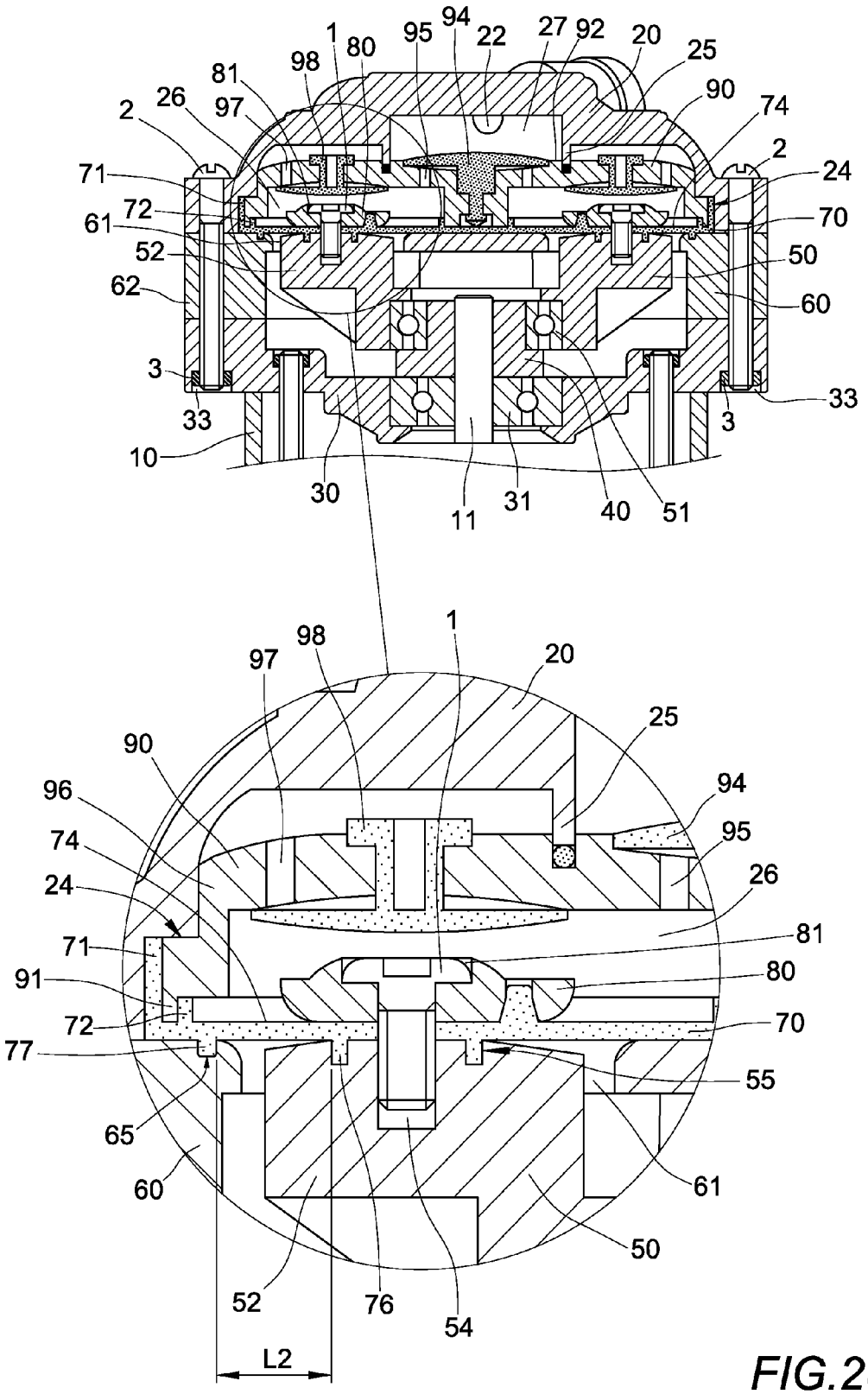
FIG. 28 is an assembled cross sectional view of the first exemplary embodiment of the present invention.
Figure 29:
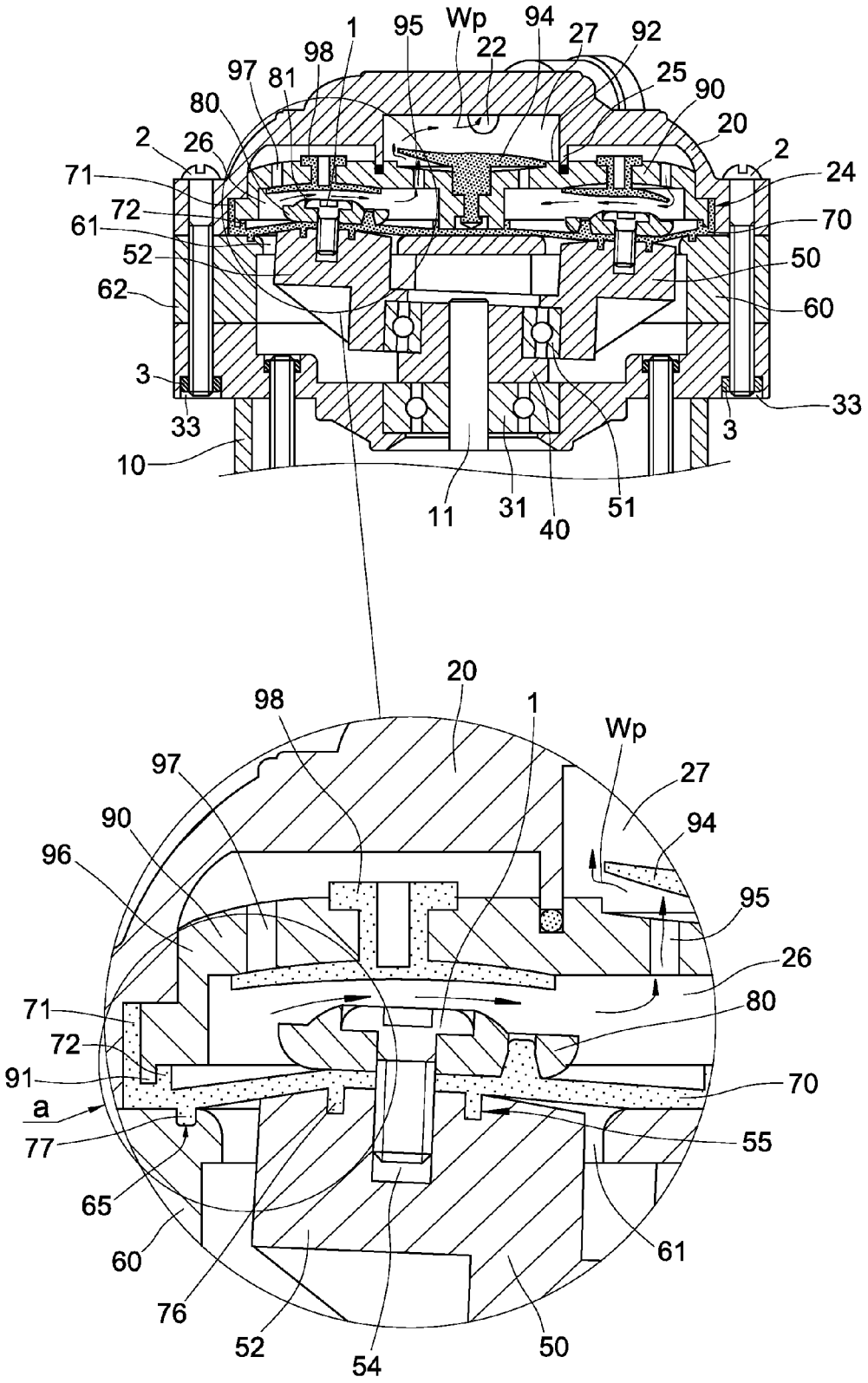
FIG. 29 is a first view illustrating operation of the first exemplary embodiment of the present invention.

Thereby, each of the basic curved protrusions 77 at the bottom side of the diaphragm membrane 70 is completely inserted into each corresponding basic curved groove 65 at the upper side of the pump head body 60 upon assembly of the pump head body 60 and the diaphragm membrane 70 (as shown in FIG. 28) with the result that the length of moment arm L2 from the basic curved protrusions 77 to the periphery of the annular positioning protrusion 76 in the diaphragm membrane 70 is during operation of the present invention is reduced (as shown in the enlarged portion of FIG. 28).

Figure 1:
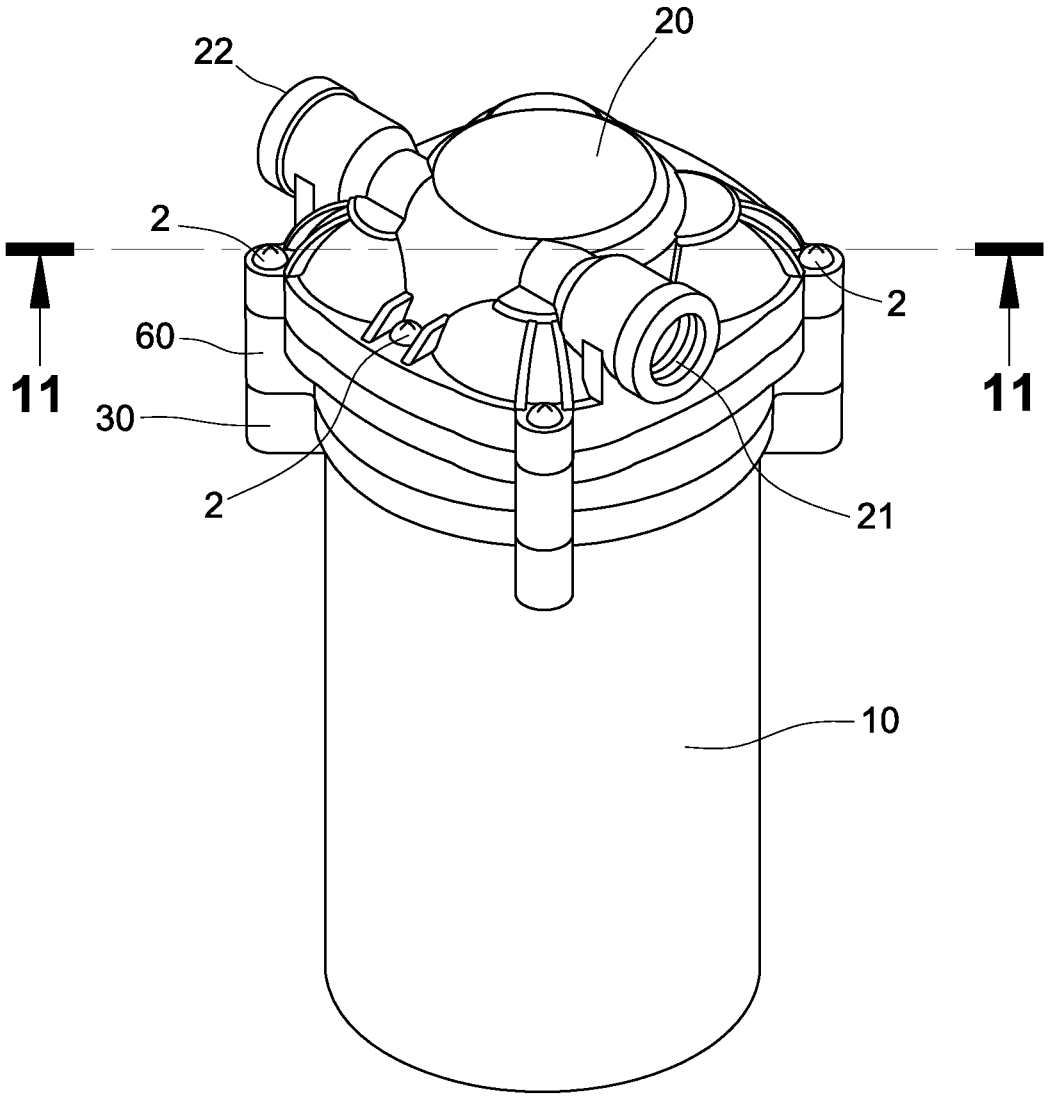
FIG.1 (PRIOR ART)
FIG. 1 is a perspective assembled view of a conventional four-compression-chamber diaphragm pump.
Figure 2:
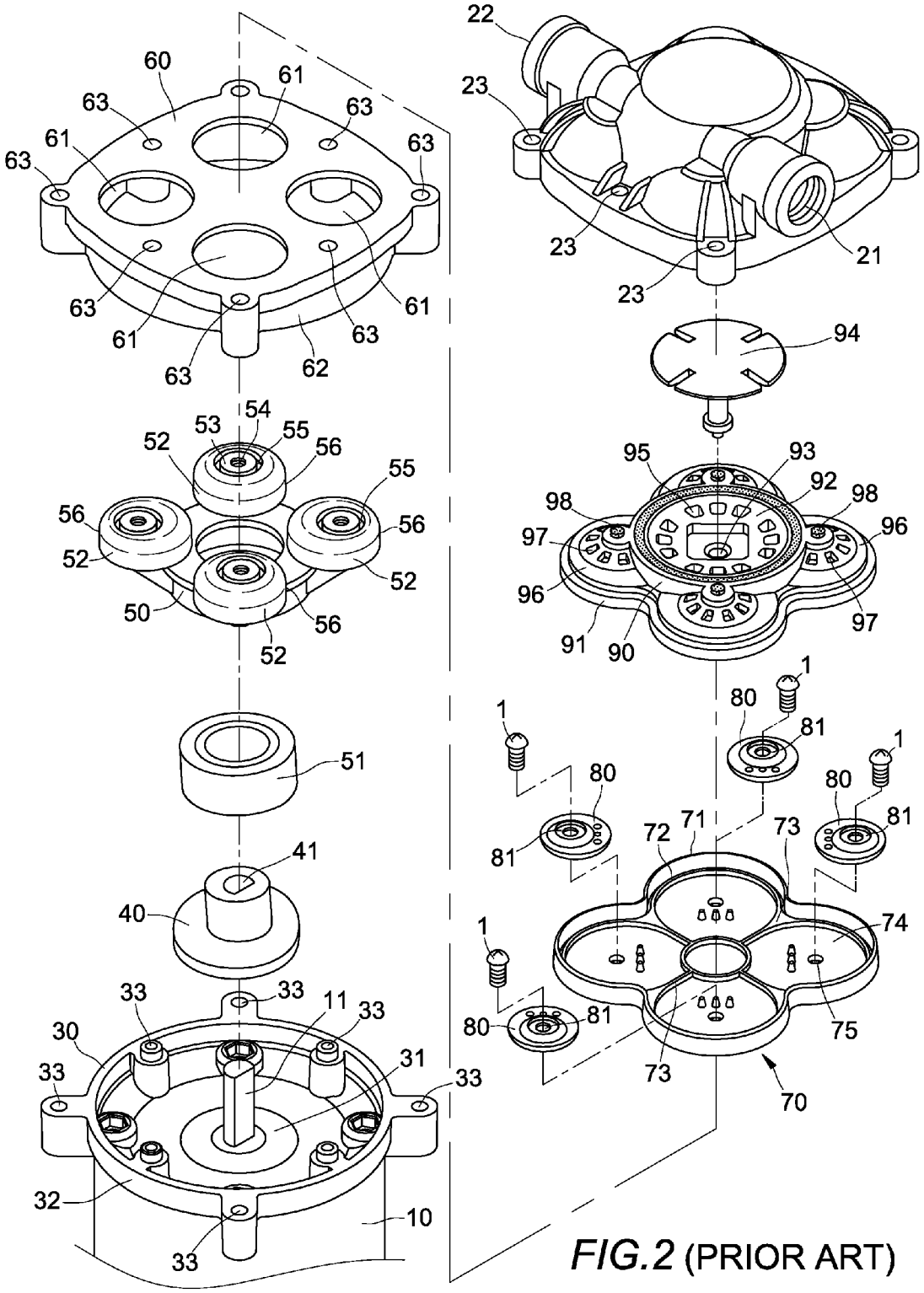
FIG.2 (PRIOR ART)
FIG. 2 is a perspective exploded view of a conventional four-compression-chamber diaphragm pump.
Figure 3:
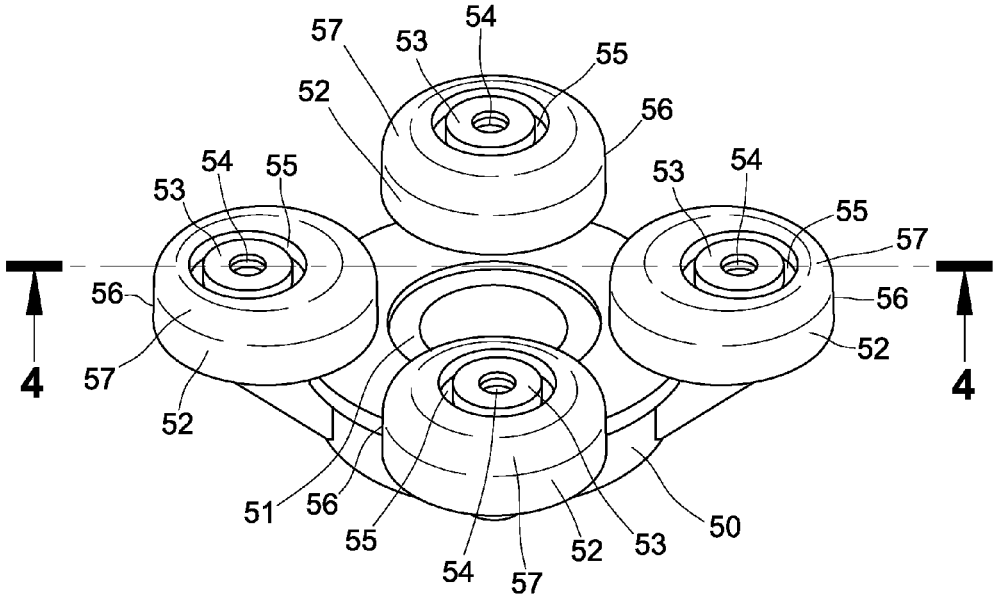
FIG.3 (PRIOR ART)
FIG. 3 is a perspective view of an eccentric roundel mount for the conventional four-compression-chamber diaphragm pump.
Figure 4:
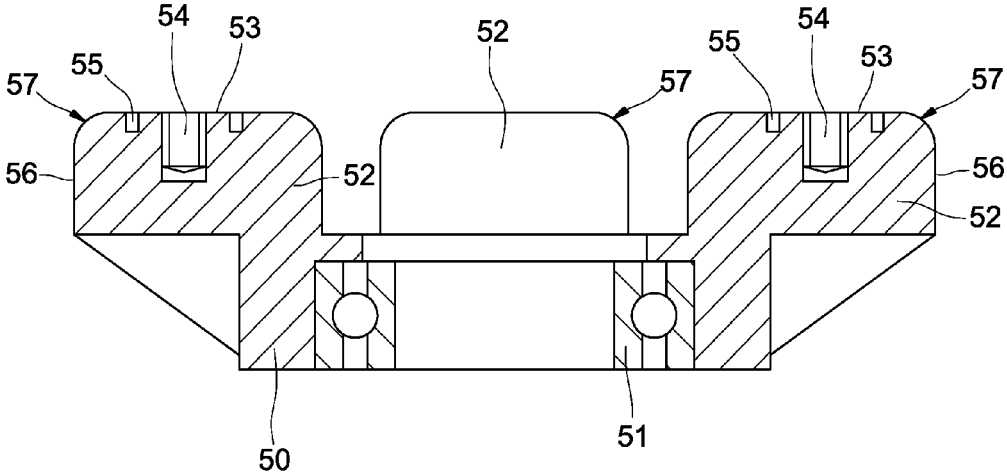
FIG.4 (PRIOR ART)
FIG. 4 is a cross sectional view taken against the section line 4-4 from previous FIG. 3.
Figure 7:
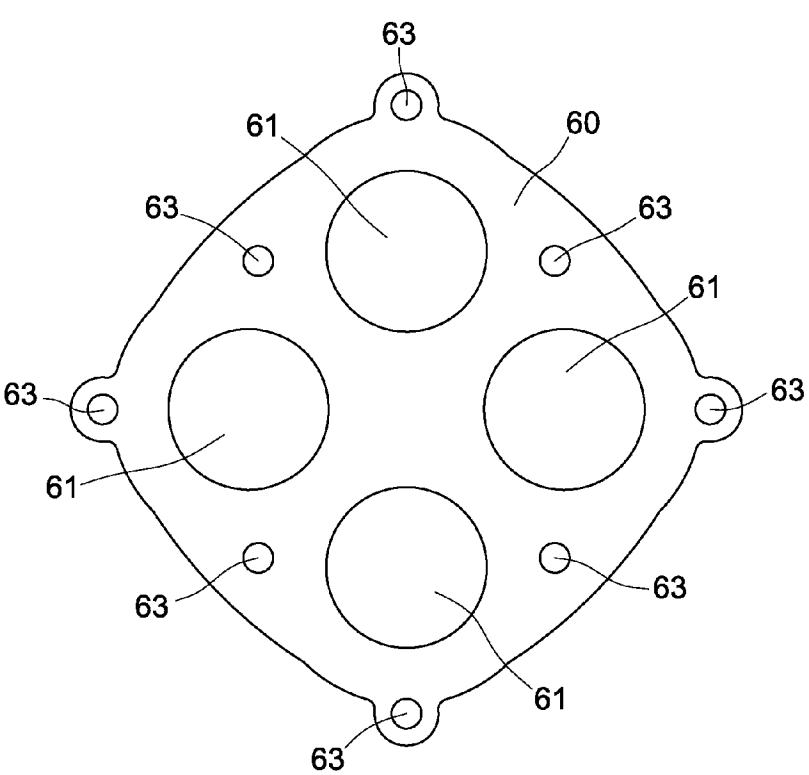
FIG.7 (PRIOR ART)
FIG. 7 is a top view of a pump head body for the conventional four-compression-chamber diaphragm pump.
Figure 5:
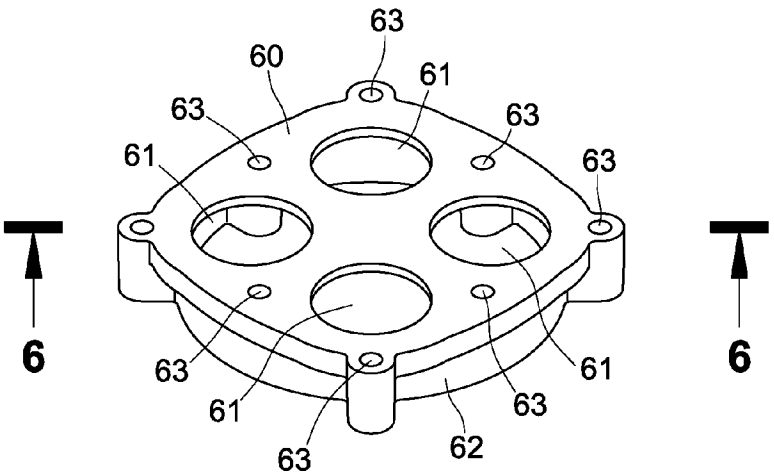
FIG.5 (PRIOR ART)
FIG. 5 is a perspective view of a pump head body for the conventional four-compression-chamber diaphragm pump.
Figure 6:
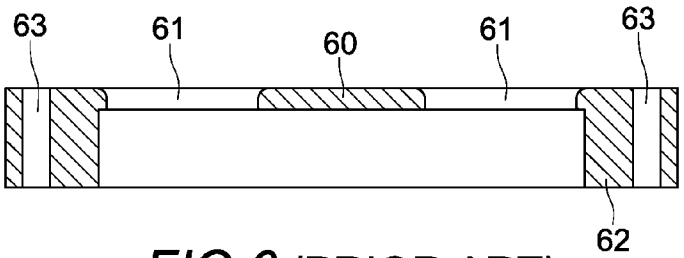
FIG.6 (PRIOR ART)
FIG. 6 is a cross sectional view taken against the section line 6-6 from previous FIG. 5.
Figure 10:
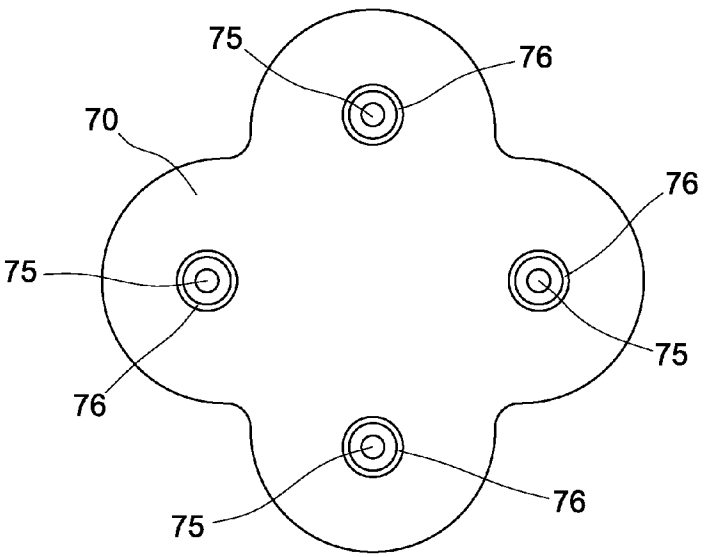
FIG.10 (PRIOR ART)
FIG. 10 is a bottom view of a diaphragm membrane for the conventional four-compression-chamber diaphragm pump.
Figure 8:
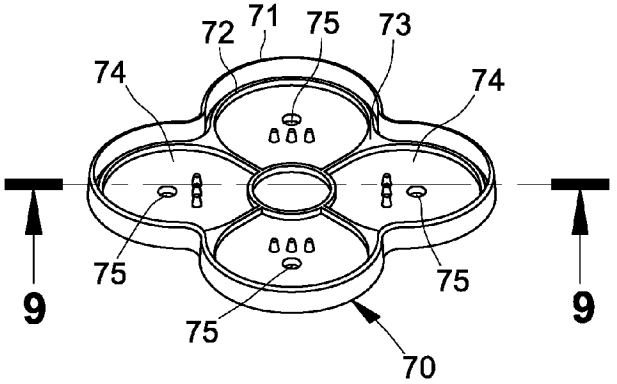
FIG.8 (PRIOR ART)
FIG. 8 is a perspective view of a diaphragm membrane for the conventional four-compression-chamber diaphragm pump.
Figure 9:
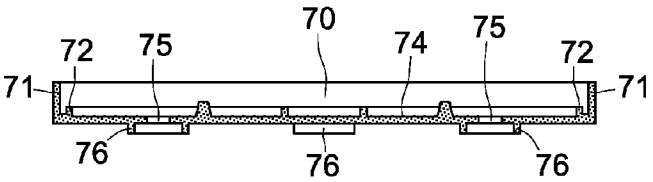
FIG.9 (PRIOR ART)
FIG. 9 is a cross sectional view taken against the section line 9-9 from previous FIG. 8.
Figure 11:
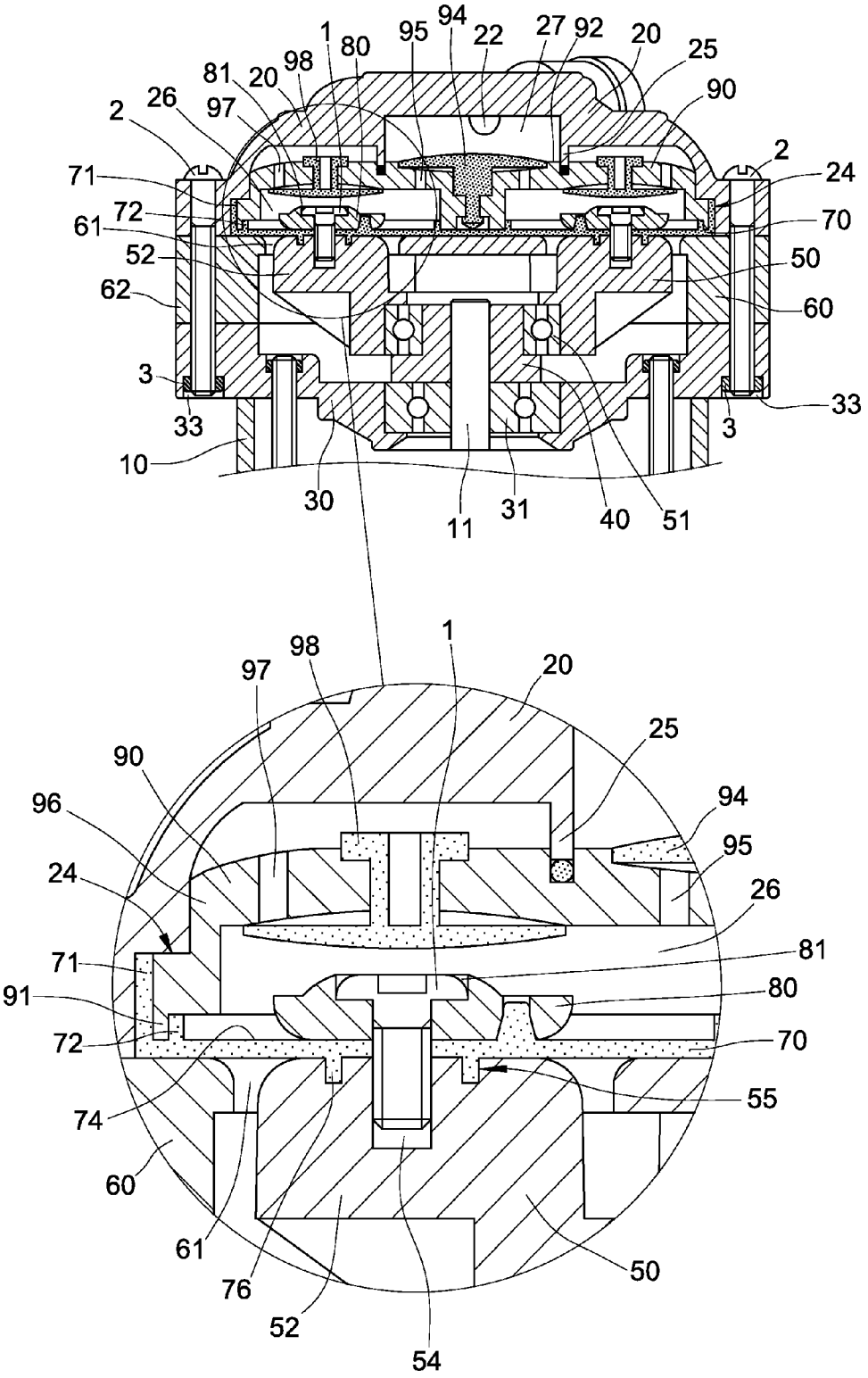
FIG.11 (PRIOR ART)
FIG. 11 is a cross sectional view taken against the section line 11-11 from previous FIG. 1.
Figure 12:
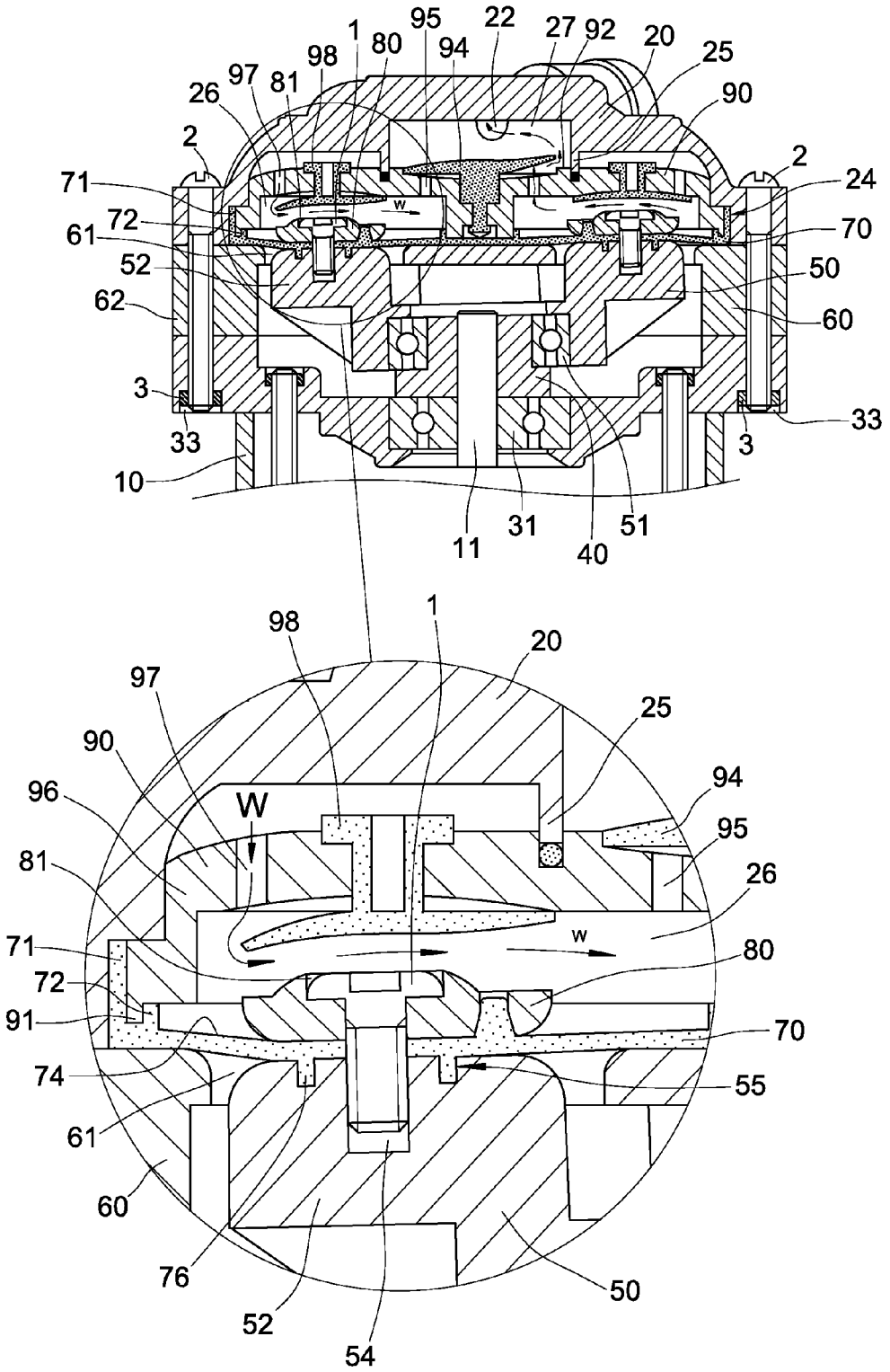
FIG.12 (PRIOR ART)
FIG. 12 is a first operation illustrative view of a conventional four-compression-chamber diaphragm pump.
Figure 13:
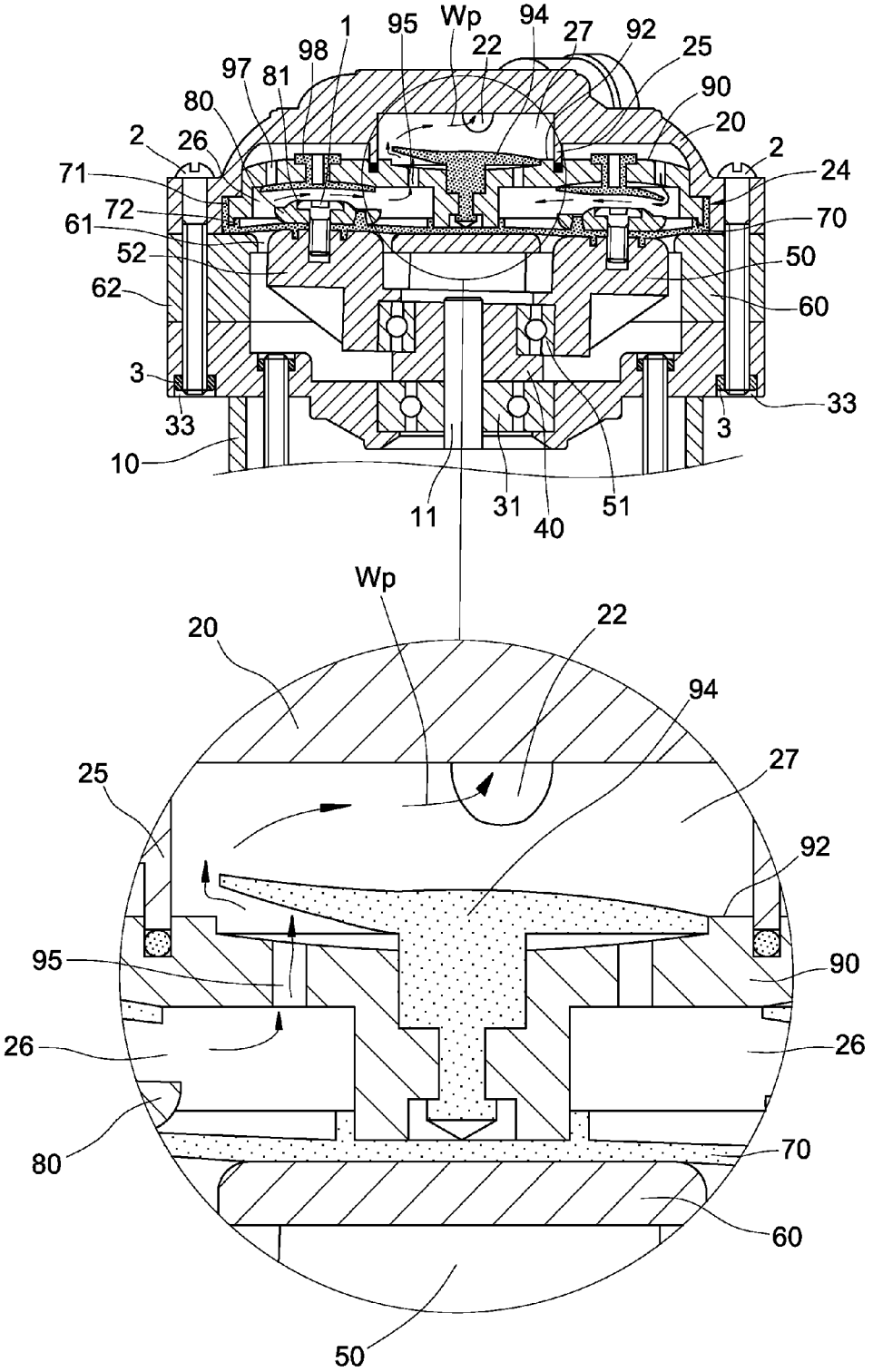
FIG.13 (PRIOR ART)
FIG. 13 is a second operation illustrative view of a conventional four-compression-chamber diaphragm pump.
Figure 14:
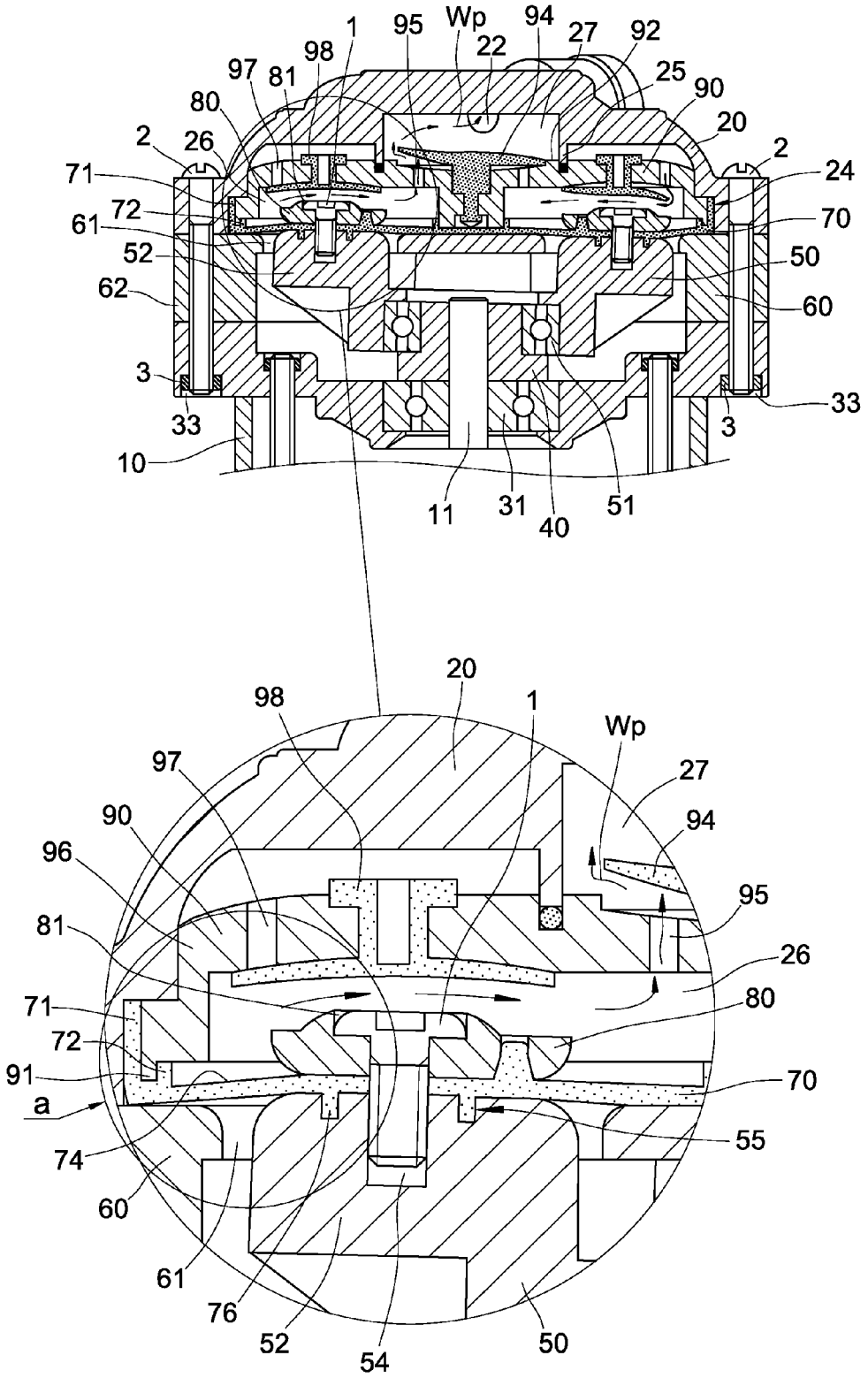
FIG.14 (PRIOR ART)
FIG. 14 is a third operation illustrative view of a conventional four-compression-chamber diaphragm pump.
Figure 26:
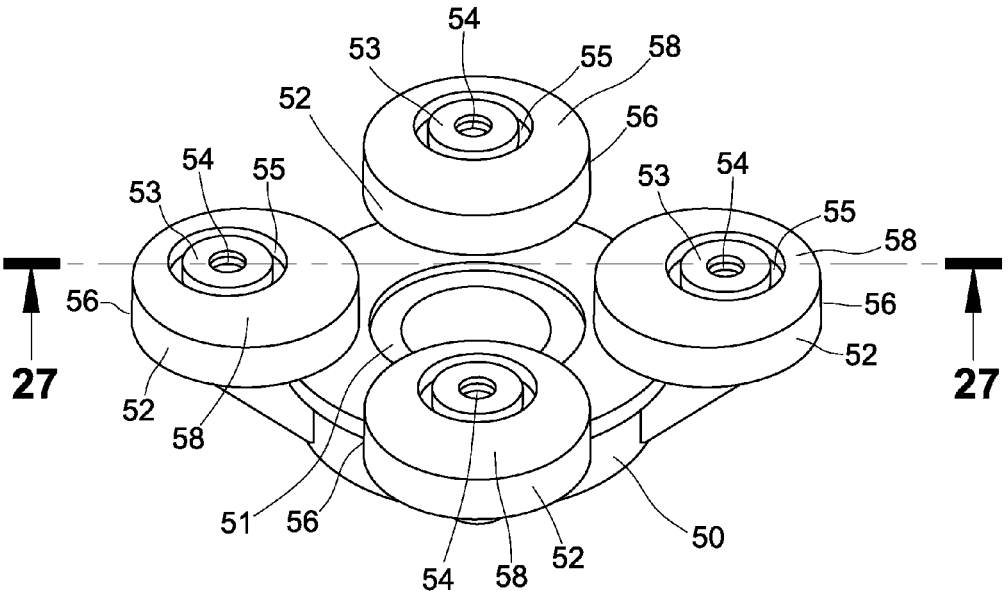
FIG. 26 is a perspective view of a eccentric roundel mount in the first exemplary embodiment of the present invention.
Figure 27:
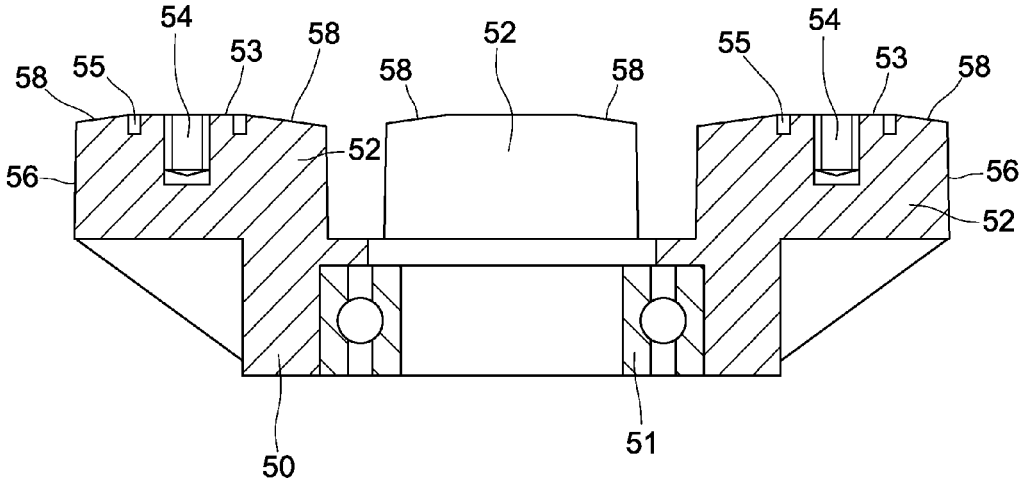
FIG. 27 is a cross sectional view taken against the section line 27-27 from previous FIG. 26.

Moreover, the cylindrical eccentric roundel 52 in the eccentric roundel mount 50 includes an annular top surface portion that is inclined relative to horizontal to form a sloped top ring 58 between the annular positioning groove 55 and a vertical flank 56 (as shown in FIGS. 26 and 27), the sloped top ring 58 replacing the conventional rounded shoulder 57 in each tubular eccentric roundel 52 of the eccentric roundel mount 50 (as shown in FIGS. 3 and 4).

FIGS. 29, 30, 15 and 16 are illustrative figures for comparing the length of the moment arm L2 obtained during operation of the four-compression-chamber diaphragm pump with multiple effects of the first exemplary embodiment in the present invention and the moment arm L1 obtained during operation of the conventional four-compression-chamber diaphragm pump.

Figure 15:
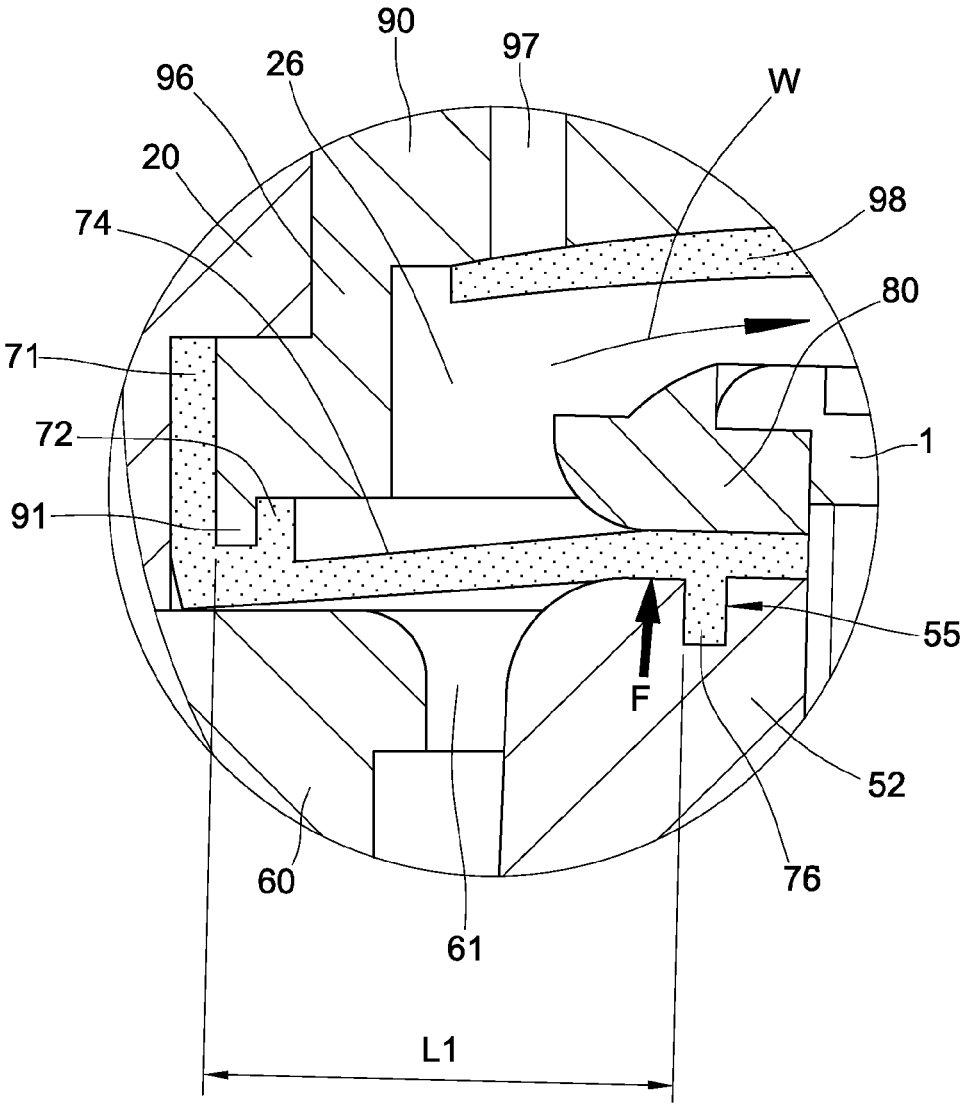
FIG.15 (PRIOR ART)
FIG. 15 is a partially enlarged view taken from circled-portion-a of previous FIG. 14.
Figure 17:
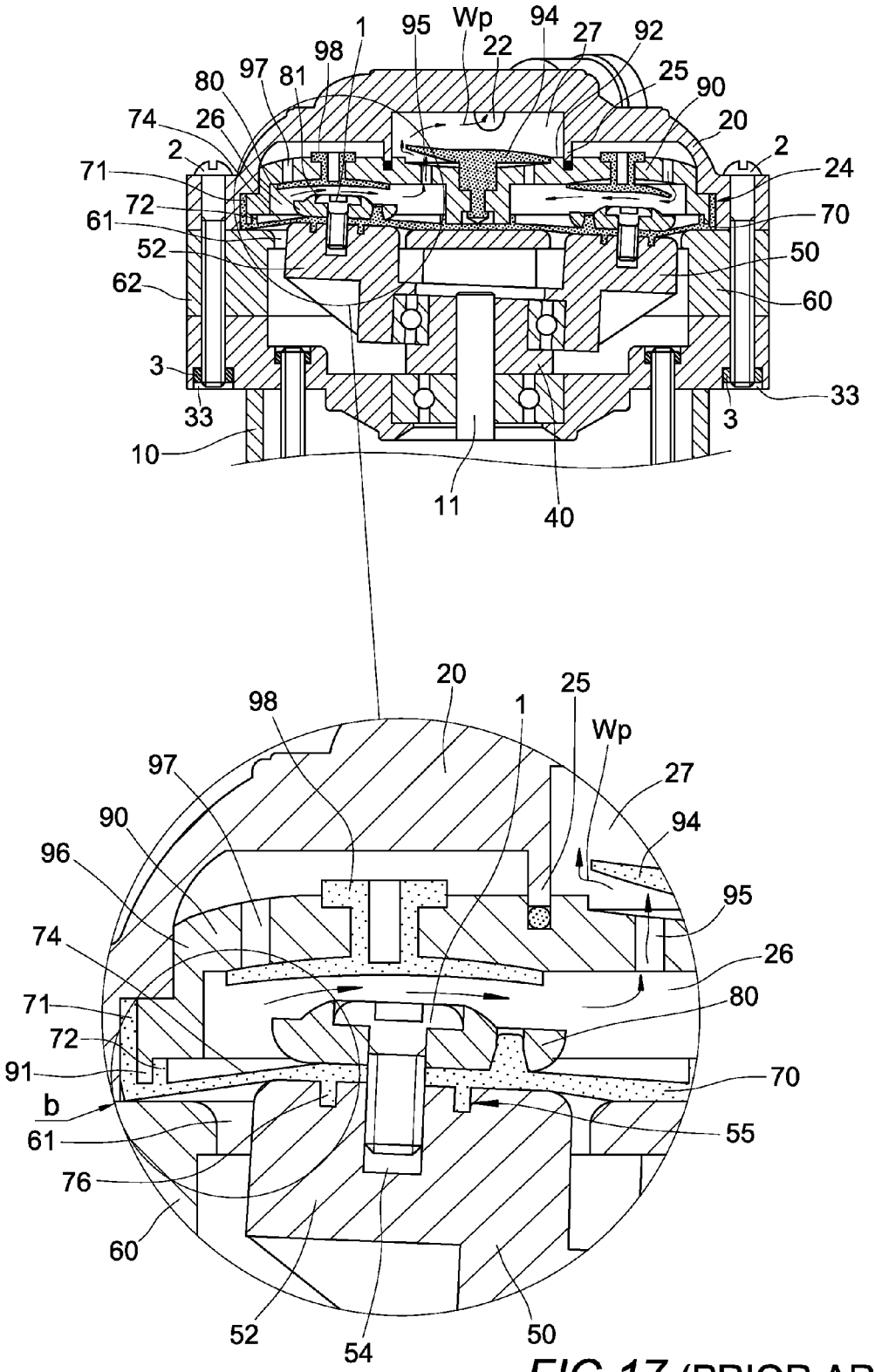
FIG.17 (PRIOR ART)
FIG. 17 is a fourth operation illustrative view of a conventional four-compression-chamber diaphragm pump.
Figure 30:
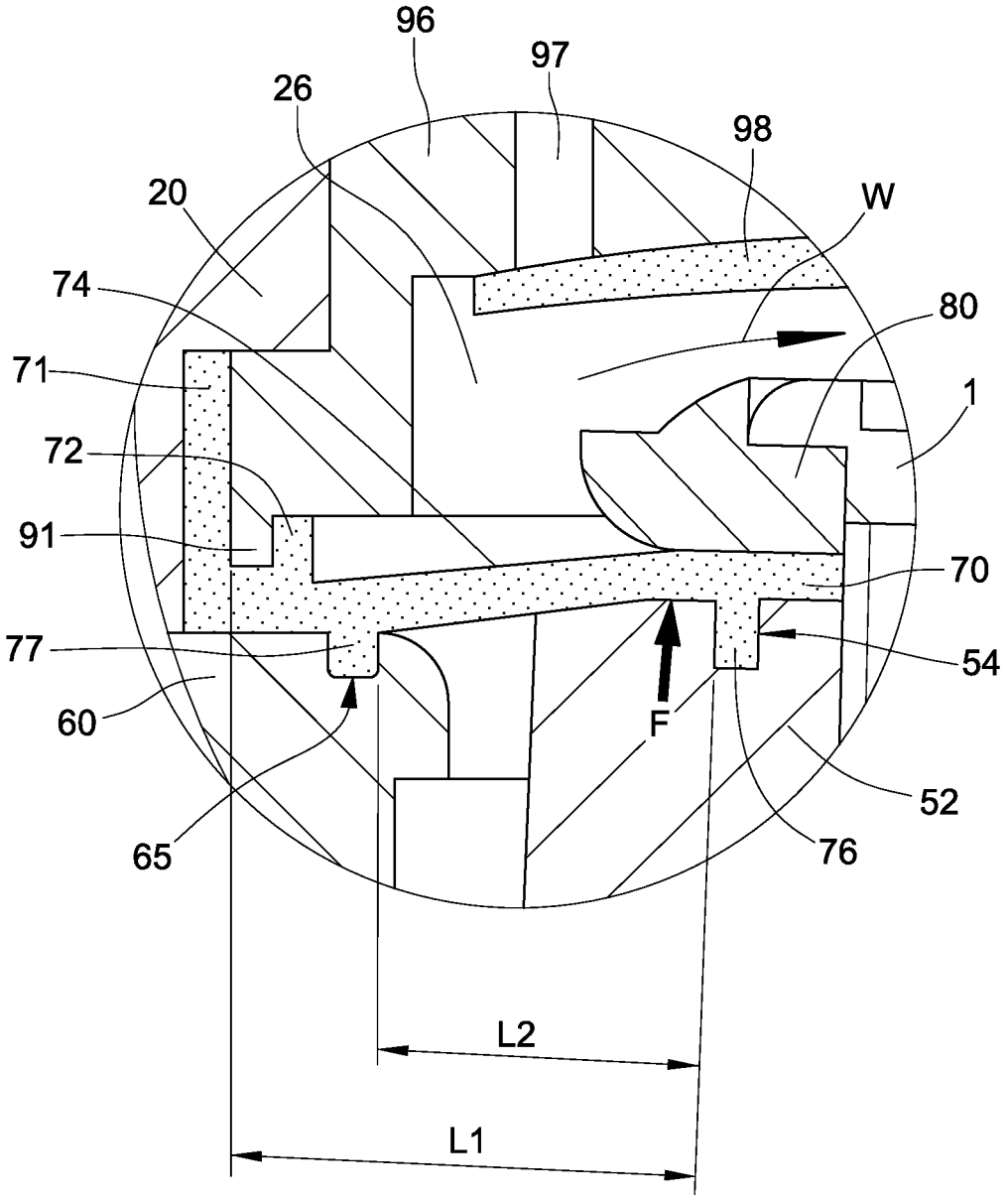
FIG. 30 is a partially enlarged view taken from circled-portion-a of FIG. 29.

During operation of the conventional four-compression-chamber diaphragm pump, a length of moment arm L1 extends from the outer raised rim 71 to the periphery of the annular positioning protruding block 76 in the diaphragm membrane 70 is obtained, as shown in FIG. 15). In contrast, a shorter length of moment arm L2 from the basic curved protrusions 77 to the periphery of the annular positioning protruding block 76 in the diaphragm membrane 70 is obtained in the operation of the present invention, as shown in FIG. 30.

Because the resultant torque in the exemplary embodiment of the present invention is calculated by multiplying the same acting force F as in the conventional diaphragm pump by the shortened length of moment arm L2, the resultant torque of the present invention is smaller than that of the conventional four-compression-chamber diaphragm pump. With the smaller resultant torque of the present invention, the vibration strength resulting therefrom is substantially reduced.

In a practical test of a prototype of the present invention, the vibration strength was reduced to only one tenth (10%) of the vibration strength in the conventional four-compression-chamber diaphragm pump.

If the present invention is installed on the housing C of a reverse osmosis purification unit cushioned by a conventional cushion base 100 with a rubber shock absorber 102, as shown in FIG. 16, the unwanted noise caused by resonant shaking that is present in the conventional four-compression-chamber diaphragm pump can be completely eliminated.

Figure 31:
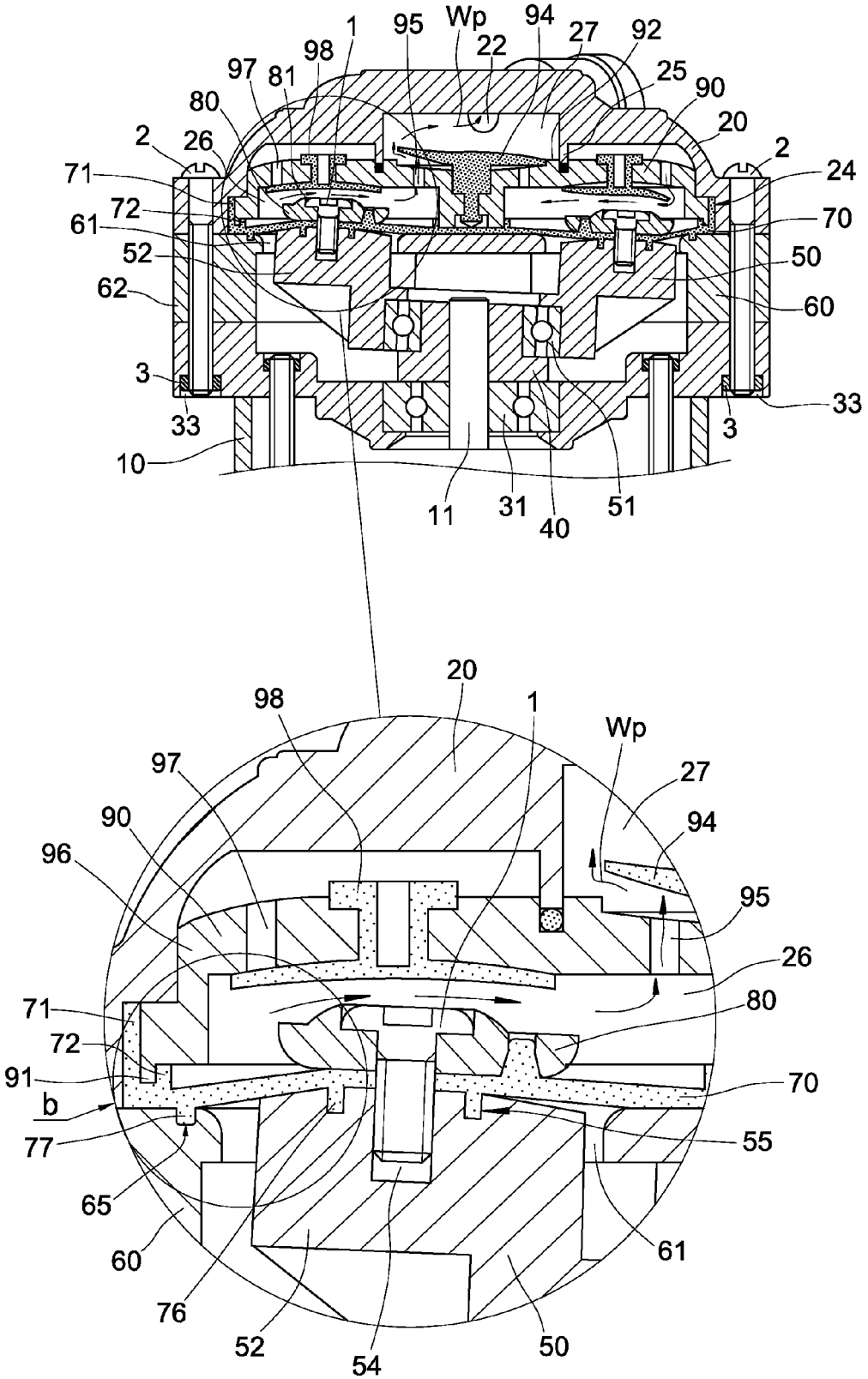
FIG. 31 is a second view illustrating operation of the first exemplary embodiment of the present invention.
Figure 32:
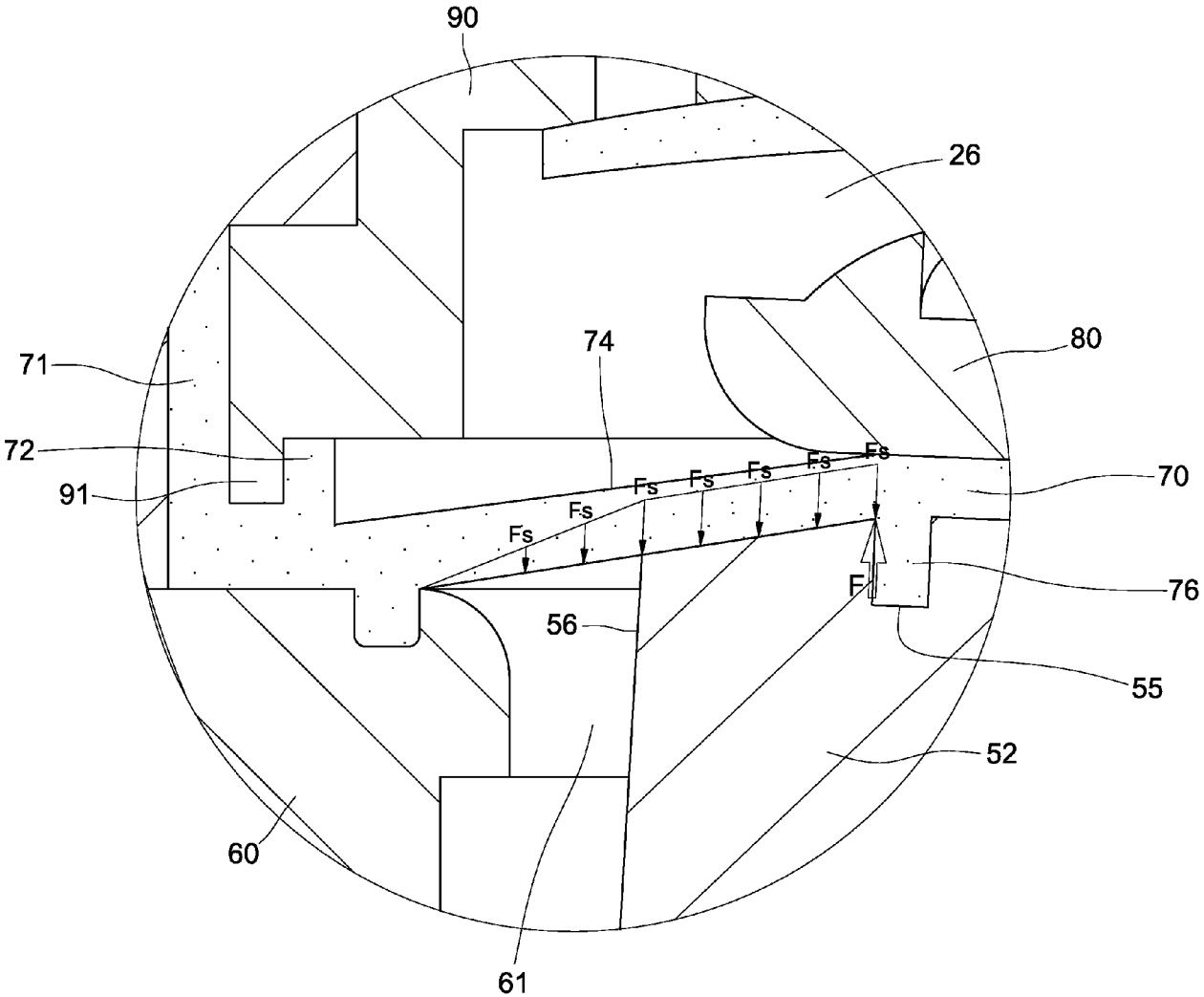
FIG. 32 is a partially enlarged view taken from circled-portion-b of previous FIG. 31.
Figure 33:
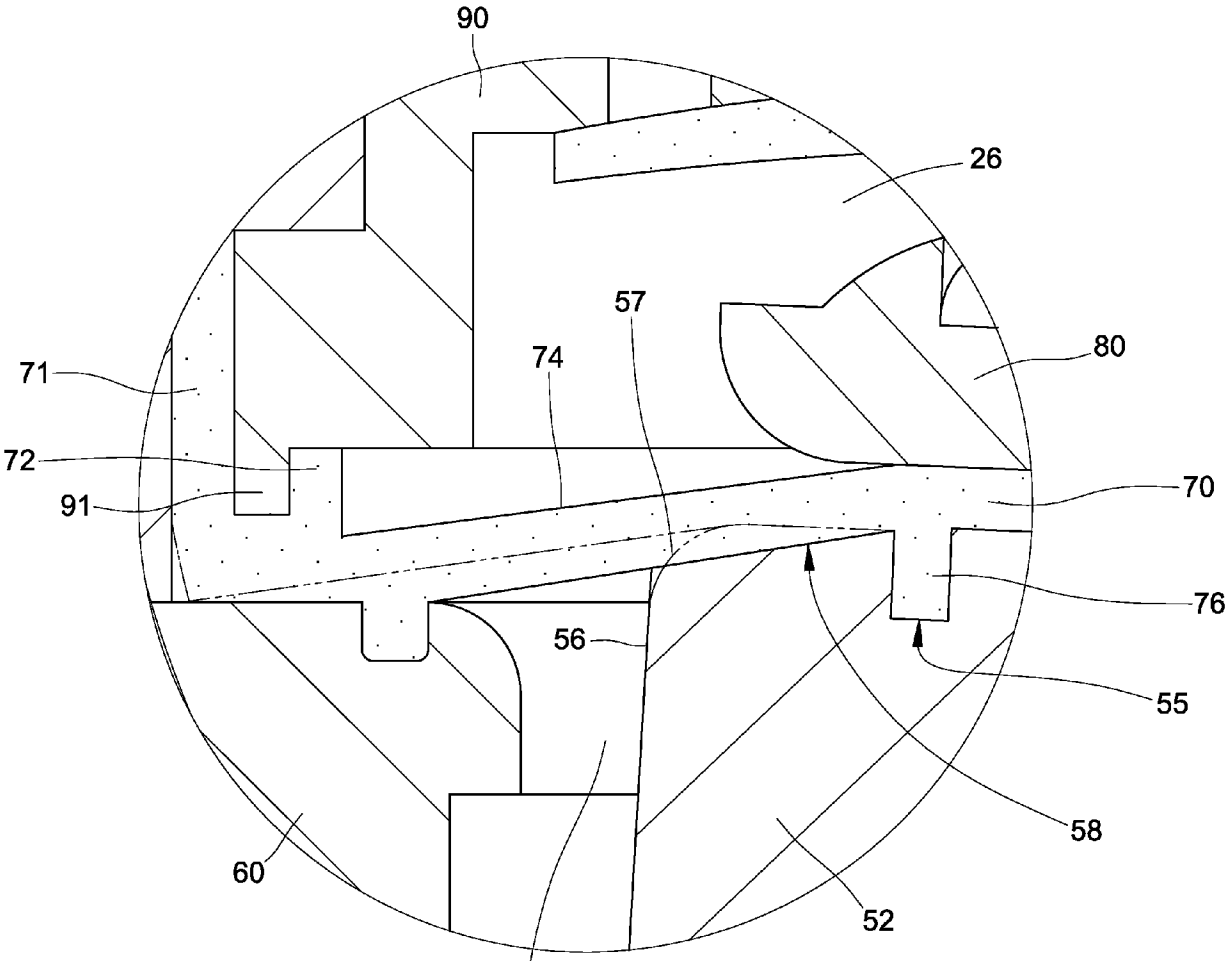
FIG. 33 is a cross sectional illustrative view showing a comparison between the cylindrical eccentric roundel acting on the diaphragm membrane of the conventional four-compression-chamber diaphragm pump and that of the first exemplary embodiment of the present invention.

FIGS. 31 through 33 are illustrative figures for the operation of the four-compression-chamber diaphragm pump with multiple effects in the first exemplary embodiment of the present invention.

Firstly, when the motor 10 is powered on, the wobble plate 40 is driven to rotate by the motor output shaft 11 so that the four cylindrical eccentric roundels 52 on the eccentric roundel mount 50 constantly move in a sequential up-and-down reciprocal stroke.

Secondly, four piston acting zones 74 in the diaphragm membrane 70 are sequentially driven by the up-and-down reciprocal stroke of four cylindrical eccentric roundels 52 to move in up-and-down displacement.

Thirdly, when the conventional tubular eccentric roundel or cylindrical eccentric roundel 52 of the present invention moves in an up stroke with the piston acting zone 74 in up displacement, an acting force F will obliquely pull on the partial portion between the corresponding annular positioning protrusion 76 and outer raised rim 71 of the diaphragm membrane 70.

Figure 18:
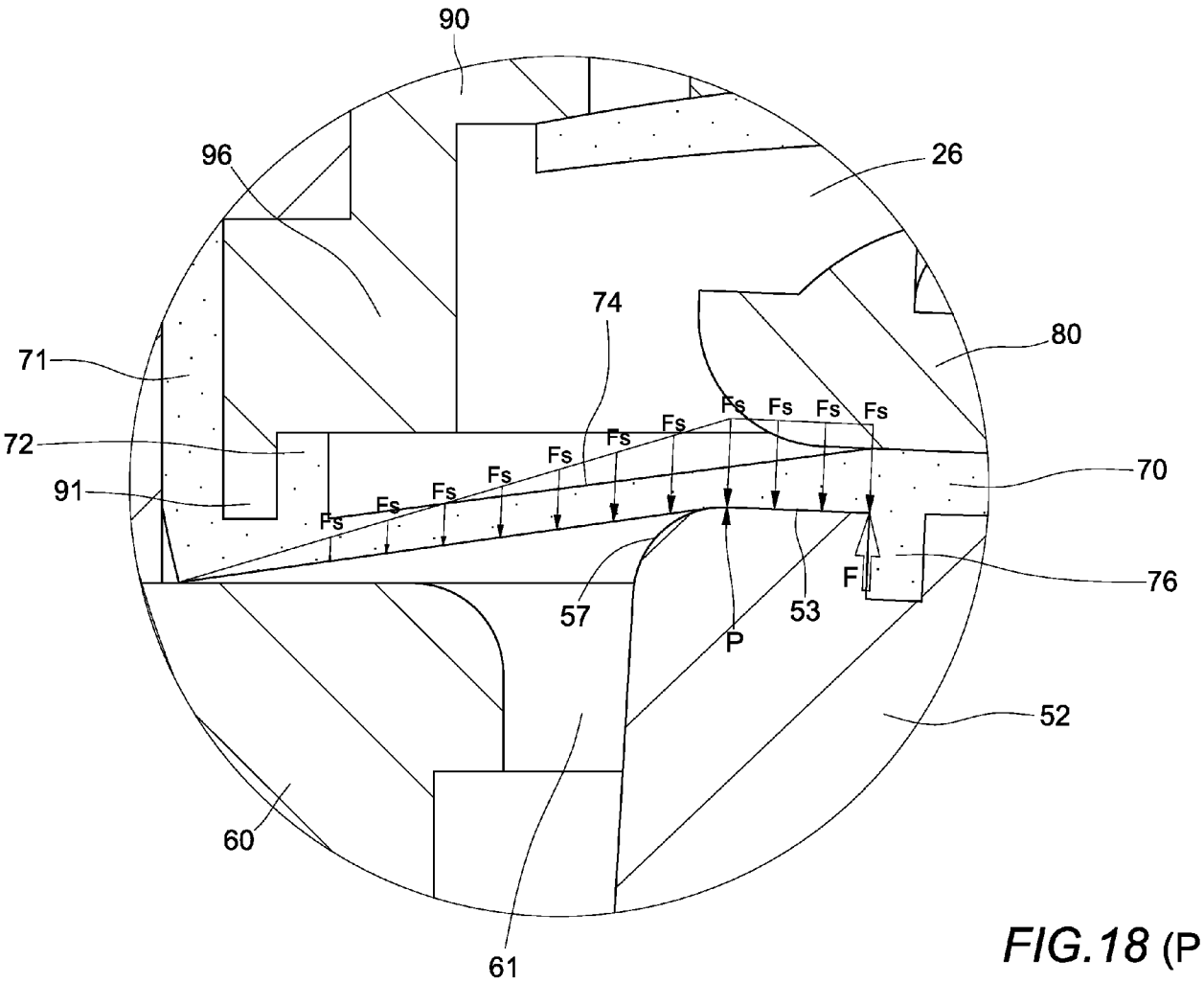
FIG. 18 (PRIOR ART)
FIG. 18 is a partially enlarged view taken from circled-portion-b of previous FIG. 17.
Figure 19:
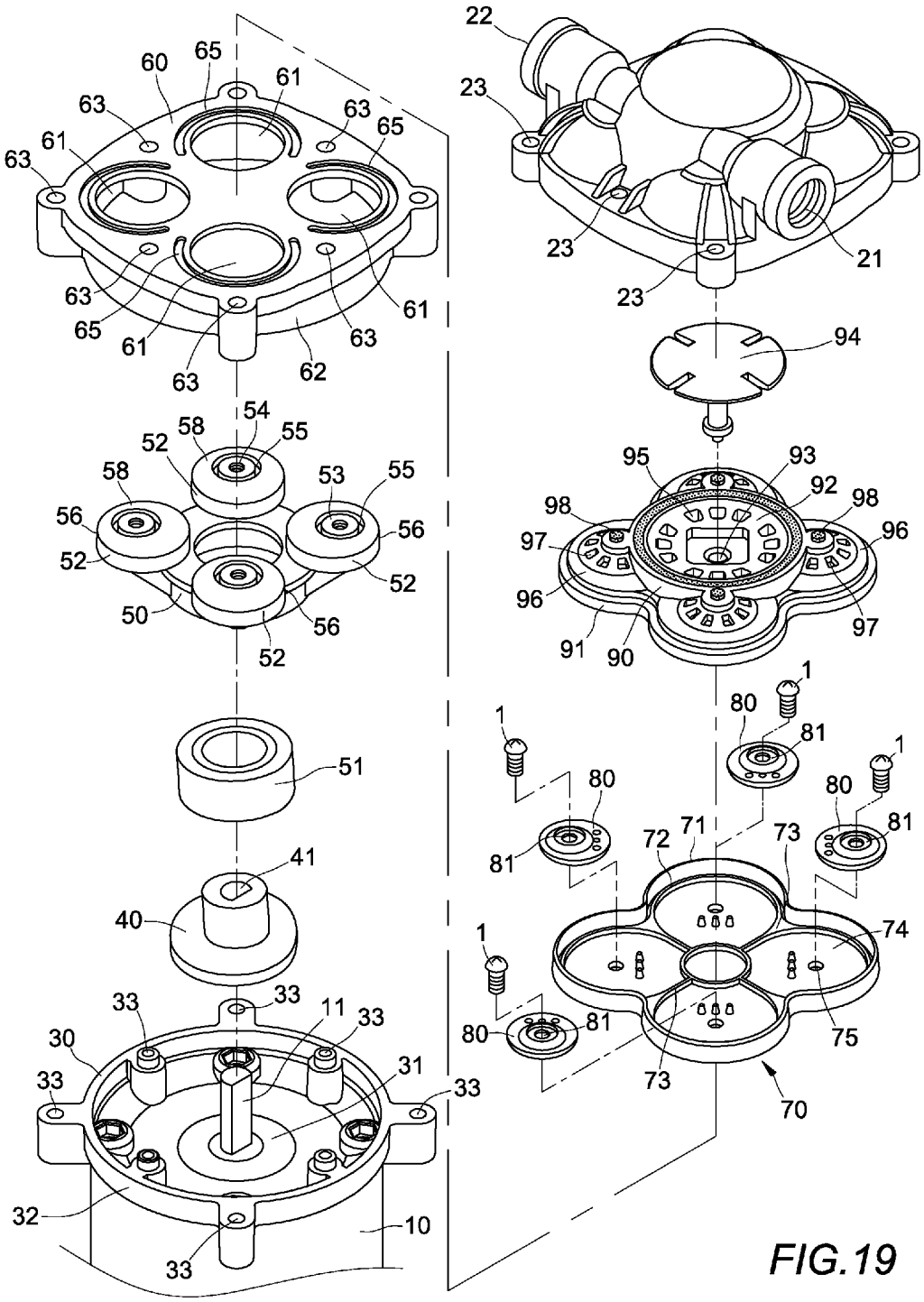
FIG. 19 is a perspective exploded view of the first exemplary embodiment of the present invention.

By comparing the operation of the conventional tubular eccentric roundels 52 shown in FIG. 18 and the cylindrical eccentric roundels 52 of the present invention, as illustrated in FIG. 32, at least the following two differences are evident:

In the case of conventional tubular eccentric roundel 52 shown in FIG. 18, the maximum among all of the distributed components Fs of the rebounding force is the component force exerted at the contacting bottom position P of the diaphragm membrane 70, which is located at an edge of the rounded shoulder 57 on a horizontal top face 53 of tubular eccentric roundel 52, so that the "squeezing phenomenon" at point P is also maximum. With such nonlinear distribution of the "squeezing phenomena," the obliquely pulling action becomes severe. In contrast, in the case of cylindrical eccentric roundels 52 as illustrated in FIG. 32, the distribution of components of the rebounding force Fs is more linear because the sloped top ring 58 therein flatly attaches to the bottom area of the piston acting zone 74 for the diaphragm membrane 70, so that the oblique pulling action is almost eliminated due to reduction in the squeezing phenomenon.

Moreover, under the same acting force F, the rebounding force Fs is inversely proportional to the contact area so that the magnitudes of the distributed components of the rebounding force Fs for the cylindrical eccentric roundels 52 of the present invention, as shown in FIG. 32, are substantially less than the magnitudes of the distributed components of the rebounding force Fs for the conventional tubular eccentric roundel 52 shown in FIG. 18.

The improved distribution linearity and decreased magnitudes of the rebounding force components Fs are the result of forming an annular top surface portion of the eccentric roundel mount 50 that is inclined relative to horizontal to form a sloped top ring 58 between the annular positioning groove 55 and the vertical flank 56 in the eccentric roundel mount 50, and results in at least two advantages. First, this arrangement eliminates susceptibility to breakage of the diaphragm membrane 70 caused by the high frequency squeezing phenomena, that occurs in the conventional arrangement as a result of the rounded shoulder 57 in the otherwise horizontal top face 53 of the tubular eccentric roundel 52. Second, the rebounding force Fs of the diaphragm membrane 70 caused by the acting force F, resulting from the sequential up-and-down displacement of the four piston acting zones 74 in the diaphragm membrane 70 driven by the up-and-down reciprocal stroke of the four tubular eccentric roundels or cylindrical eccentric roundels 52, is tremendously reduced.

These advantages result in the following practical benefits:

1. The durability of the diaphragm membrane 70 for sustaining the high frequency pumping action of the cylindrical eccentric roundels 52 is substantially enhanced.

2. The power consumption of the four-compression-chamber diaphragm pump is tremendously diminished due to less current being wasted as a result of the squeezing phenomena at high frequencies.

3. The working temperature of the four-compression-chamber diaphragm pump is tremendously reduced due to the decrease in power consumption.

4. The undesirable bearing noise caused by aging of the lubricant in the four-compression-chamber diaphragm pump, which is normally accelerated by the high working temperature, is mostly eliminated.

Test results carried out on a prototype of the present invention are as follows.

A. The service lifespan of the tested diaphragm membrane 70 was more than doubled.

B. The reduction in electric current consumption exceeded 1 ampere.

C. The working temperature was reduced by over 15 degrees Celsius.

D. The smoothness of the bearing was improved.

Figure 34:
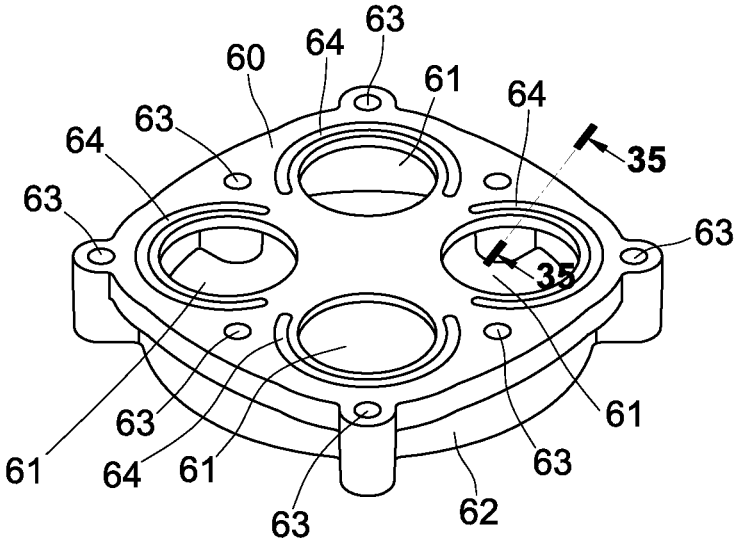
FIG. 34 is a perspective view of a variation of the pump head body of the first exemplary embodiment of the present invention.
Figure 35:
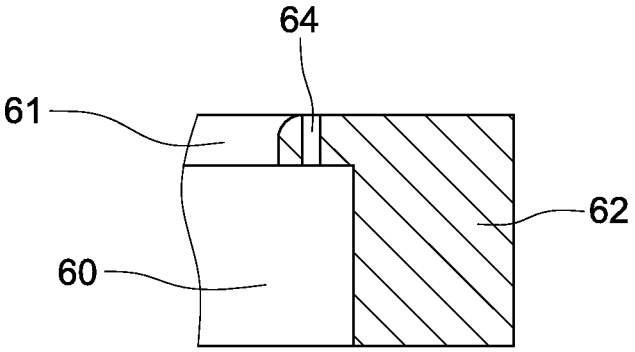
FIG. 35 is a cross sectional view taken against the section line 35-35 from previous FIG. 34.

As shown in FIGS. 34 and 35, in a variation of the first exemplary embodiment, each basic curved groove 65 of the pump head body 60 can be replaced by a basic curved bore 64.

Figure 36:
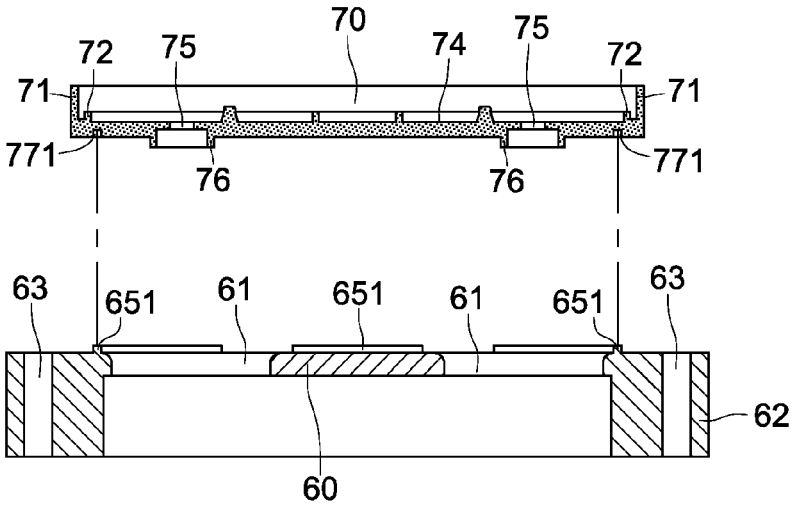
FIG. 36 is an exploded cross sectional view showing another variation of the pump head body and diaphragm membrane of the first exemplary embodiment of the present invention.
Figure 37:
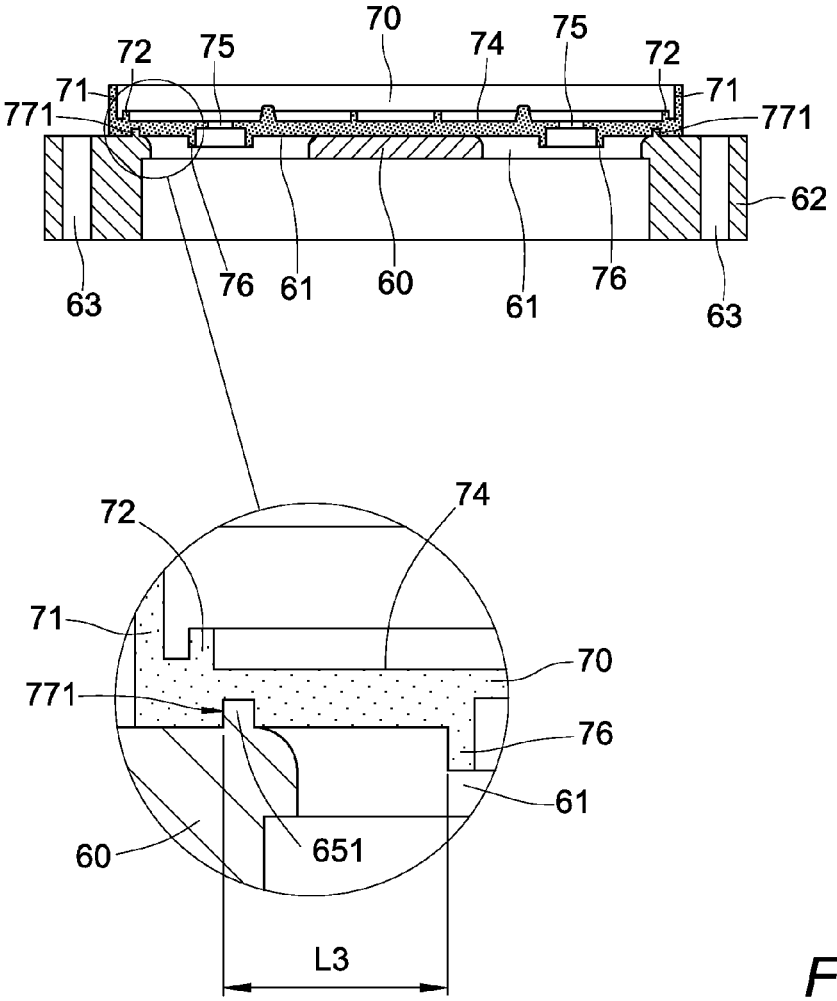
FIG. 37 is a cross sectional view showing assembly of the pump head body and diaphragm membrane of the first exemplary embodiment of the present invention.

Alternatively, as shown in FIGS. 36 and 37, in the first exemplary embodiment, each basic curved groove 65 in the pump head body 60 (as shown in FIGS. 20 and 22) and each corresponding basic curved protrusion 77 in the diaphragm membrane 70 (as shown in FIGS. 24 and 25) can be exchanged with a basic curved protrusion 651 in the pump head body 60 (as shown in FIG. 36) and a corresponding basic curved groove 771 in the diaphragm membrane 70 (as shown in FIG. 36) without affecting their mating condition.

Each basic curved protrusion 651 at the upper side of the pump head body 60 is completely inserted into each corresponding basic curved groove 771 at the bottom side of the diaphragm membrane 70 upon assembly of the pump head body 60 and the diaphragm membrane 70 (as shown in FIG. 37), with the result that a shortened length of moment arm L3 from the basic curved groove 771 to the periphery of the annular positioning protrusion 76 in the diaphragm membrane 70 is also obtained (as shown in the enlarged portion of FIG. 37), resulting in a significant reduction in vibrations.

Figure 40:
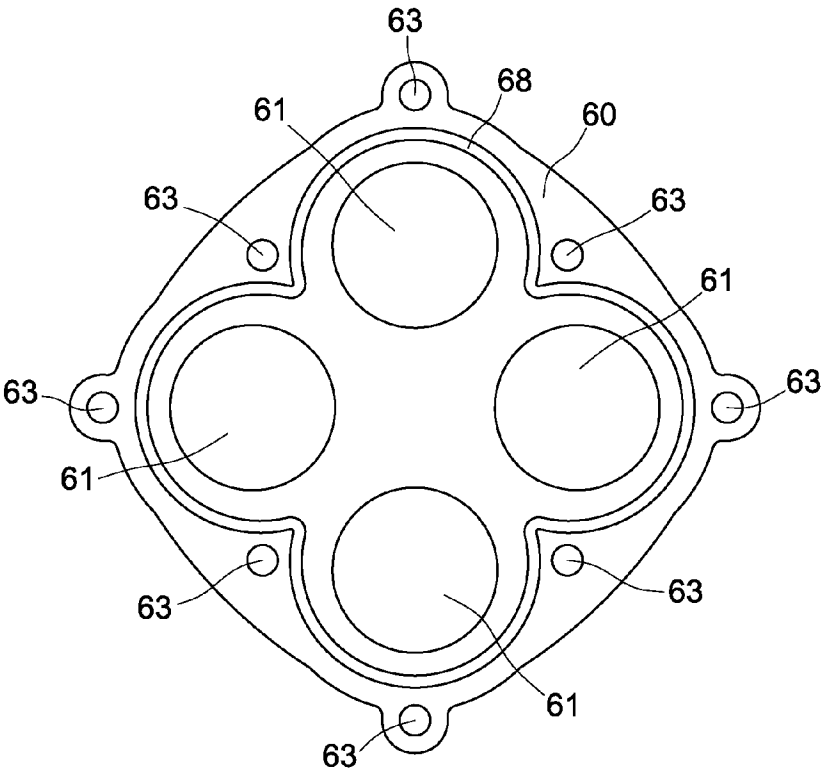
FIG. 40 is a top view of a pump head body in the second exemplary embodiment of the present invention.
Figure 38:
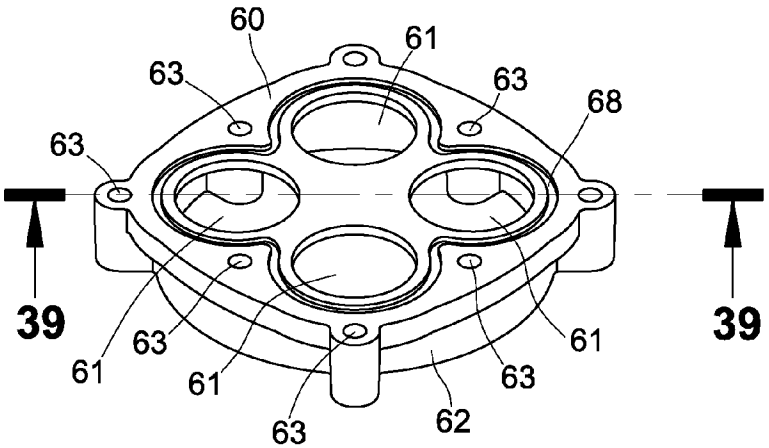
FIG. 38 is a perspective view of a pump head body in the second exemplary embodiment of the present invention.
Figure 39:
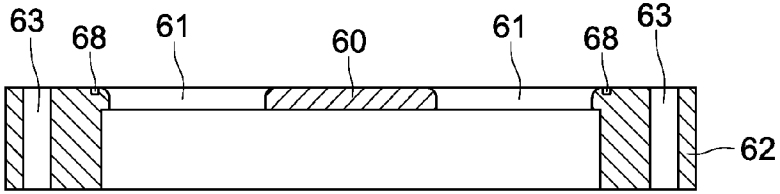
FIG. 39 is a cross sectional view taken against the section line 39-39 from previous FIG. 38.
Figure 43:
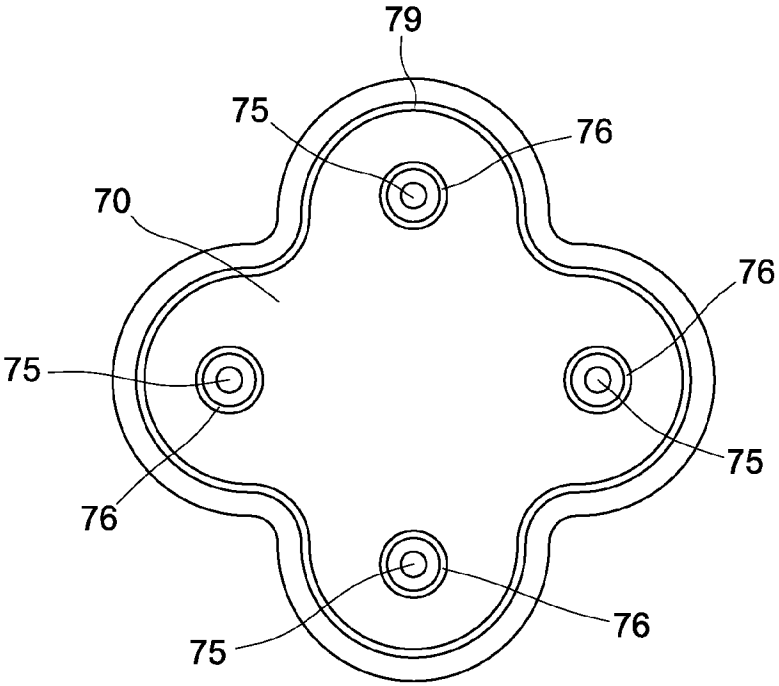
FIG. 43 is a bottom view of a diaphragm membrane in the second exemplary embodiment of the present invention.
Figure 41:
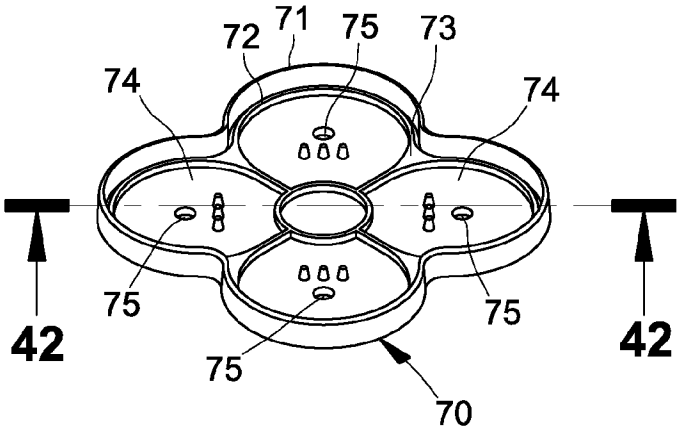
FIG. 41 is a perspective view of a diaphragm membrane in the second exemplary embodiment of the present invention.
Figure 42:
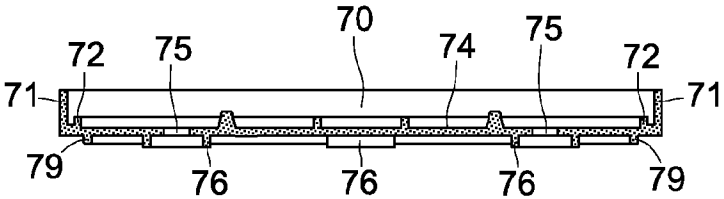
FIG. 42 is a cross sectional view taken against the section line 42-42 from previous FIG. 41.

Please refer to FIGS. 38 through 44, which are illustrative figures of a four-compression-chamber diaphragm pump with multiple effects for the second exemplary embodiment of the present invention, In this embodiment, the four basic grooves 65 in the pump head body 60 as shown in FIGS. 20 through 22 may be linked to form a continuous four-curved groove 68 to that encompasses all four operating holes 61, as shown in FIGS. 38 through 40, and the four corresponding basic curved protrusions 77 in the diaphragm membrane 70 shown in FIGS. 24 and 25 can be linked to form a continuous four-curved protrusion 79 at a position corresponding to the position of the continuous four-curved groove 68 in the pump head body 60 to encompass all four annular positioning protrusions 76, as shown in FIGS. 42 and 43.

Figure 44:
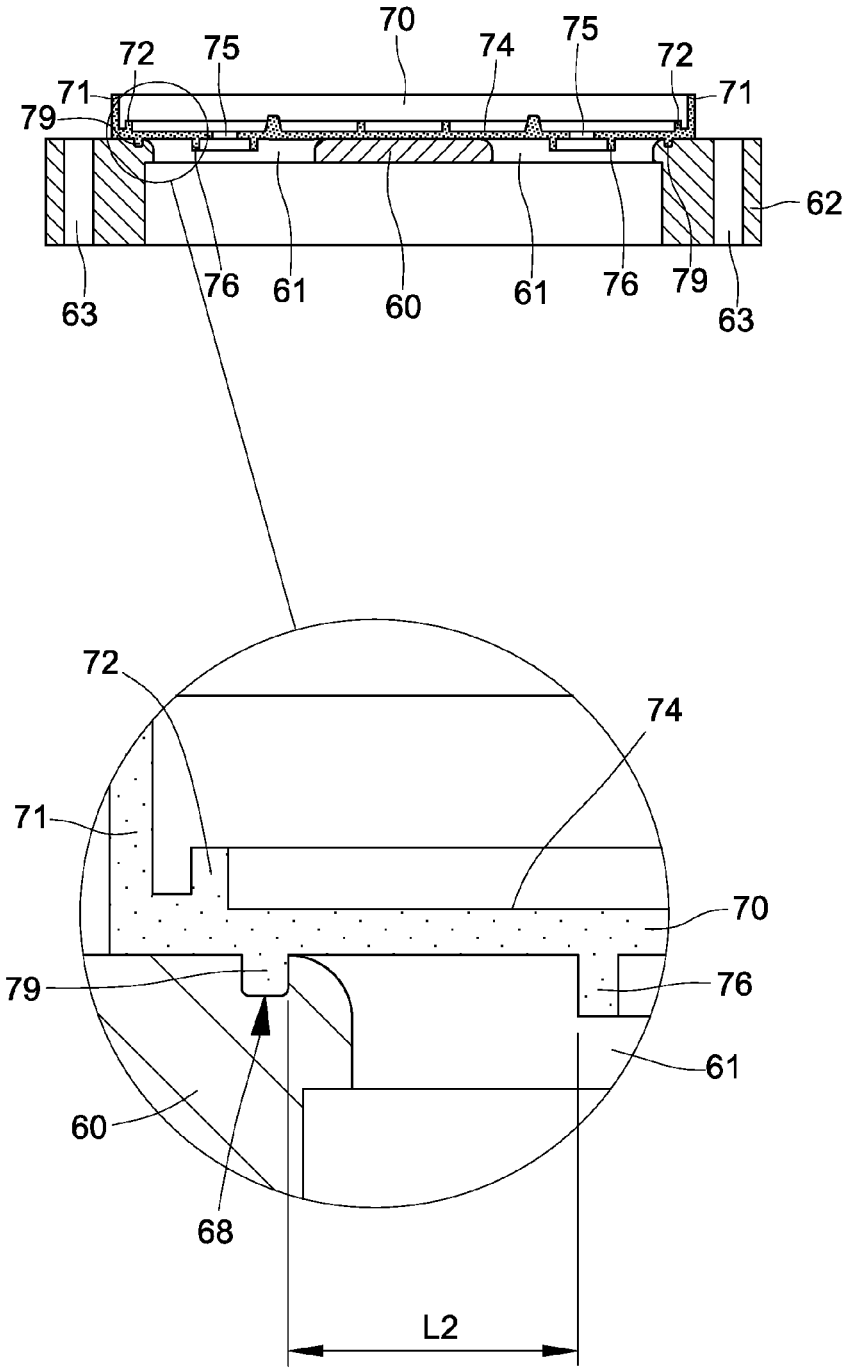
FIG. 44 is a cross sectional view showing the assembly of a diaphragm membrane and a pump head body for the second exemplary embodiment of the present invention.

The continuous four-curved protrusion 79 at the bottom side of the diaphragm membrane 70 is completely inserted into the corresponding continuous four-curved groove 68 at the upper side of the pump head body 60 upon assembly of the pump head body 60 and the diaphragm membrane 70, as shown in FIG. 44, to obtain a shortened length of moment arm L2 extending from the continuous four-curved protrusion 79 to the periphery of the annular positioning protrusion 76 in the diaphragm membrane 70, as shown in the enlarged insert of FIG. 44, thereby significantly reducing vibrations.

Figure 45:
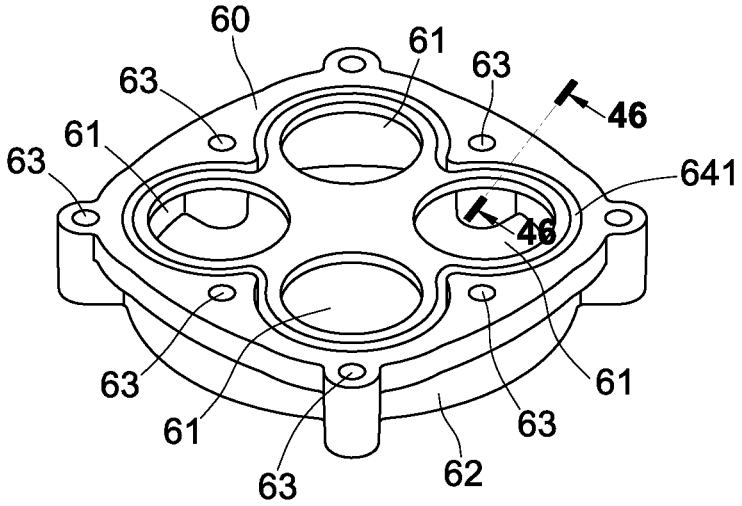
FIG. 45 is a perspective view of a modified pump head body in the second exemplary embodiment of the present invention.
Figure 46:
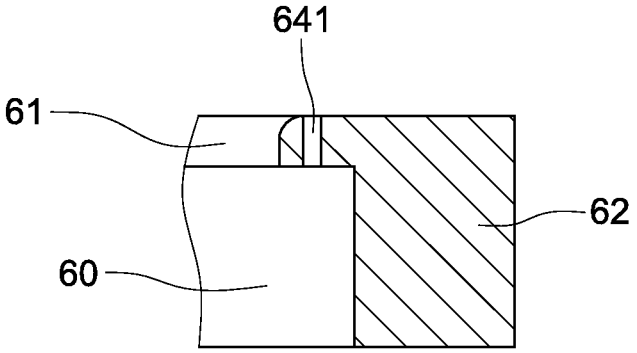
FIG. 46 is a cross sectional view taken against the section line 46-46 from previous FIG. 45.

As shown in FIGS. 45 and 46, in the second exemplary embodiment, the continuous four-curved groove 68 of the pump head body 60 may be replaced by a four-curved slot 641.

Figure 47:
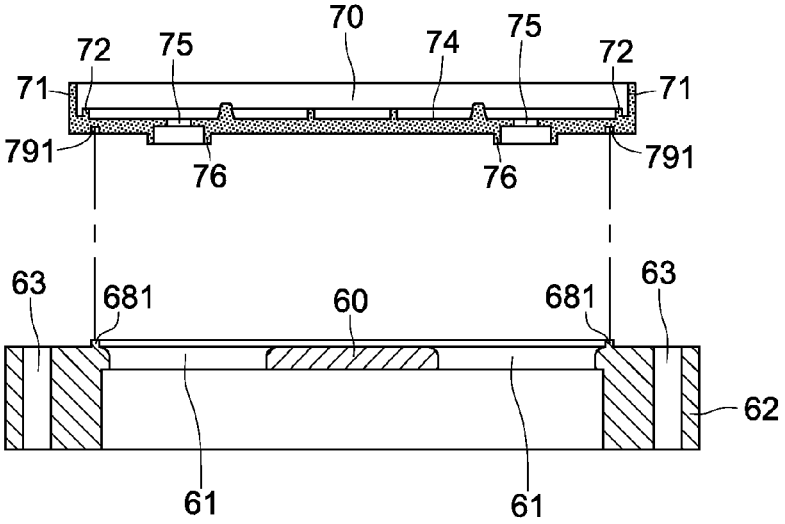
FIG. 47 is an exploded cross sectional view showing a second modified pump head body and diaphragm membrane of the second exemplary embodiment of the present invention.
Figure 48:
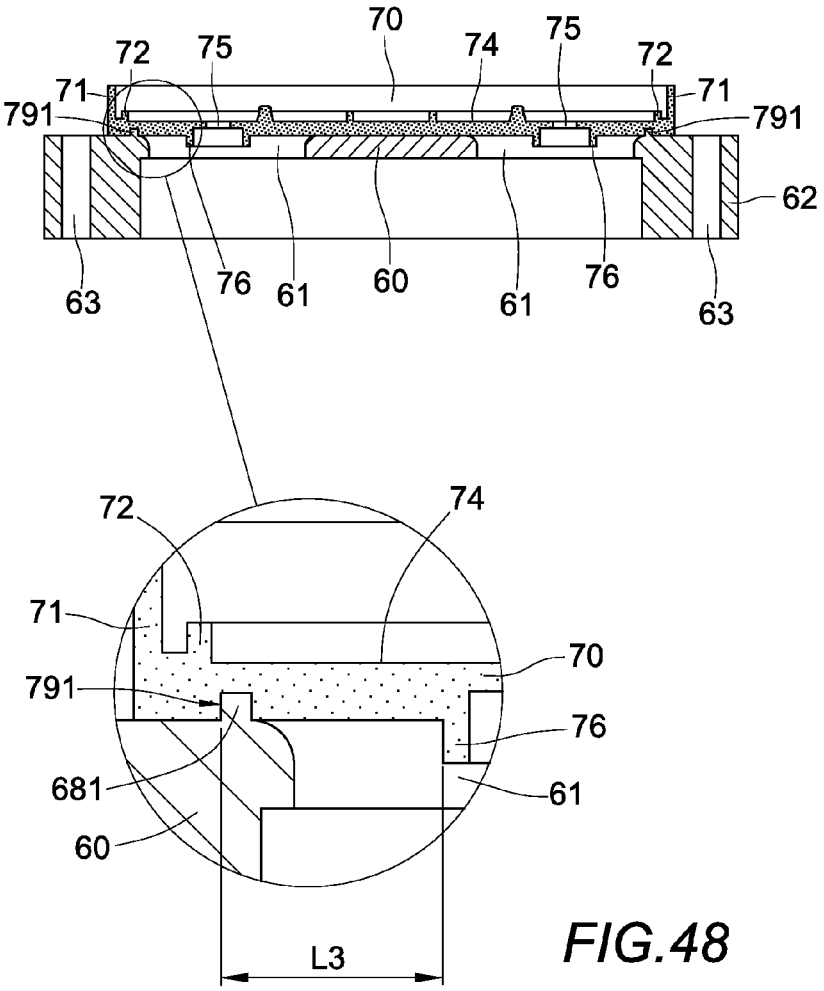
FIG. 48 is a cross sectional view showing assembly of the second modified pump head body and diaphragm membrane in the second exemplary embodiment of the present invention.

Also, as shown in FIGS. 47 and 48, in the second exemplary embodiment, the continuous four-curved groove 68 in the pump head body 60 (as shown in FIGS. 38 to 40) and the corresponding continuous four-curved protrusion 79 in the diaphragm membrane 70 shown in FIGS. 42 and 43 can be replaced by a continuous four-curved protrusion 681 in the pump head body 60, as shown in FIG. 47, and a continuous four-curved groove 791 in the diaphragm membrane 70 (as shown in FIG. 47) without affecting their mating condition.

The continuous four-curved protrusion 681 at the upper side of the pump head body 60 is completely inserted into the continuous four-curved groove 791 at the bottom side of the diaphragm membrane 70 upon assembly of the pump head body 60 and the diaphragm membrane 70, as shown in FIG. 48 to reduce the length of moment arm L3 from the continuous four-curved groove 791 to the periphery of the annular positioning protrusion 76 in the diaphragm membrane 70 during operation of the present invention, as shown in the enlarged section of FIG. 48, and thereby significantly reduce vibrations.

FIGS. 49 through 55 are illustrative figures of a four-compression-chamber diaphragm pump with multiple effects for the third exemplary embodiment in the present invention.

Figure 51:
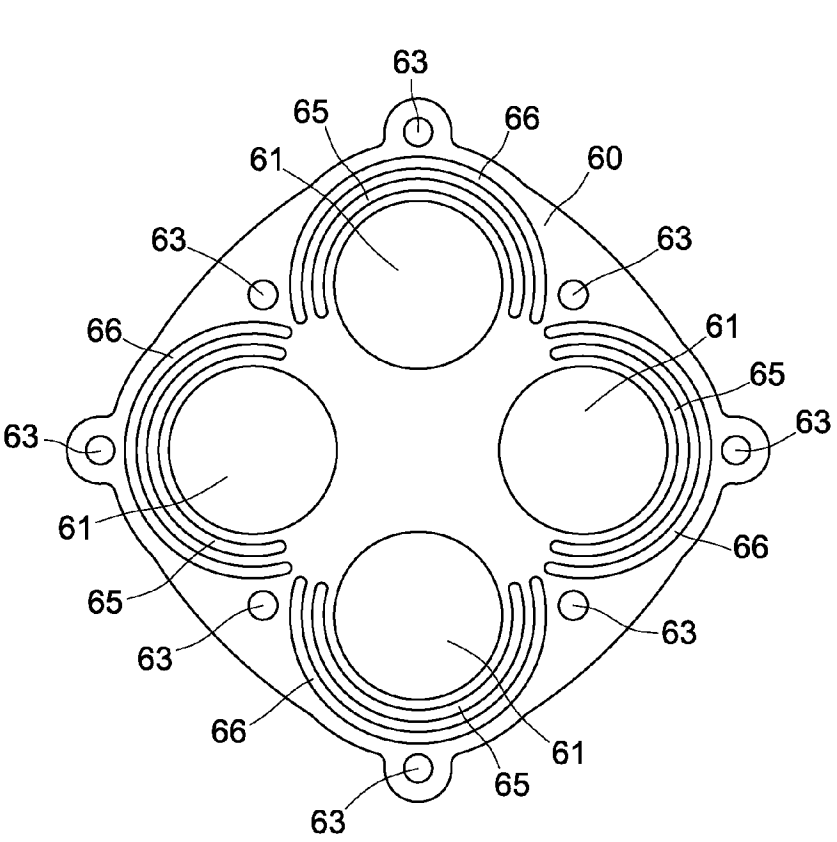
FIG. 51 is a top view of a pump head body in the third exemplary embodiment of the present invention.
Figure 49:
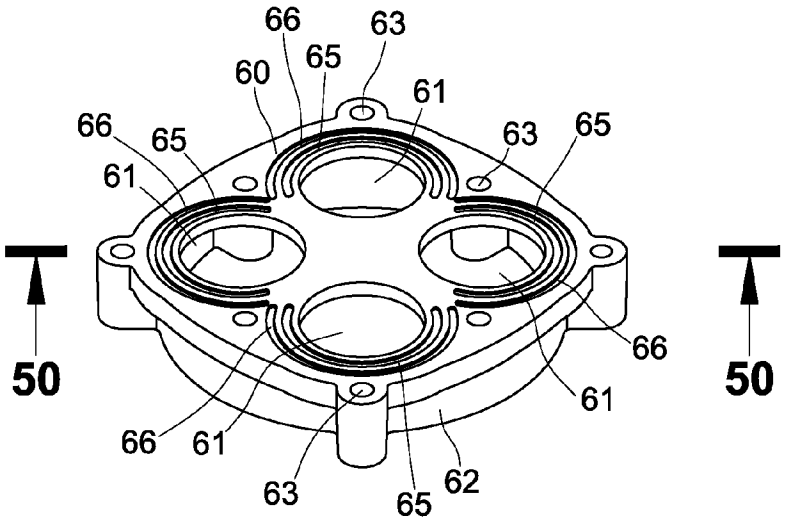
FIG. 49 is a perspective view of a pump head body in the third exemplary embodiment of the present invention.
Figure 50:
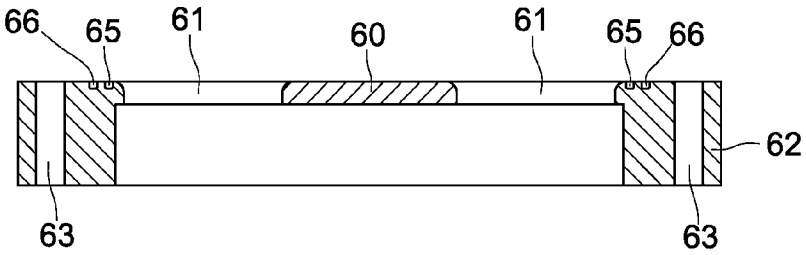
FIG. 50 is a cross sectional view taken against the section line 50-50 from previous FIG. 49.
Figure 54:
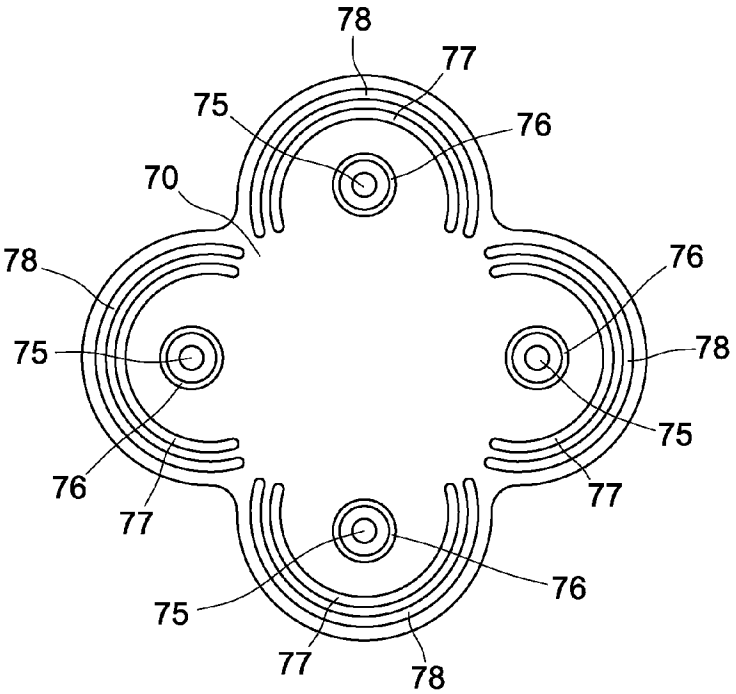
FIG. 54 is a bottom view of a diaphragm membrane in the third exemplary embodiment of the present invention.
Figure 52:
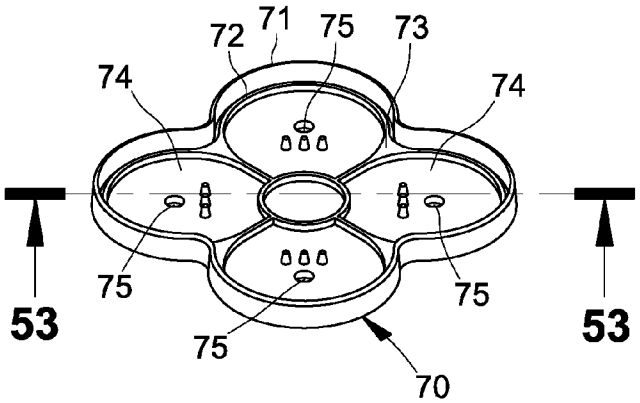
FIG. 52 is a perspective view of a diaphragm membrane in the third exemplary embodiment of the present invention.
Figure 53:
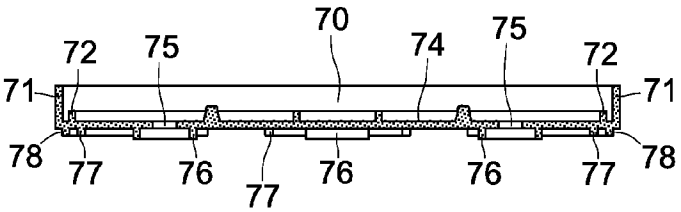
FIG. 53 is a cross sectional view taken against the section line 53-53 from previous FIG. 52.

In the third exemplary embodiment, a second outer curved groove 66 is further circumferentially disposed around each basic curved groove 65 in the pump head body 60, as shown in FIGS. 49 through 51, while a second outer curved protrusion 78 is further circumferentially disposed around each basic curved protrusion 77 in the diaphragm membrane 70 at a position corresponding to a position of each mating second outer curved groove 66 in the pump head body 60, as shown in FIGS. 53 and 54.

Figure 55:
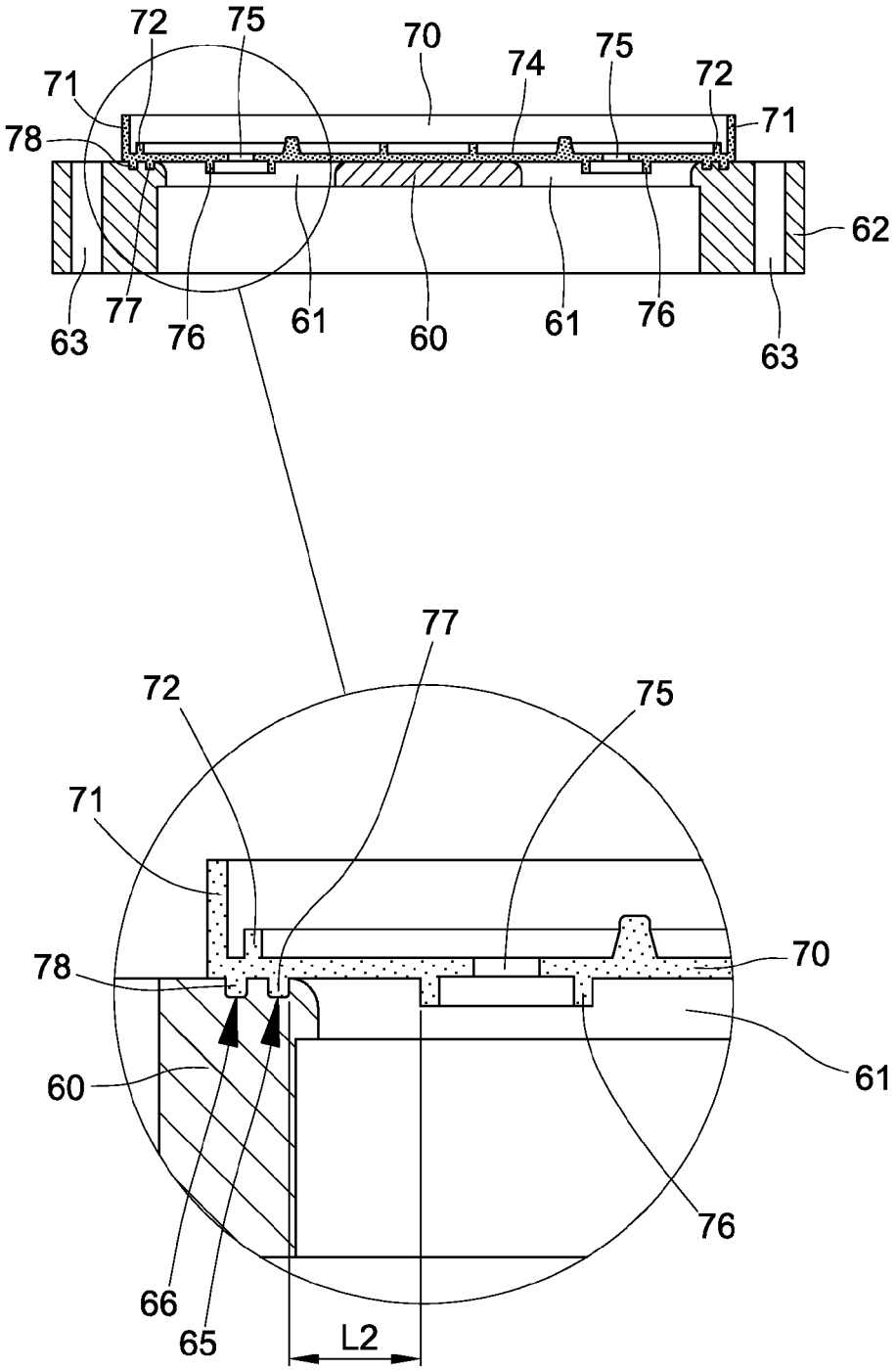
FIG. 55 is a cross sectional view showing the assembly of a diaphragm membrane and a pump head body for the third exemplary embodiment of the present invention.

Each pair of basic curved protrusions 77 and second outer curved protrusion 78 at the bottom side of the diaphragm membrane 70 is completely inserted into each pair of corresponding basic curved grooves 65 and second outer curved grooves 66 at the upper side of the pump head body 60 upon assembly of the pump head body 60 and the diaphragm membrane 70 (as shown in the enlarged portion of FIG. 55), resulting in relatively a short length of moment arm L2 from the basic curved protrusion 77 to the periphery of the annular positioning protrusion 76 in the diaphragm membrane 70 during operation of the present invention (as shown in the enlarged portion of FIG. 55).

The shortened length of moment arm L2 not only has a significant effect in reducing vibration but also enhances stability by preventing displacement and maintaining the length of moment arm L2 to resist the acting force F on the eccentric roundel 52.

Figure 56:
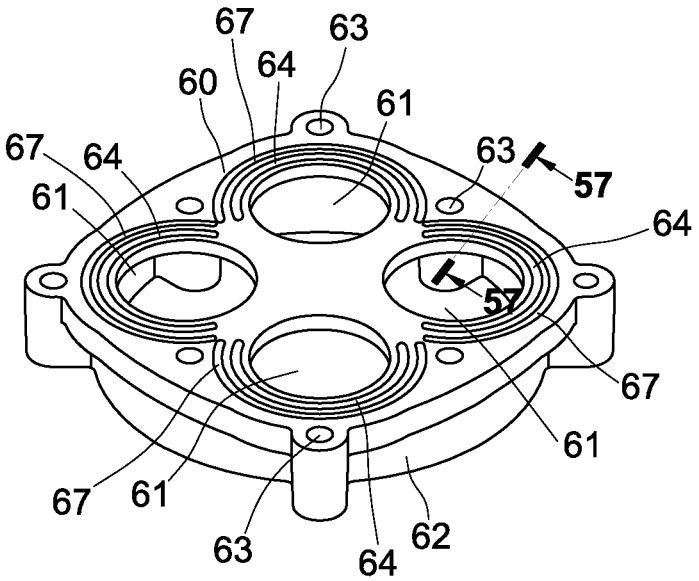
FIG. 56 is a perspective view of a modified pump head body in the third exemplary embodiment of the present invention.
Figure 57:
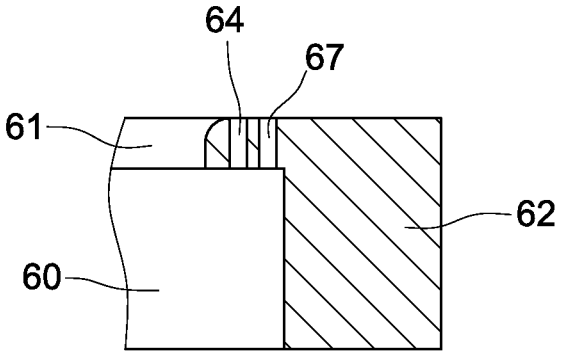
FIG. 57 is a cross sectional view taken against the section line 57-57 from previous FIG. 56.

As shown in FIGS. 56 and 57, in the third exemplary embodiment, each pair of basic curved grooves 65 and second outer curved grooves 66 of the pump head body 60 can be replaced by a pair of basic curved bores 64 and second outer curved bores 67.

Figure 58:
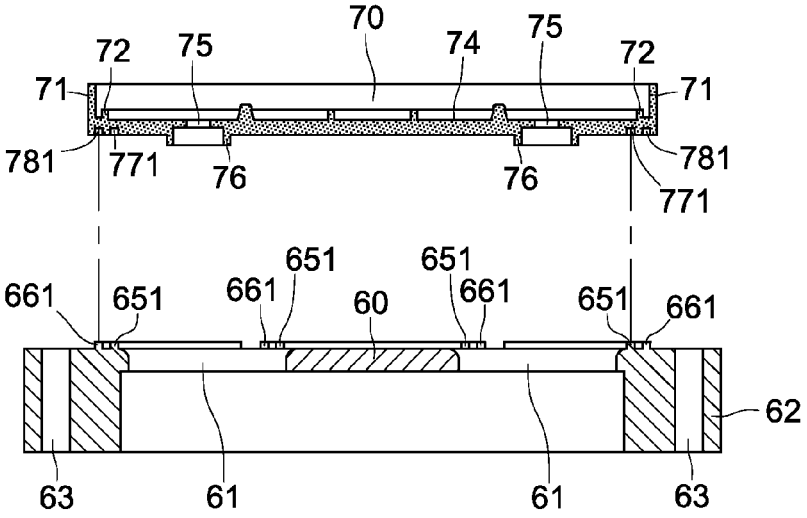
FIG. 58 is a cross sectional view showing explosion of a second modified pump head body and diaphragm membrane in the third exemplary embodiment of the present invention.
Figure 59:
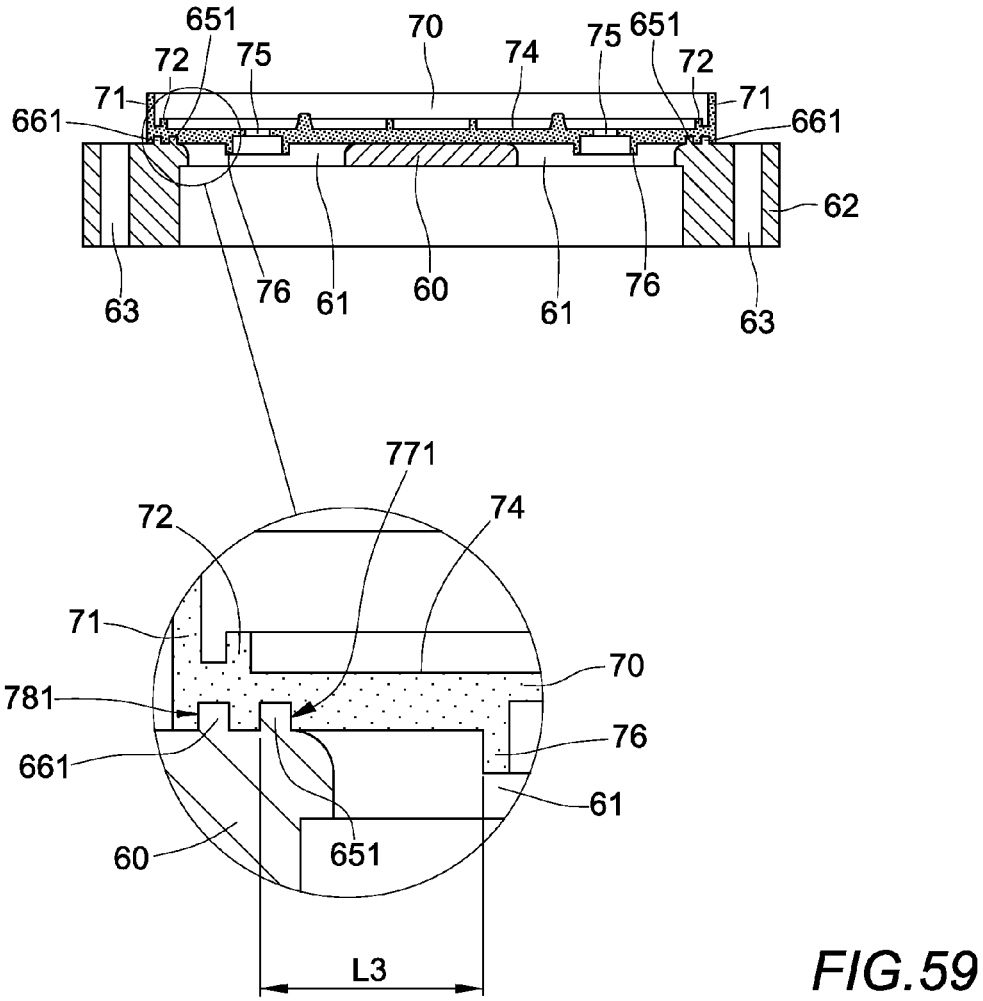
FIG. 59 is a cross sectional view showing assembly of the second modified pump head body and diaphragm membrane in the third exemplary embodiment of the present invention.

Alternatively, as shown in FIGS. 58 and 59, in the third exemplary embodiment, each pair of basic curved grooves 65 and second outer curved grooves 66 in the pump head body 60 (as shown in FIGS. 49 to 51) and each corresponding pair of basic curved protrusions 77 and second outer curved protrusions 78 in the diaphragm membrane 70 (as shown in FIGS. 53 and 54) can be exchanged with a pair of basic curved protrusions 651 and second outer curved protrusions 661 in the pump head body 60 (as shown in FIG. 58) and a pair of corresponding basic curved grooves 771 and second outer curved grooves 781 in the diaphragm membrane 70 (as shown in FIG. 58) without affecting their mating condition.

Each pair of basic curved protrusions 651 and second outer curved protrusions 661 at the upper side of the pump head body 60 is completely inserted into each corresponding pair of basic curved grooves 771 and second outer curved grooves 781 at the bottom side of the diaphragm membrane 70 upon assembly of the pump head body 60 and the diaphragm membrane 70 (as shown in FIG. 59), with the result that a relatively short length of moment arm L3 from the basic curved groove 771 to the periphery of the annular positioning protrusion 76 in the diaphragm membrane 70 is also obtained during operation of the present invention (as shown in the enlarged portion of FIG. 59), thereby achieving significantly reduced vibration enhanced stability in preventing displacement and maintaining the length of moment arm L2.

Figure 62:
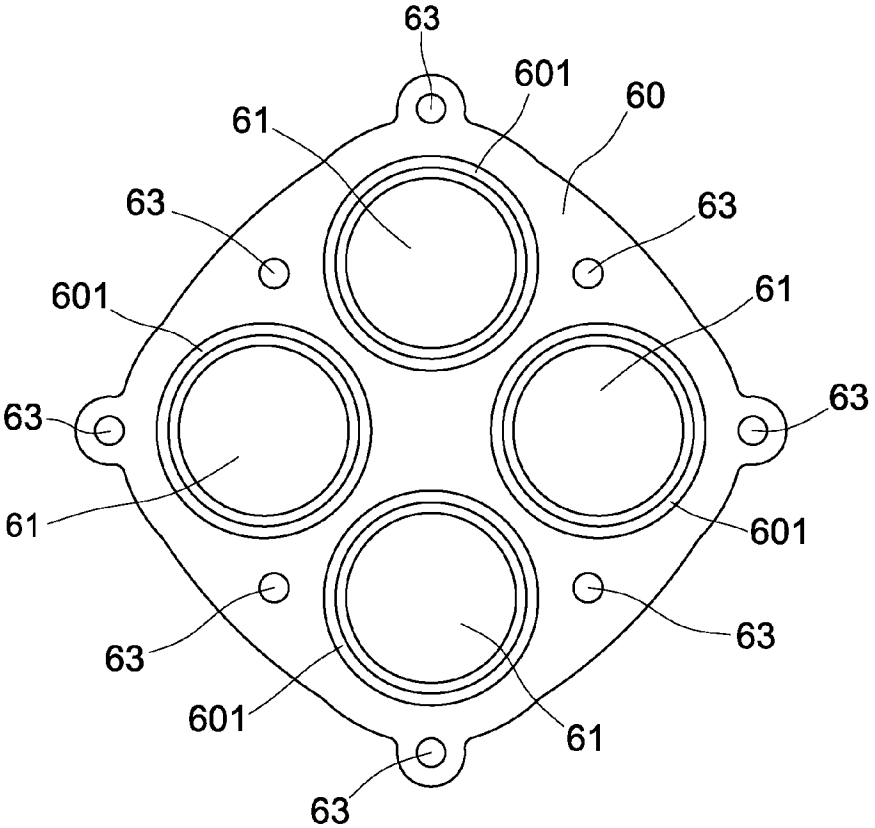
FIG. 62 is a top view of a pump head body in the fourth exemplary embodiment of the present invention.
Figure 60:
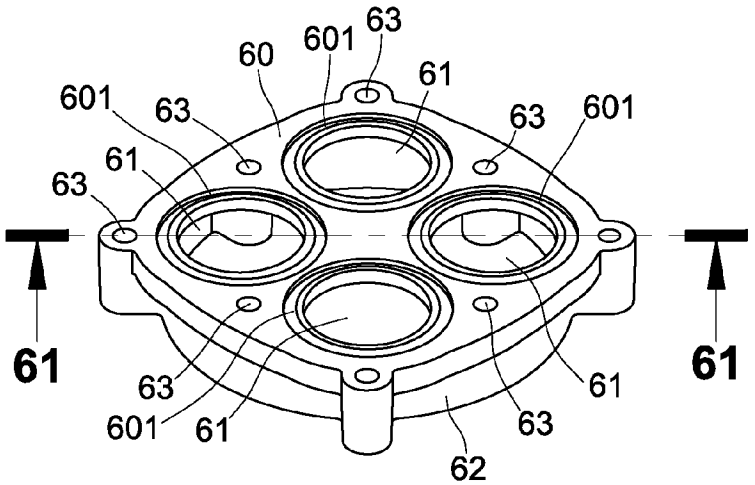
FIG. 60 is a perspective view of a pump head body in the fourth exemplary embodiment of the present invention.
Figure 61:
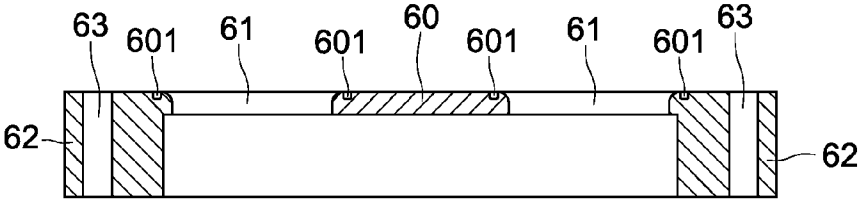
FIG. 61 is a cross sectional view taken against the section line 61-61 from previous FIG. 60.
Figure 65:
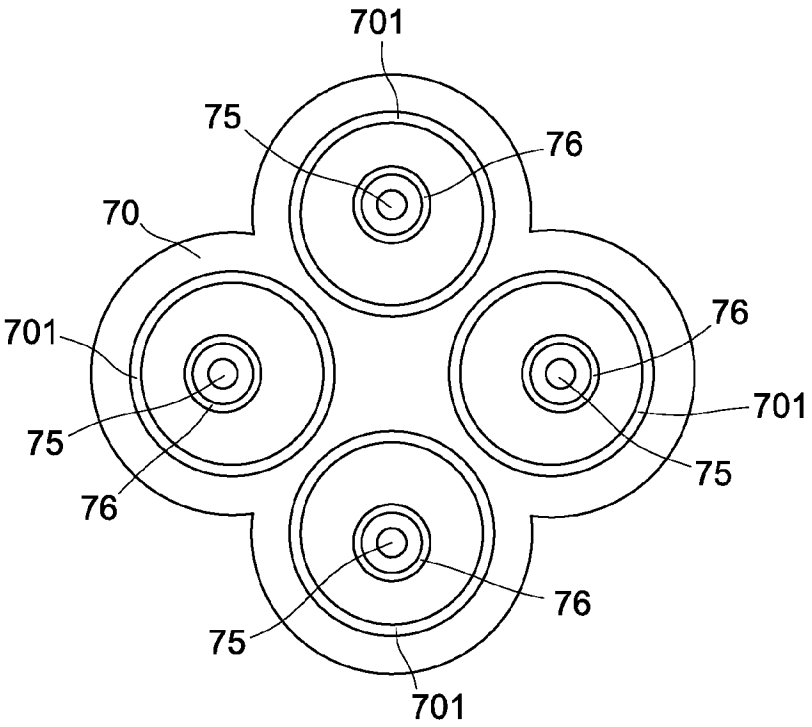
FIG. 65 is a bottom view of a diaphragm membrane in the fourth exemplary embodiment of the present invention.
Figure 63:
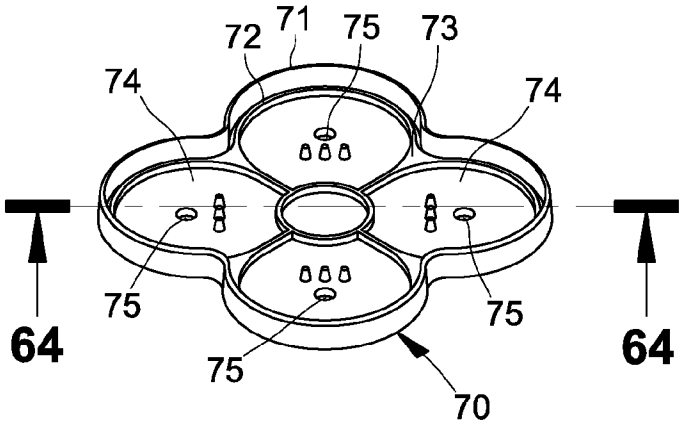
FIG. 63 is a perspective view of a diaphragm membrane in the fourth exemplary embodiment of the present invention.
Figure 64:
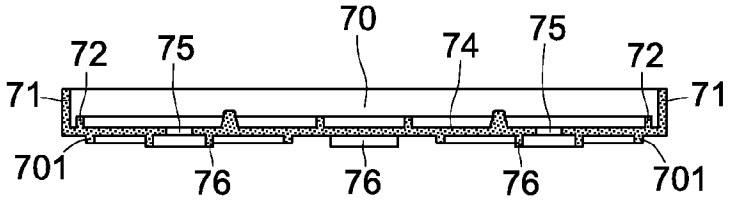
FIG. 64 is a cross sectional view taken against the section line 64-64 from previous FIG. 63.

Please refer to FIGS. 60 through 66, which are illustrative figures of the four-compression-chamber diaphragm pump with multiple effects of a fourth exemplary embodiment of the present invention, in which a basic annular groove 601 is further circumferentially disposed around each operating hole 61 in the pump head body 60 (as shown in FIGS. 60 through 62) while a basic protruded ring 701 is further circumferentially disposed around each annular positioning protrusion 76 in the diaphragm membrane 70 at a position corresponding to a position of each mating basic annular groove 601 in the pump head body 60 (as shown in FIGS. 64 and 65).

Figure 66:
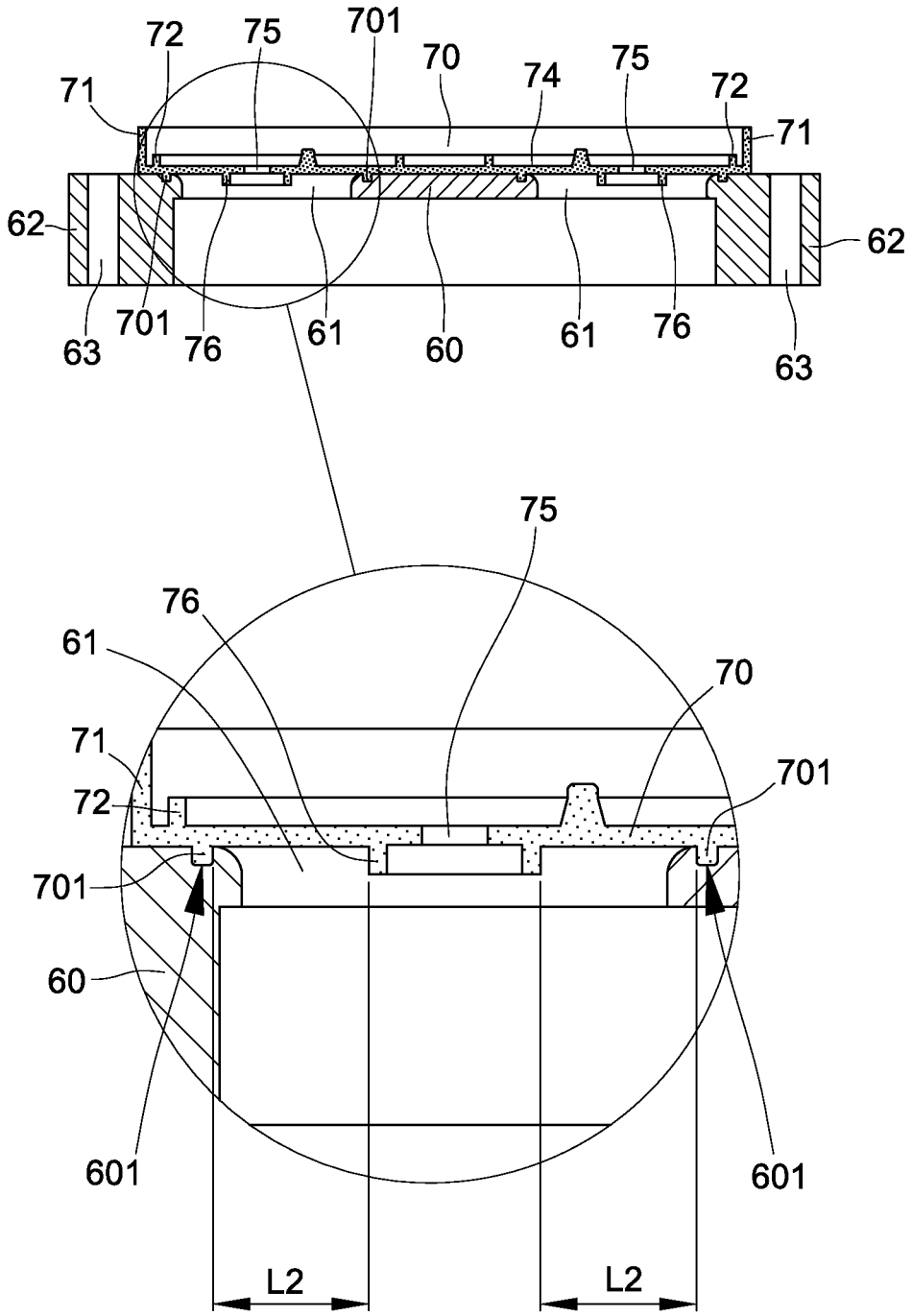
FIG. 66 is a cross sectional view showing the assembly of a diaphragm membrane and a pump head body for the fourth exemplary embodiment of the present invention.

Each basic protruded ring 701 at the bottom side of the diaphragm membrane 70 is completely inserted into each corresponding basic annular groove 601 at the upper side of the pump head body 60 upon assembly of the pump head body 60 and the diaphragm membrane 70 (as shown in FIG. 66), with the result that a short length of moment arm L2 from the basic protruded ring 701 to the periphery of the annular positioning protrusion 76 in the diaphragm membrane 70 is obtained during operation of the present invention (as shown in FIG. 66), thereby achieving significantly reduced vibration and enhanced stability in preventing displacement and maintaining the length of moment arm L2 for resisting the acting force F on the eccentric roundel 52.

Figure 67:
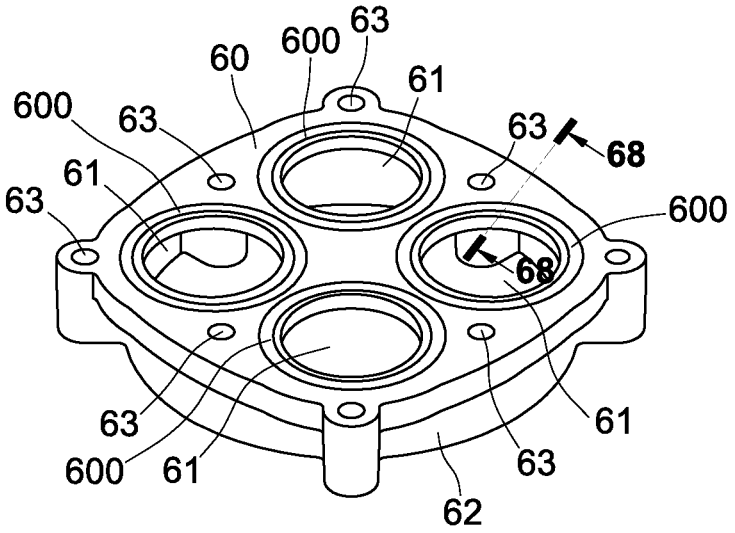
FIG. 67 is a perspective view of a modified pump head body in the fourth exemplary embodiment of the present invention.
Figure 68:
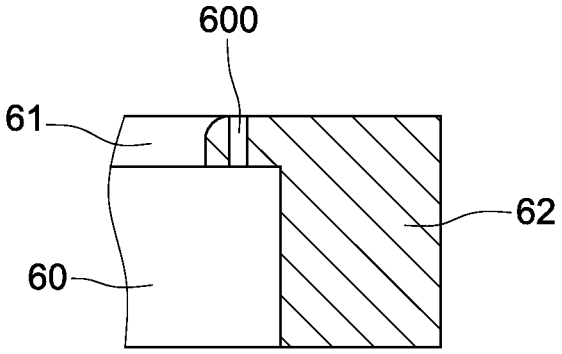
FIG. 68 is a cross sectional view taken against the section line 68-68 from previous FIG. 67.

As shown in FIGS. 67 and 68, in the fourth exemplary embodiment, each basic annular groove 601 of the pump head body 60 can be replaced by a basic perforated hole 600.

Figure 69:
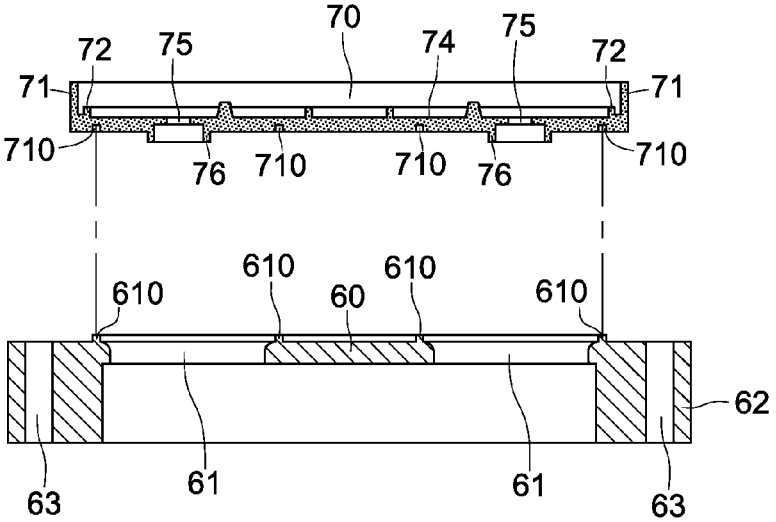
FIG. 69 is a cross sectional view showing explosion of a second modified pump head body and diaphragm membrane in the fourth exemplary embodiment of the present invention.
Figure 70:
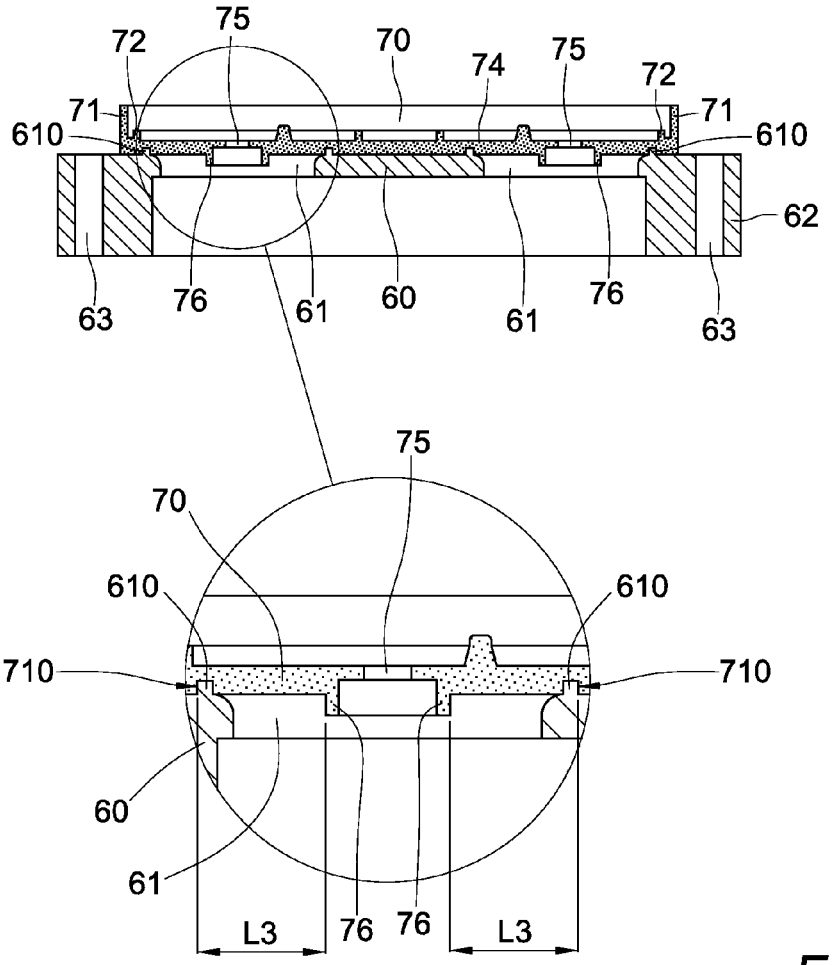
FIG. 70 is a cross sectional view showing assembly of the second modified pump head body and diaphragm membrane in the fourth exemplary embodiment of the present invention.

Also, as shown in FIGS. 69 and 70, in the fourth exemplary embodiment, each basic annular groove 601 in the pump head body 60 (as shown in FIGS. 60 to 62) and each corresponding basic protruding ring 701 in the diaphragm membrane 70 (as shown in FIGS. 64 and 65) can be exchanged with a basic protruding ring 610 in the pump head body 60 (as shown in FIG. 69) and a corresponding basic annular groove 710 in the diaphragm membrane 70 (as shown in FIG. 69) without affecting their mating condition.

Each basic protruding ring 610 at the upper side of the pump head body 60 is completely inserted into each corresponding basic annular groove 710 at the bottom side of the diaphragm membrane 70 upon assembly of the pump head body 60 and the diaphragm membrane 70 (as shown in FIG. 70) with the result that a shortened length of moment arm L3 from the basic annular groove 710 to the periphery of the annular positioning protrusion 76 in the diaphragm membrane 70 is also obtained during operation of the present invention (as shown in FIG. 70), again substantially reducing vibrations.

Figure 73:
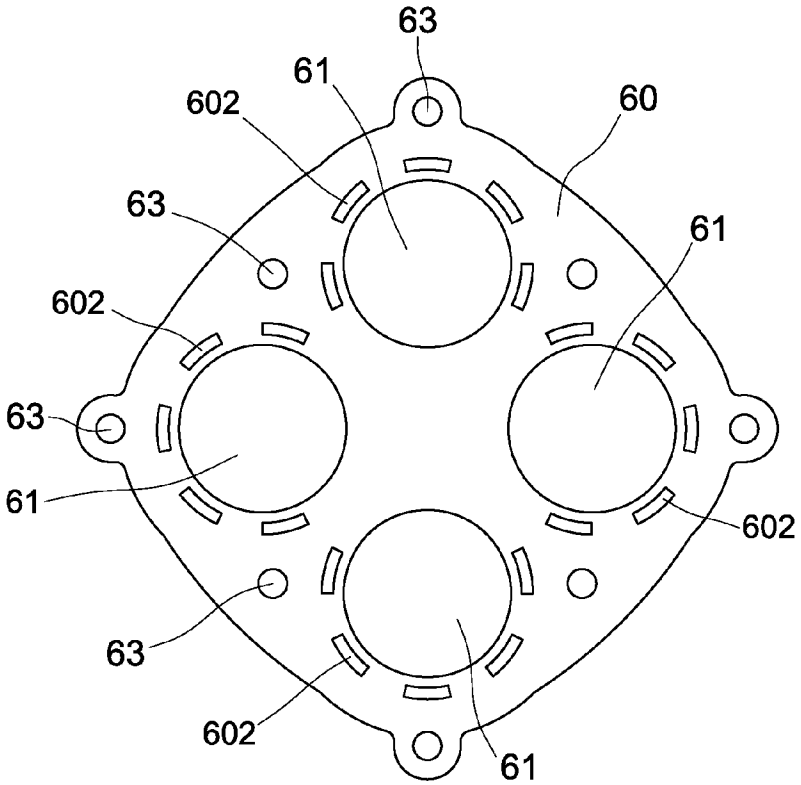
FIG. 73 is a top view of a pump head body in the fifth exemplary embodiment of the present invention.
Figure 71:
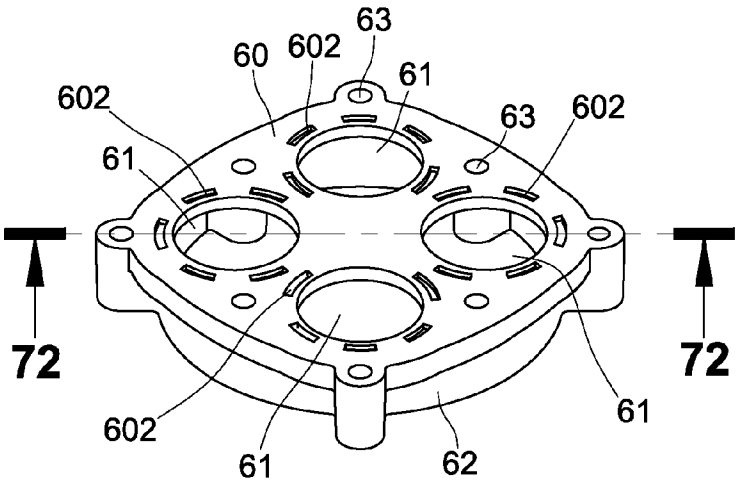
FIG. 71 is a perspective view of a pump head body in the fifth exemplary embodiment of the present invention.
Figure 72:
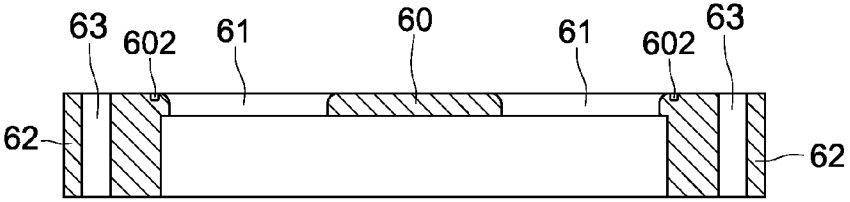
FIG. 72 is a cross sectional view taken against the section line 72-72 from previous FIG. 71.
Figure 76:
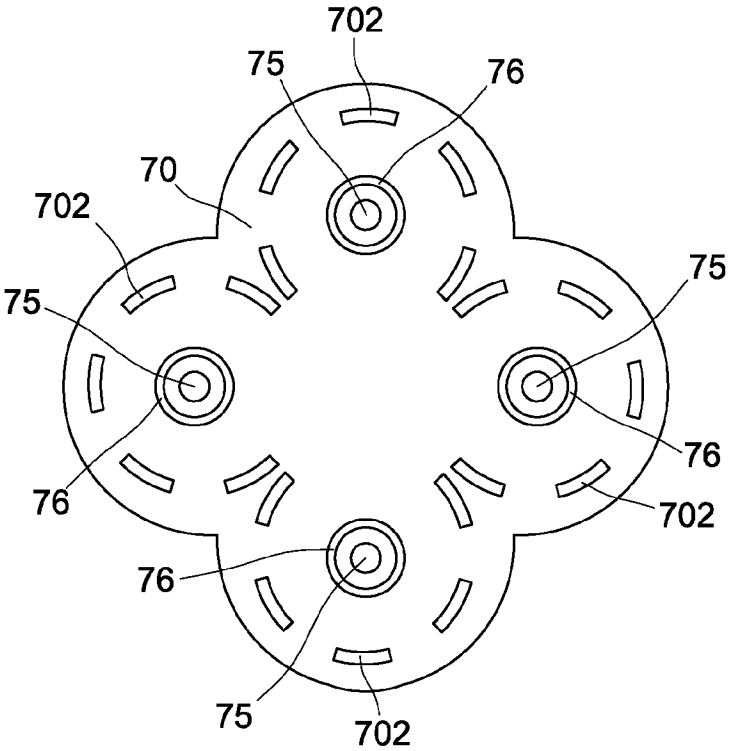
FIG. 76 is a bottom view of a diaphragm membrane in the fifth exemplary embodiment of the present invention.
Figure 74:
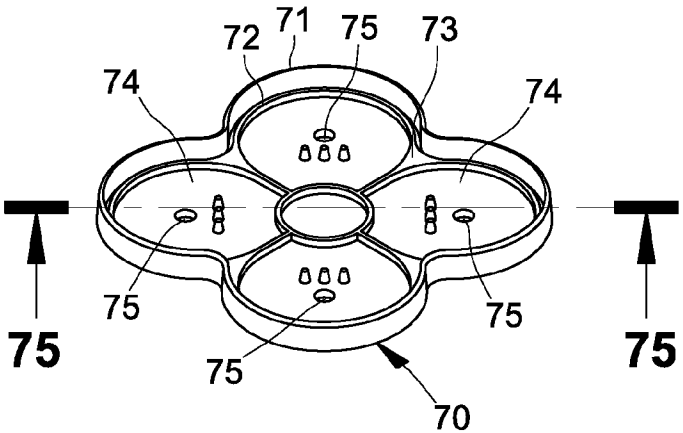
FIG. 74 is a perspective view of a diaphragm membrane in the fifth exemplary embodiment of the present invention.
Figure 75:
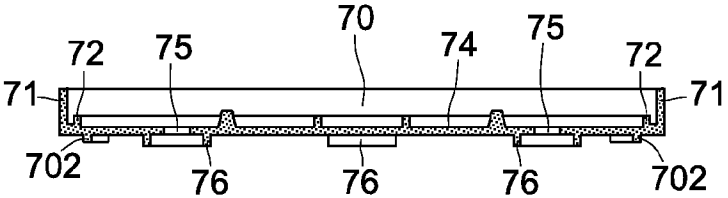
FIG. 75 is a cross sectional view taken against the section line 75-75 from previous FIG. 74.

FIGS. 71 through 77 are illustrative figures of the four-compression-chamber diaphragm pump with multiple effects of a fifth exemplary embodiment of the present invention, in which a pair of curved indented segments 602 is further circumferentially disposed around each said operating hole 61 in the pump head body 60 (as shown in FIGS. 71 through 73) while a pair of curved protruding segments 702 is further circumferentially disposed around each annular positioning protrusion 76 in the diaphragm membrane 70 at a position corresponding to a position of each mating curved indented segment 602 in the pump head body 60 (as shown in FIGS. 75 and 76).

Figure 77:
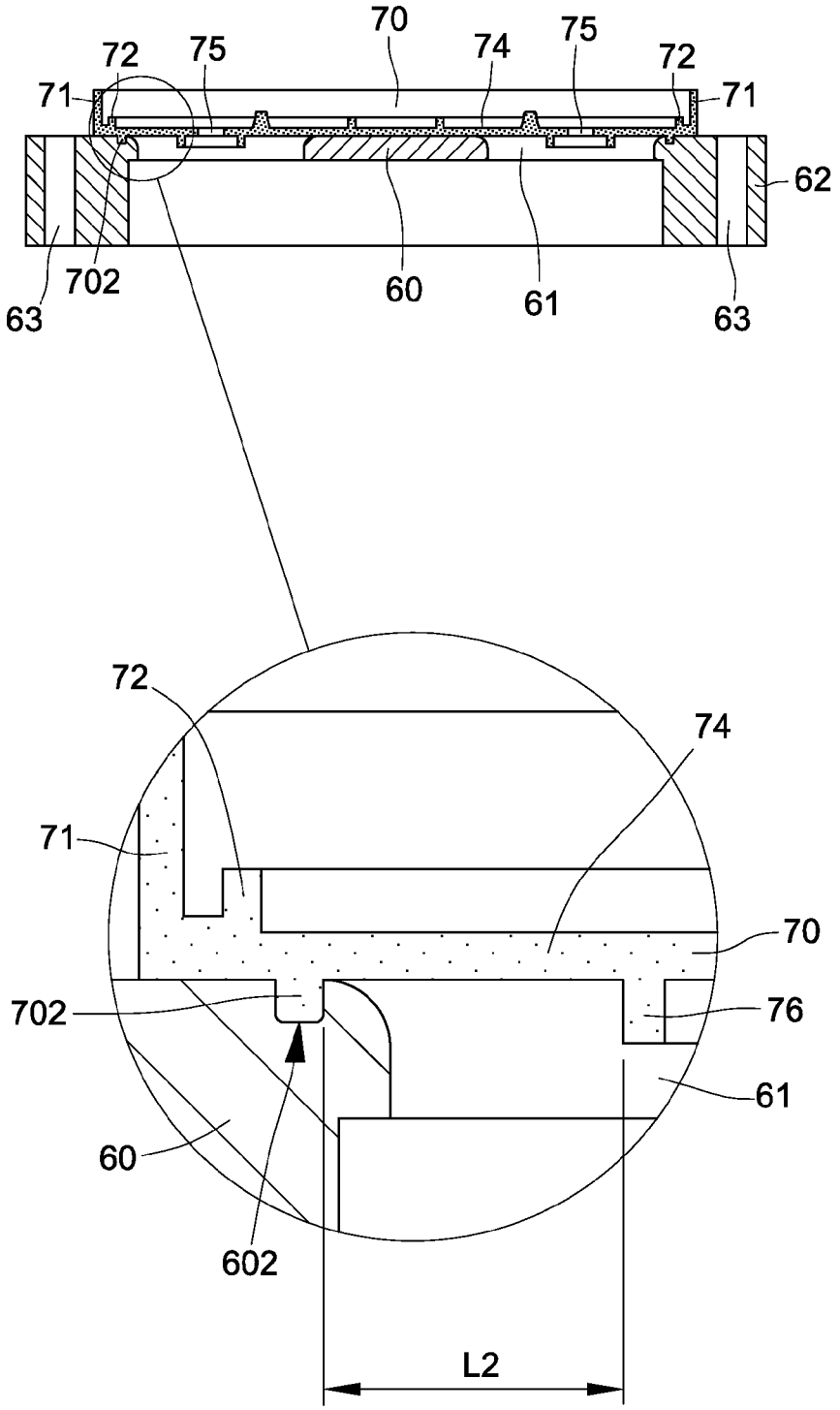
FIG. 77 is a cross sectional view showing the assembly of a diaphragm membrane and a pump head body for the fifth exemplary embodiment of the present invention.

Each pair of curved protruding segments 702 at the bottom side of the diaphragm membrane 70 is completely inserted into each corresponding pair of curved indented segments 602 at the upper side of the pump head body 60 upon assembly of the pump head body 60 and the diaphragm membrane 70 (as shown in FIG. 77), with the result that a shortened length of moment arm L2 from the curved protruding segment 702 to the periphery of the annular positioning protrusion 76 in the diaphragm membrane 70 is obtained during operation of the present invention (as shown in FIG. 77 and enlarged view of association) thereby significantly reducing vibration as well as enhancing stability in preventing displacement and maintaining the length of moment arm L2.

Figure 78:
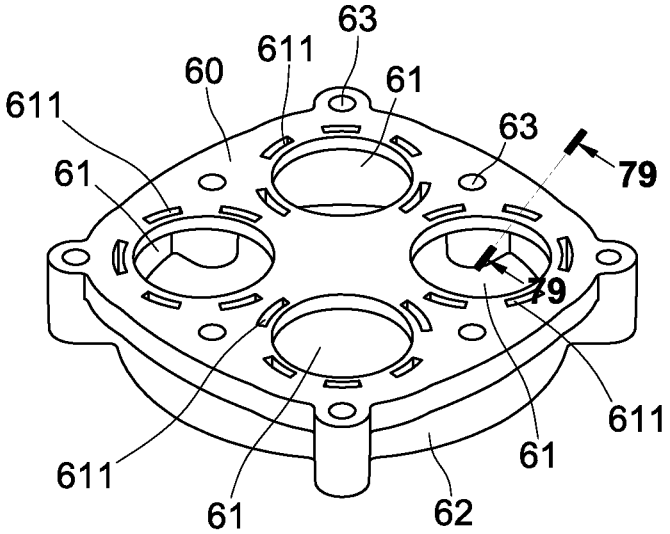
FIG. 78 is a perspective view of a modified pump head body in the fifth exemplary embodiment of the present invention.
Figure 79:
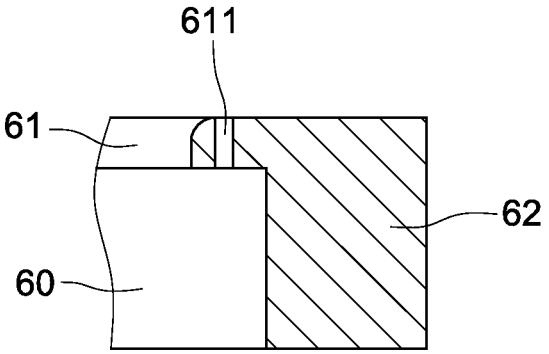
FIG. 79 is a cross sectional view taken against the section line 79-79 from previous FIG. 78.

As shown in FIGS. 78 and 79, in the fifth exemplary embodiment, each pair of curved indented segments 602 of the pump head body 60 can be replaced by a pair of curved perforated segments 611.

Figure 80:
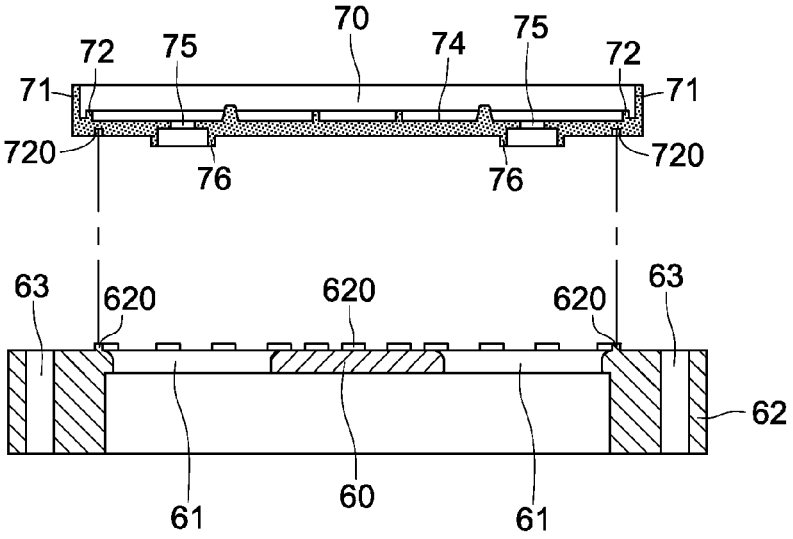
FIG. 80 is an exploded cross sectional view showing a second modified pump head body and diaphragm membrane in the fifth exemplary embodiment of the present invention.
Figure 81:
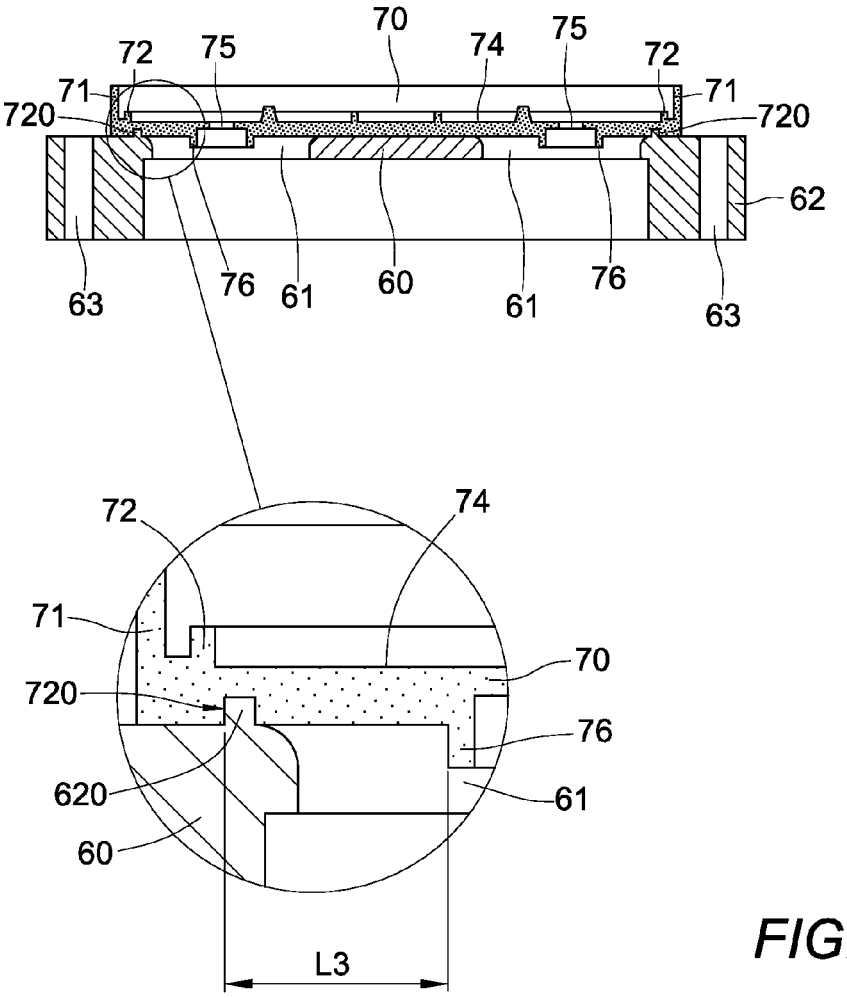
FIG. 81 is a cross sectional view showing assembly of the second modified pump head body and diaphragm membrane in the fifth exemplary embodiment of the present invention.

Alternatively, as shown in FIGS. 80 and 81, in the fifth exemplary embodiment, each pair of curved indented segments 602 in the pump head body 60 (as shown in FIGS. 71 to 73) and each corresponding pair of curved protruding segments 702 in the diaphragm membrane 70 (as shown in FIGS. 75 and 76) can be exchanged with a pair of curved protruding segments 620 in the pump head body 60 (as shown in FIG. 80) and a pair of corresponding curved indented segments 720 in the diaphragm membrane 70 (as shown in FIG. 80) without affecting their mating condition.

Each pair of curved protruding segments 620 at the upper side of the pump head body 60 is completely inserted into each pair of corresponding curved indented segments 720 at the bottom side of the diaphragm membrane 70 upon assembly of the pump head body 60 and the diaphragm membrane 70 (as shown in FIG. 81), with the result that a shortened length of moment arm L3 from the curved indented segment 720 to the periphery of the annular positioning protrusion 76 in the diaphragm membrane 70 is also obtained during operation of the present invention (as shown in FIG. 81).

Figure 84:
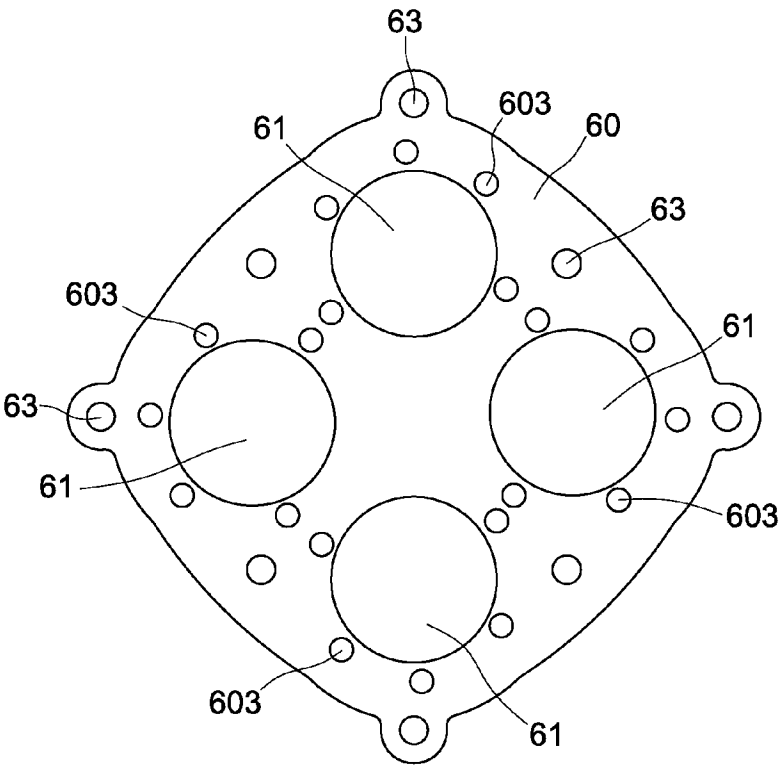
FIG. 84 is a top view of a pump head body in the sixth exemplary embodiment of the present invention.
Figure 82:
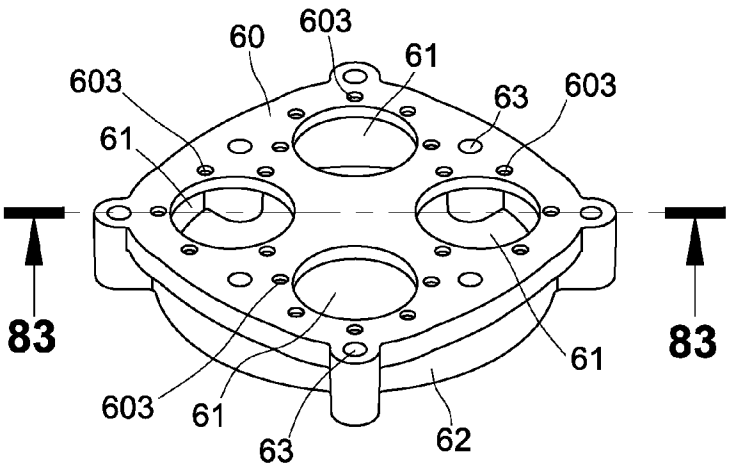
FIG. 82 is a perspective view of a pump head body in the sixth exemplary embodiment of the present invention.
Figure 83:
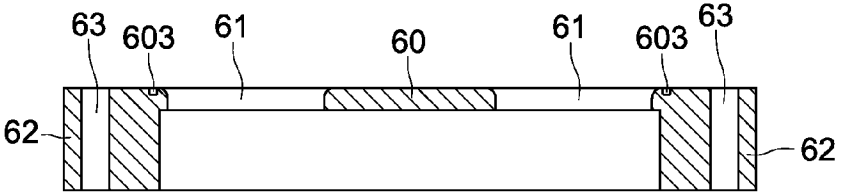
FIG. 83 is a cross sectional view taken against the section line 83-83 from previous FIG. 82.
Figure 87:
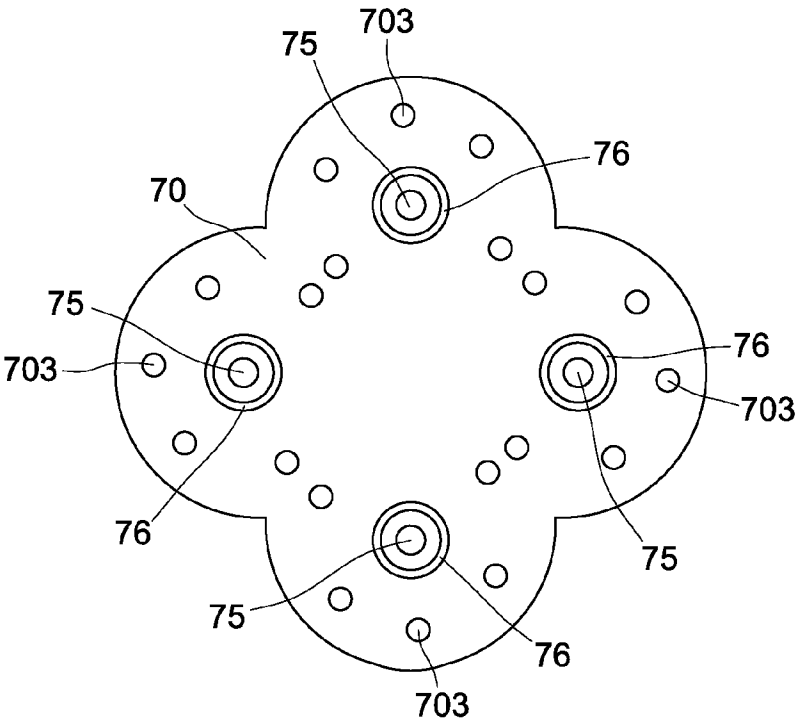
FIG. 87 is a bottom view of a diaphragm membrane in the sixth exemplary embodiment of the present invention.
Figure 85:
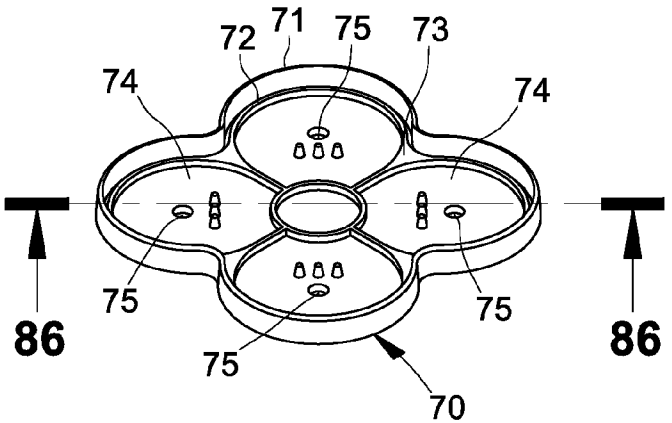
FIG. 85 is a perspective view of a diaphragm membrane in the sixth exemplary embodiment of the present invention.
Figure 86:
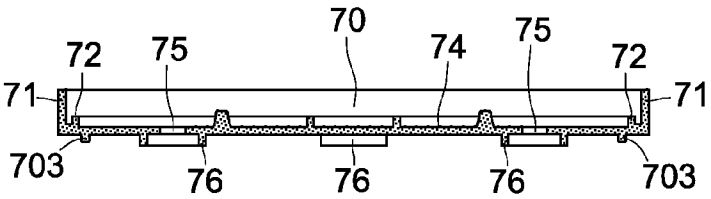
FIG. 86 is a cross sectional view taken against the section line 86-86 from previous FIG. 85.

Please refer to FIGS. 82 through 88, which are illustrative figures of the four-compression-chamber diaphragm pump with multiple effects of a sixth exemplary embodiment in the present invention, in which a group of round openings or holes 603 are further circumferentially disposed around each operating hole 61 in the pump head body 60 (as shown in FIGS. 82 through 84) while a group of round protrusions 703 are further circumferentially disposed around each of the annular positioning protrusions 76 in the diaphragm membrane 70 at a position corresponding to a position of each group of mating round openings or holes 603 in the pump head body 60 (as shown in FIGS. 86 and 87).

Figure 88:
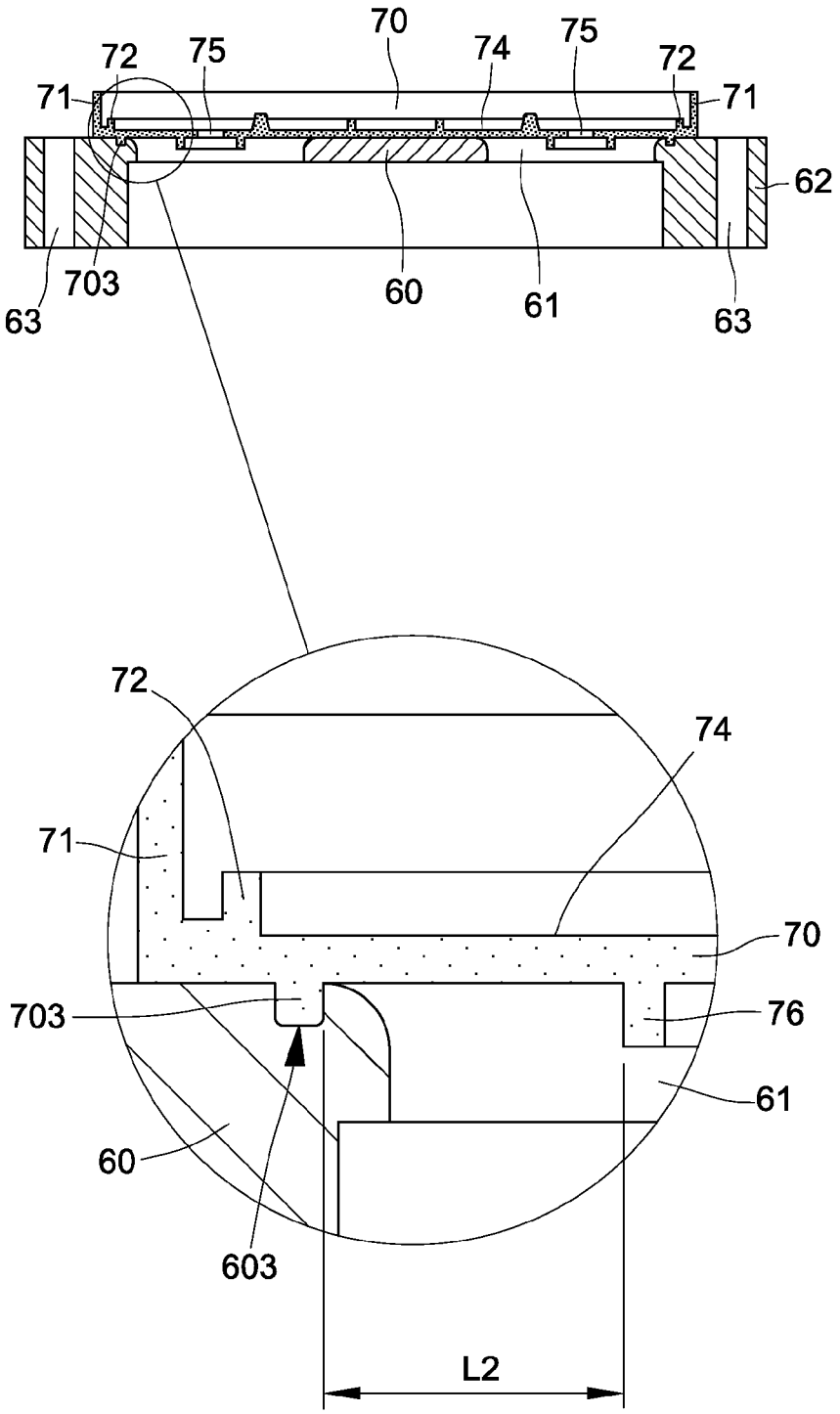
FIG. 88 is a cross sectional view showing the assembly of a diaphragm membrane and a pump head body for the sixth exemplary embodiment of the present invention.

Each group of round protrusions 703 at the bottom side of the diaphragm membrane 70 is completely inserted into each corresponding group of round openings or holes 603 at the upper side of the pump head body 60 upon assembly of the pump head body 60 and the diaphragm membrane 70 (as shown in FIG. 88), with the result that a shortened length of moment arm L2 from the round protrusion 703 to the periphery of the annular positioning protrusion 76 in the diaphragm membrane 70 is obtained in the operation of the present invention (as shown in FIG. 88).

Figure 89:
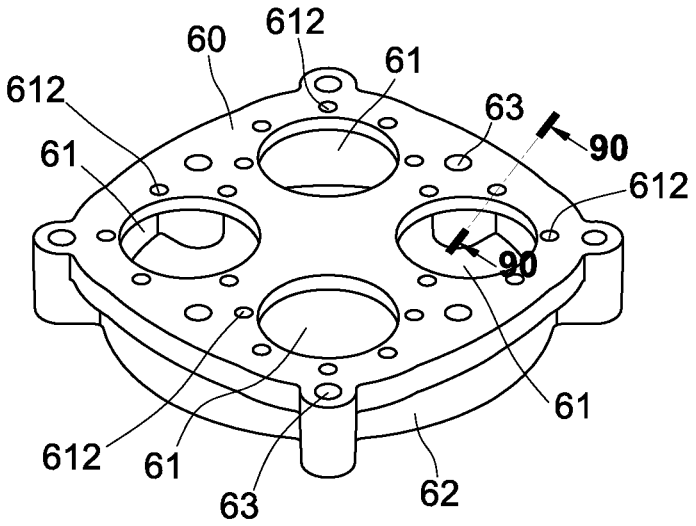
FIG. 89 is a perspective view of a modified pump head body in the sixth exemplary embodiment of the present invention.
Figure 90:
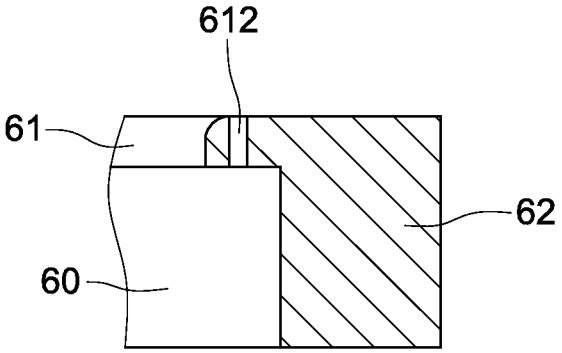
FIG. 90 is a cross sectional view taken against the section line of 90-90 from previous FIG. 89.

As shown in FIGS. 89 and 90, in the sixth exemplary embodiment, each group of round openings or holes 603 in the pump head body 60 can be replaced by a group of round perforated holes 612.

Figure 91:
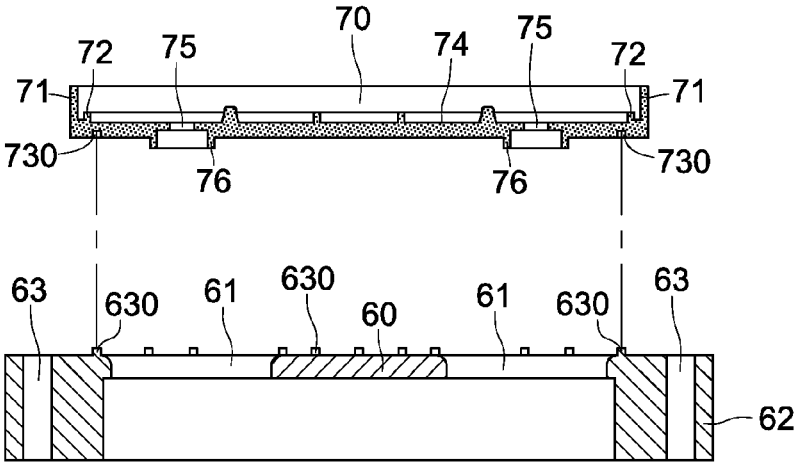
FIG. 91 is an exploded cross sectional view showing the second modified pump head body and diaphragm membrane in the sixth exemplary embodiment of the present invention.
Figure 92:
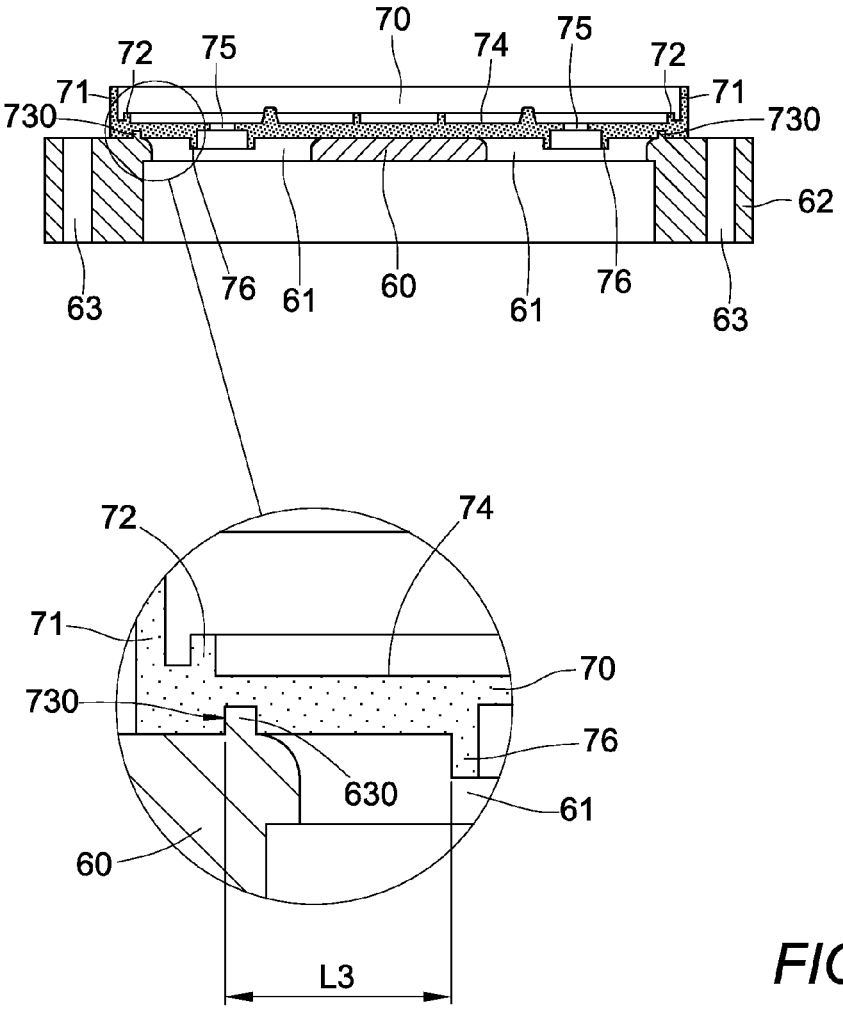
FIG. 92 is a cross sectional view showing assembly of the second modified pump head body and diaphragm membrane in the sixth exemplary embodiment of the present invention.

As shown in FIGS. 91 and 92, in the sixth exemplary embodiment, each group of round openings or holes 603 in the pump head body 60 (as shown in FIGS. 82 to 84) and each corresponding group of round protrusions 703 in the diaphragm membrane 70 (as shown in FIGS. 86 and 87) can be exchanged for a group of round protrusions 630 in the pump head body 60 (as shown in FIG. 91) and a group of corresponding round openings or holes 730 in the diaphragm membrane 70 (as shown in FIG. 91) without affecting their mating condition.

Each group of round protrusions 630 at the upper side of the pump head body 60 is completely inserted into each group of corresponding round openings or holes 730 at the bottom side of the diaphragm membrane 70 upon assembly of the pump head body 60 and the diaphragm membrane 70 (as shown in FIG. 92), with the result that a shortened length of moment arm L3 from the round openings or holes 730 to the periphery of the annular positioning protrusion 76 in the diaphragm membrane 70 is also obtained during operation of the present invention (as shown in FIG. 92) to thereby significantly reduce vibrations.

FIGS. 93 through 99 are illustrative figures of the four-compression-chamber diaphragm pump with multiple effects of a the seventh exemplary embodiment in the present invention.

Figure 95:
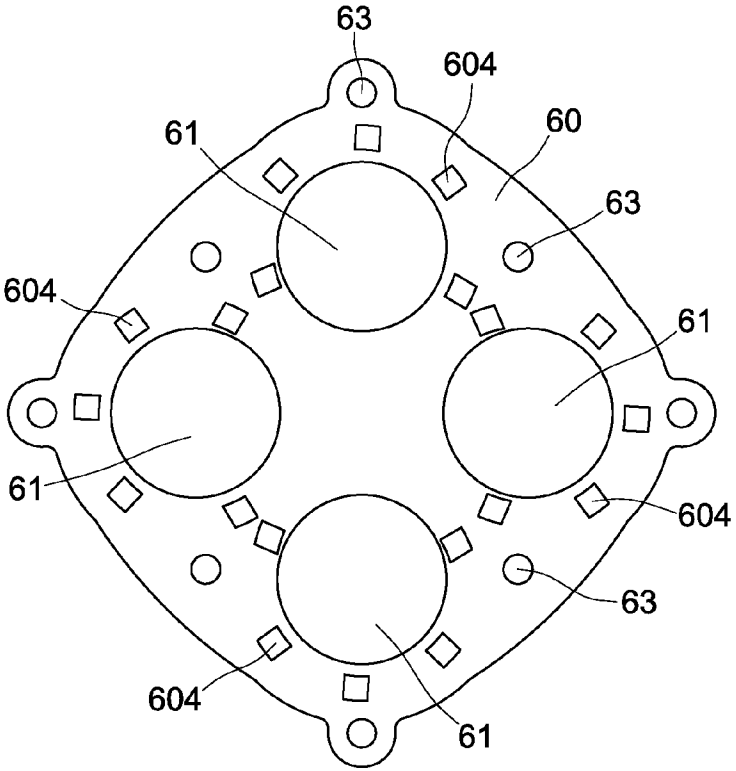
FIG. 95 is a top view for pump head body in the seventh exemplary embodiment of the present invention.
Figure 93:
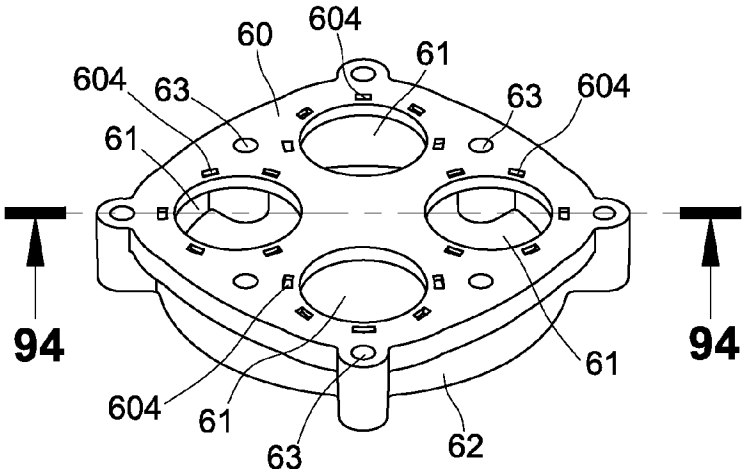
FIG. 93 is a perspective view of a pump head body in the seventh exemplary embodiment of the present invention.
Figure 94:
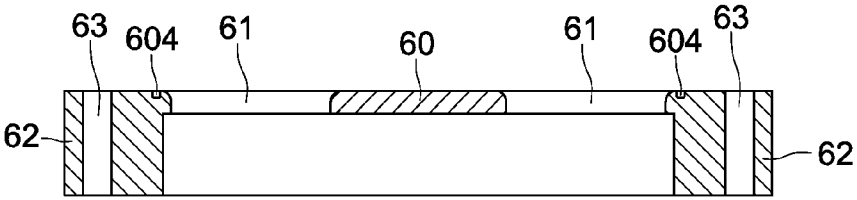
FIG. 94 is a cross sectional view taken against the section line of 94-94 from previous FIG. 93.
Figure 98:
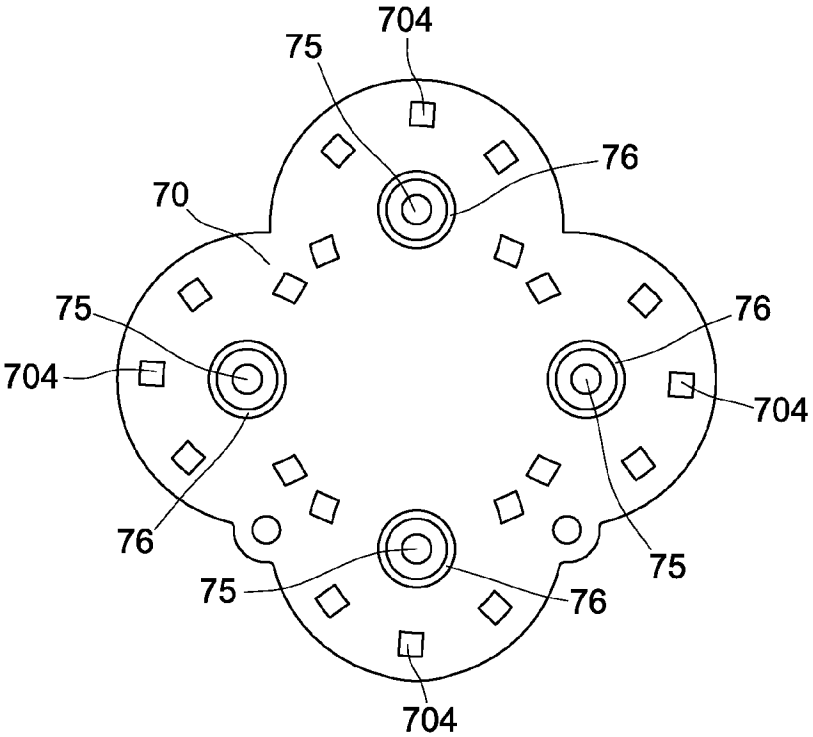
FIG. 98 is a bottom view of a diaphragm membrane in the seventh exemplary embodiment of the present invention.
Figure 96:
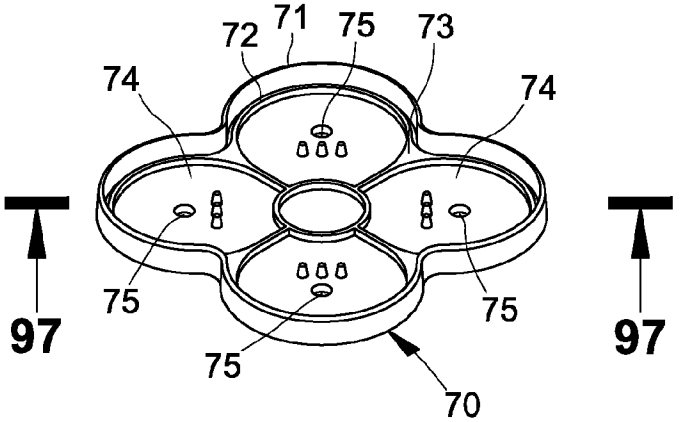
FIG. 96 is a perspective view for diaphragm membrane in the seventh exemplary embodiment of the present invention.
Figure 97:
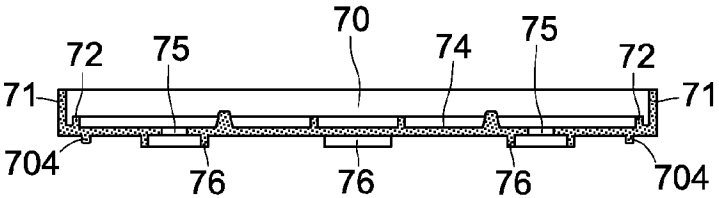
FIG. 97 is a cross sectional view taken against the section line of 97-97 from previous FIG. 96.

A group of square openings or holes 604 are further circumferentially disposed around each operating hole 61 in the pump head body 60 (as shown in FIGS. 93 through 95) while a group of square protrusions 704 are further circumferentially disposed around each annular positioning protrusion 76 in the diaphragm membrane 70 at a position corresponding to a position of each mating group of square openings or holes 604 in the pump head body 60 (as shown in FIGS. 97 and 98).

Figure 99:
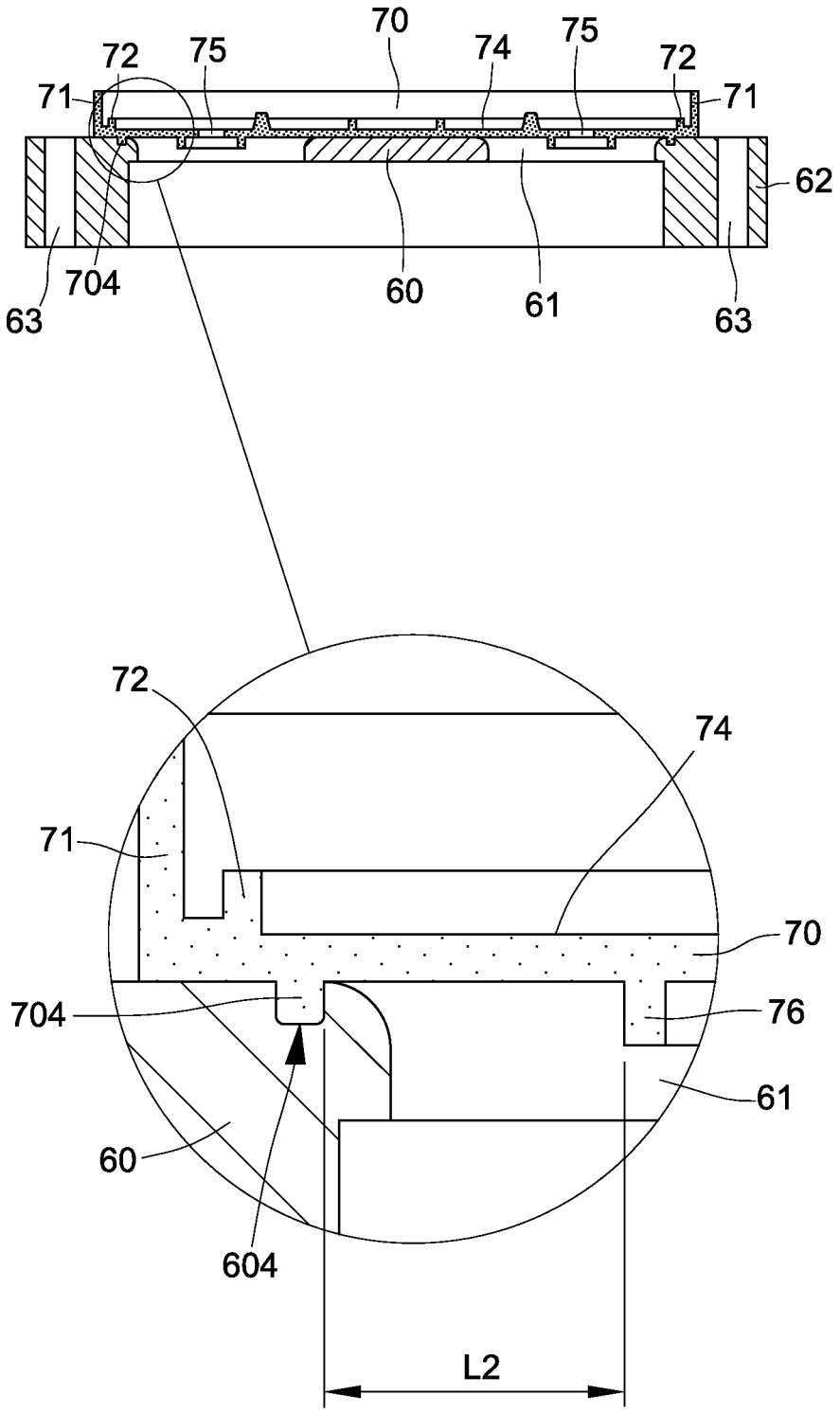
FIG. 99 is a cross sectional view showing the assembly of a diaphragm membrane and a pump head body for the seventh exemplary embodiment of the present invention.

Each group of square protrusions 704 at the bottom side of the diaphragm membrane 70 is completely inserted into each corresponding group of square openings or holes 604 at the upper side of the pump head body 60 upon assembly of the pump head body 60 and the diaphragm membrane 70 (as shown in FIG. 99), with the result that a relatively short length of moment arm L2 from the square protrusions 704 to the periphery of the annular positioning protrusion 76 in the diaphragm membrane 70 is obtained during operation of the present invention (as shown in FIG. 99), thereby achieving significantly reduced vibration and enhanced stability in preventing displacement and maintaining the length of moment arm L2.

Figure 100:
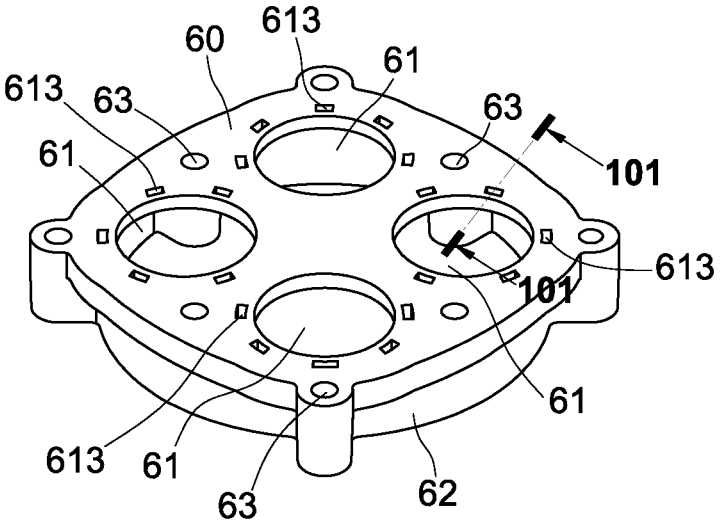
FIG. 100 is a perspective view of a modified pump head body in the seventh exemplary embodiment of the present invention.
Figure 101:
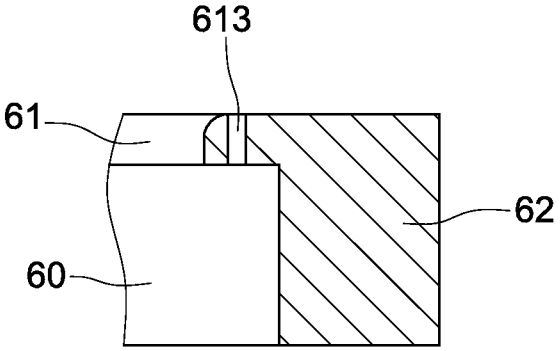
FIG. 101 is a cross sectional view taken against the section line of 101-101 from previous FIG. 100.

As shown in FIGS. 100 and 101, in the seventh exemplary embodiment, each group of square openings or holes 604 in the pump head body 60 can be replaced by a group of square perforated holes 613.

Figure 102:
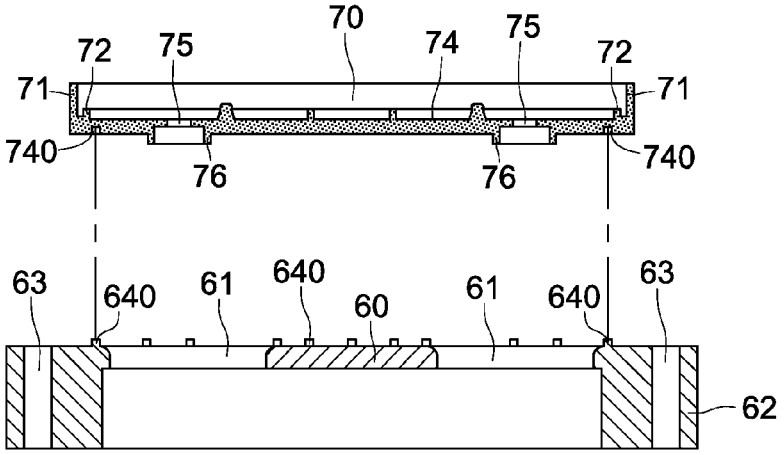
FIG. 102 is an exploded cross sectional view showing a second modified pump head body and diaphragm membrane in the seventh exemplary embodiment of the present invention.
Figure 103:
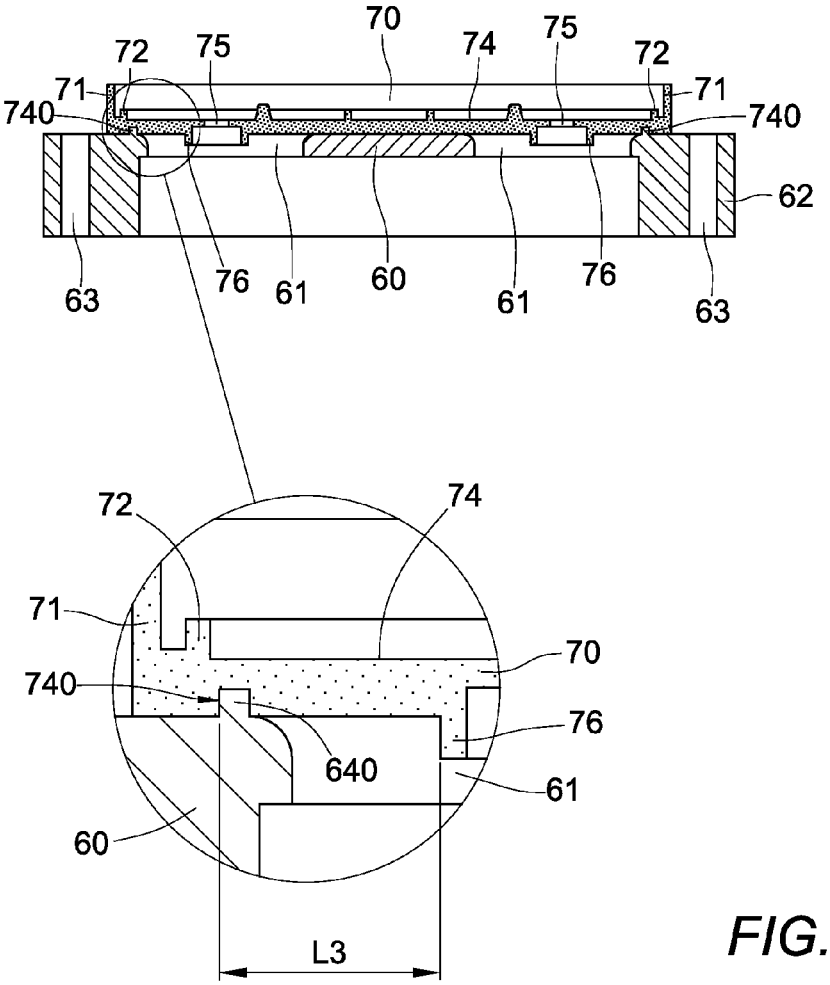
FIG. 103 is a cross sectional view showing assembly of the second modified pump head body and diaphragm membrane in the seventh exemplary embodiment of the present invention.

Alternatively, as shown in FIGS. 102 and 103, in the seventh exemplary embodiment, each group of square openings or holes 604 in the pump head body 60 (as shown in FIGS. 93 to 95) and each corresponding group of square protrusions 704 in the diaphragm membrane 70 (as shown in FIGS. 97 and 98) can be exchanged for a group of square protrusions 640 in the pump head body 60 (as shown in FIG. 102) and a group of corresponding square openings or holes 740 in the diaphragm membrane 70 (as shown in FIG. 91) without affecting their mating condition.

Each group of square protrusions 640 at the upper side of the pump head body 60 is completely inserted into each group of corresponding square openings or holes 740 at the bottom side of the diaphragm membrane 70 upon assembly of the pump head body 60 and the diaphragm membrane 70 (as shown in FIG. 103), with the result that a short length of moment arm L3 from the square dents 740 to the periphery of the annular positioning protrusion 76 in the diaphragm membrane 70 is also obtained in the operation of the present invention (as shown in the enlarged section of FIG. 103) to thereby significantly reduce vibrations.

Figure 104:
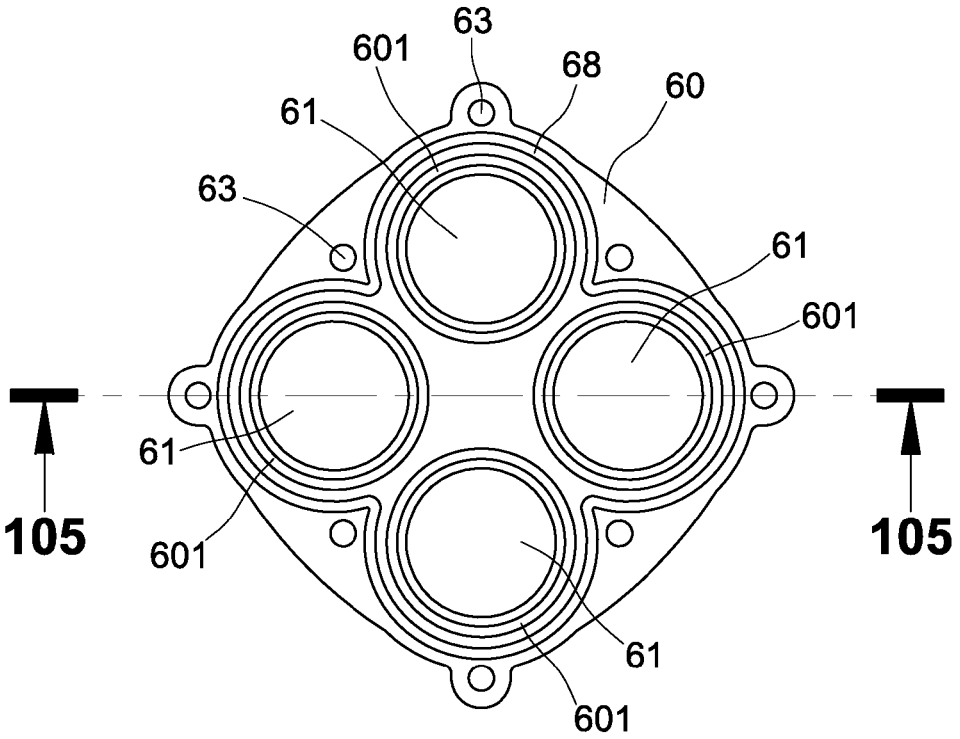
FIG. 104 is a top view of a pump head body in the eighth exemplary embodiment of the present invention.
Figure 105:
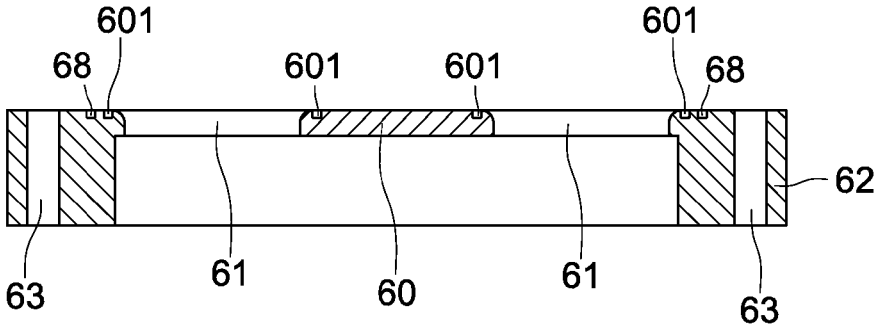
FIG. 105 is a cross sectional view taken against the section line of 105-105 from previous FIG. 104.
Figure 106:
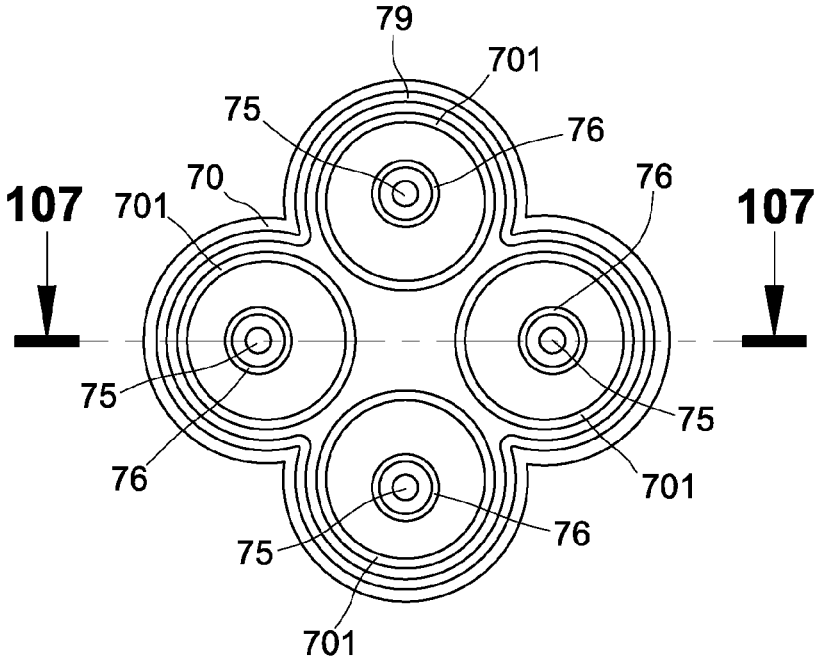
FIG. 106 is a bottom view for diaphragm membrane in the eighth exemplary embodiment of the present invention.
Figure 107:
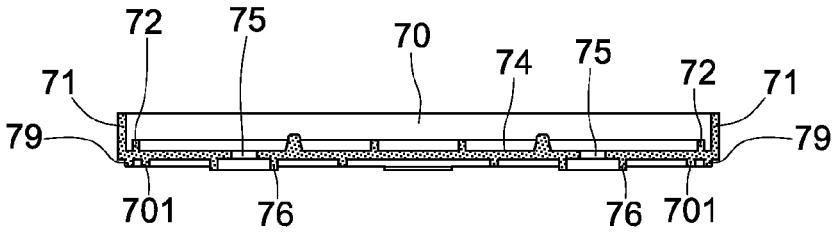
FIG. 107 is a cross sectional view taken against the section line 107-107 from previous FIG. 106.
Figure 108:
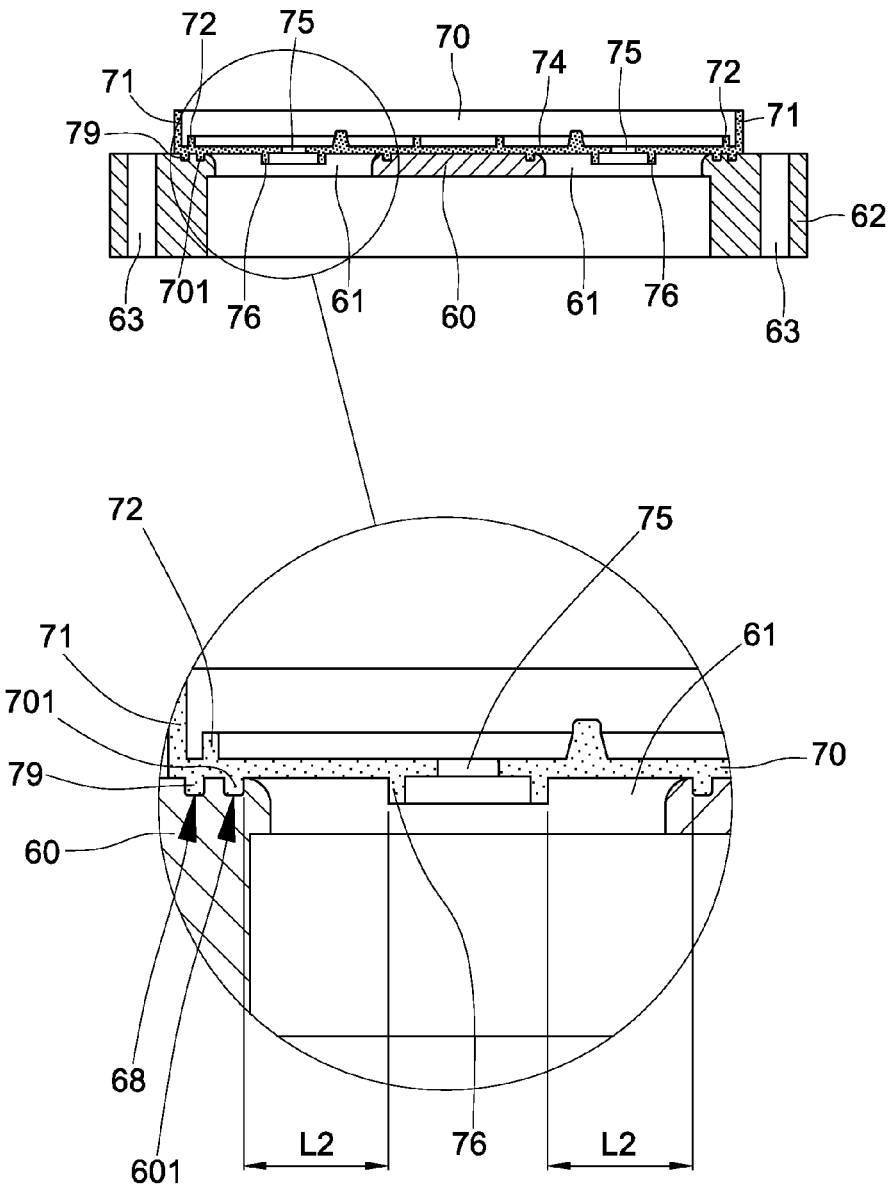
FIG. 108 is a cross sectional view showing the assembly of a diaphragm membrane and a pump head body for the eighth exemplary embodiment of the present invention.

FIGS. 104 through 108 are illustrative figures of the four-compression-chamber diaphragm pump with multiple effects of a eighth exemplary embodiment of the present invention. An integral annular grooves 601 is circumferentially disposed around the upper side of each operating hole 61 and a continuous, linked four-curved groove 68 is disposed to encompass all four integral indented rings 601 in the pump head body 60 (as shown in FIGS. 104 and 105) while an integral protruding ring 701 is circumferentially disposed around each concentric annular positioning protrusion 76 and a continuous, linked four-curved protrusion 79 is disposed to encompass all four integral protruded rings 701 at the bottom side of the diaphragm membrane 70 at a position corresponding to a position of the mating linked four-curved groove 68 and four integral rings 601, 606 in the pump head body 60 (as shown in FIGS. 106 and 107), The linked four-curved protrusion 79 and four integral protruding rings 701 at the bottom side of the diaphragm membrane 70 are completely inserted into the corresponding linked four-curved groove 68 and four integral indented rings 601 at the upper side of the pump head body 60 upon assembly of the pump head body 60 and the diaphragm membrane 70 (as shown in FIG. 108), with the result that a shortened length of moment arm L2 from the first integral protruding ring 701 to the periphery of the annular positioning protrusion 76 in the diaphragm membrane 70 is obtained during operation of the present invention (as shown in FIG. 108 and enlarged view of association), thereby achieving reduced vibration and enhanced stability in the length of moment arm L2 in resisting the acting force F on the eccentric roundel 52.

Figure 109:
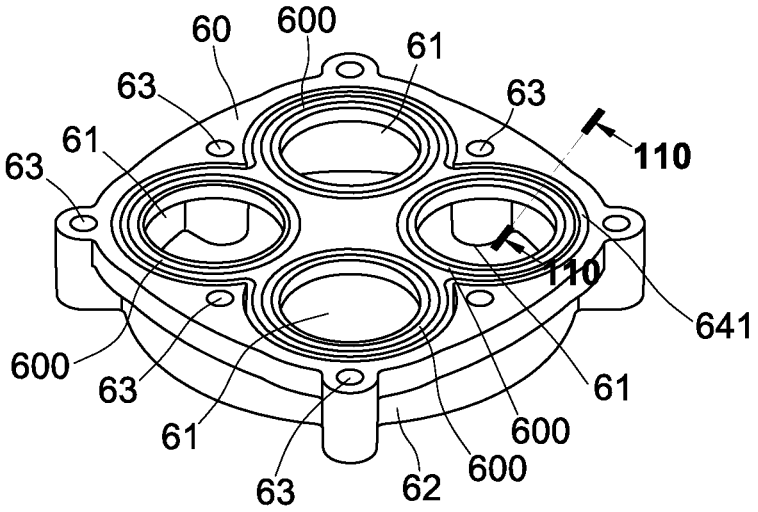
FIG. 109 is a perspective view for a modified pump head body in the eighth exemplary embodiment of the present invention.
Figure 110:
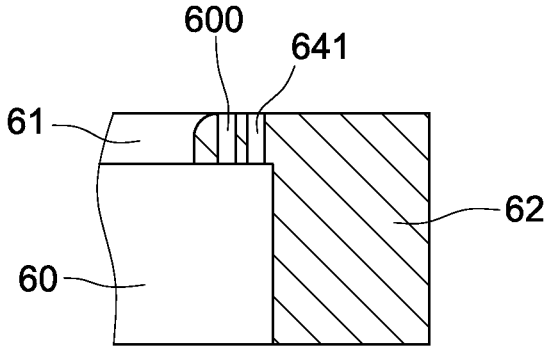
FIG. 110 is a cross sectional view taken against the section line of 110-110 from previous FIG. 109.

As shown in FIGS. 109 and 110, in the eighth exemplary embodiment, the linked four-curved groove 68 and four integral indented rings 601 in the pump head body 60 can be replaced by a linked four-curved slot 641 and four integral perforated rings 600.

Figure 111:
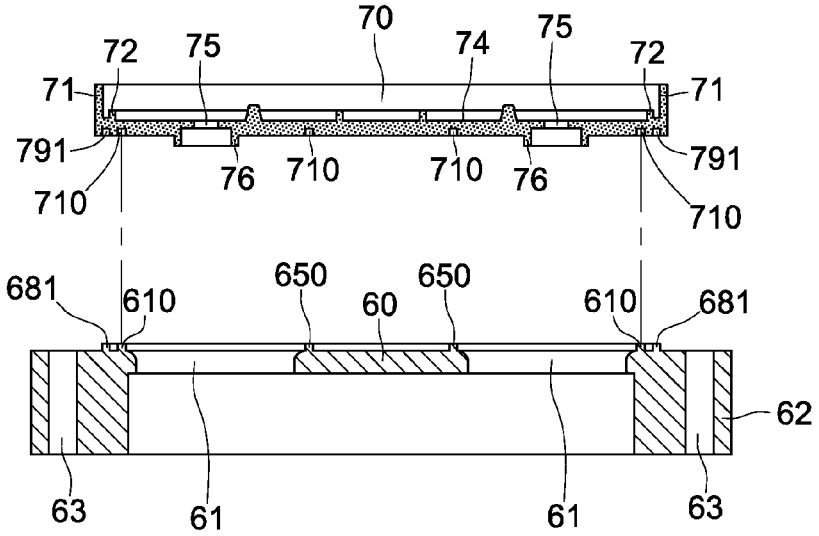
FIG. 111 is a cross sectional view showing explosion of a second modified pump head body and diaphragm membrane in the eighth exemplary embodiment of the present invention.
Figure 112:
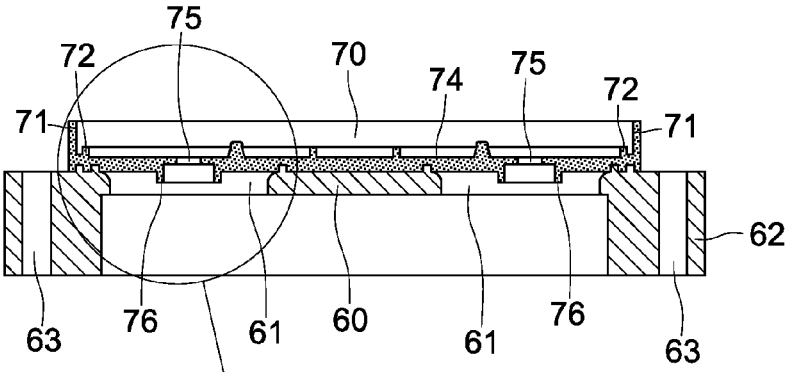
FIG. 112 is a cross sectional view showing assembly of the second modified pump head body and diaphragm membrane in the eighth exemplary embodiment of the present invention.
Figure 112:
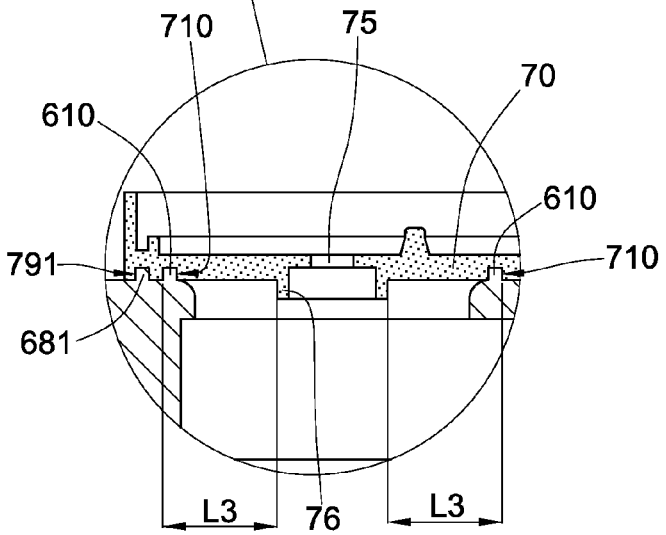

Alternatively, as shown in FIGS. 111 and 112, in the eighth exemplary embodiment, the linked four-curved groove 68 and four integral indented rings 601 in the pump head body 60 (as shown in FIGS. 104 and 105) and the corresponding linked four-curved protrusion 79 and four integral protruding rings 701 in the diaphragm membrane 70 (as shown in FIGS. 106 and 107) can be exchanged for a linked four-curved protrusion 681 and four integral protruding rings 610 in the pump head body 60 (as shown in FIG. 111) and a corresponding linked four-curved groove 791 and four integral indented rings 710 in the diaphragm membrane 70 (as shown in FIG. 111) without affecting their mating condition.

The linked four-curved protrusion 681 and four integral protruding rings 610 at the upper side of the pump head body 60 are completely inserted into the corresponding linked four-curved groove 791 and four integral indented rings 710 at the bottom side of the diaphragm membrane 70 upon assembly of the pump head body 60 and the diaphragm membrane 70 (as shown in FIG. 112), with the result that a shortened length of moment arm L3 from the first integral annular groove 710 to the periphery of respective annular positioning protrusions 76 in the diaphragm membrane 70 is also obtained during operation of the present invention (as shown in FIG. 112, thereby achieving significantly reduced vibration and enhanced stability in preventing displacement and maintaining the length of moment arm L2.

Figure 113:
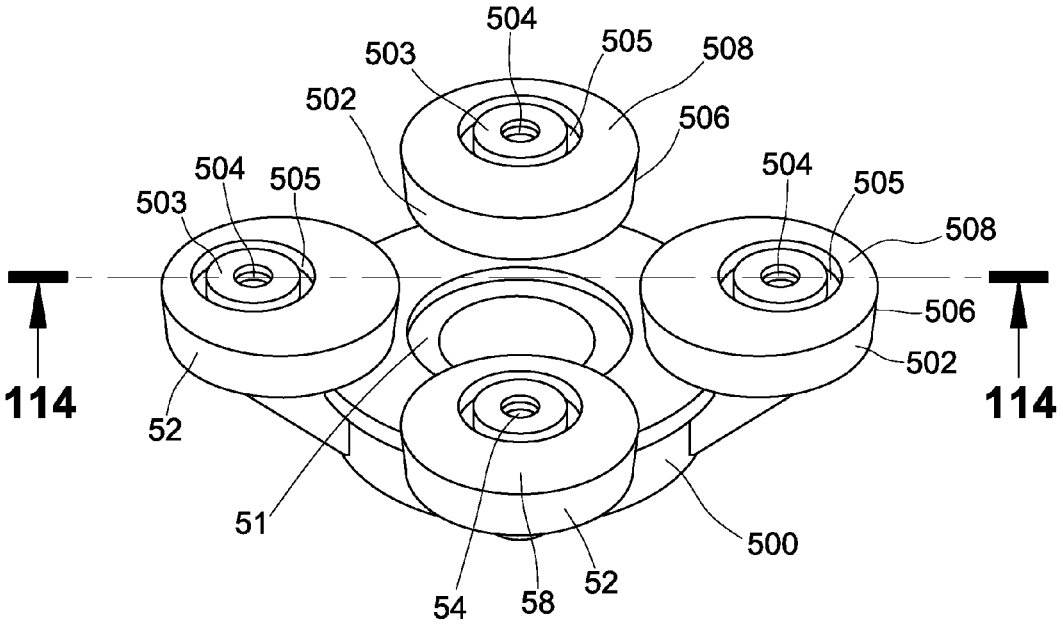
FIG. 113 is a perspective view for an eccentric roundel mount in the ninth exemplary embodiment of the present invention.
Figure 114:
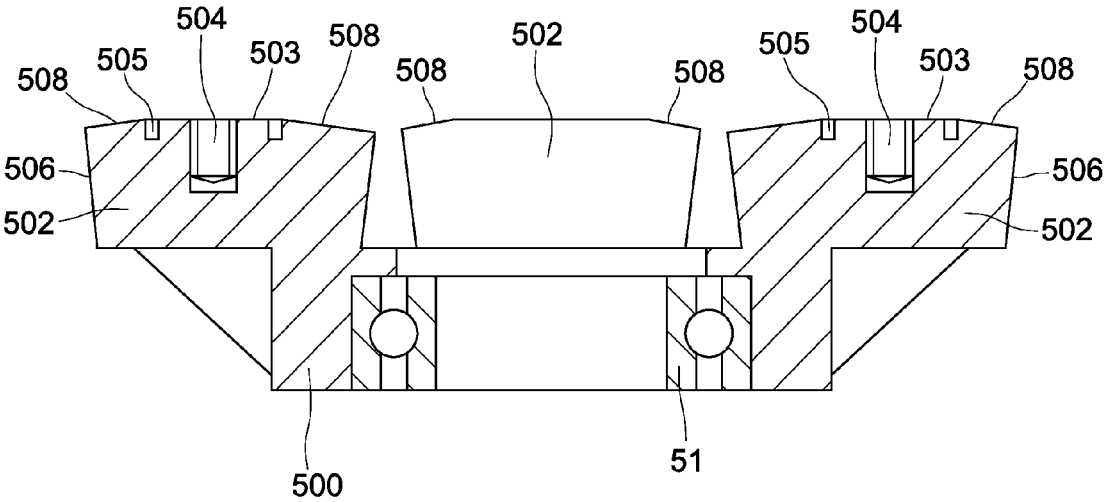
FIG. 114 is a cross sectional view taken against the section line of 114-114 from previous FIG. 113.
Figure 115:
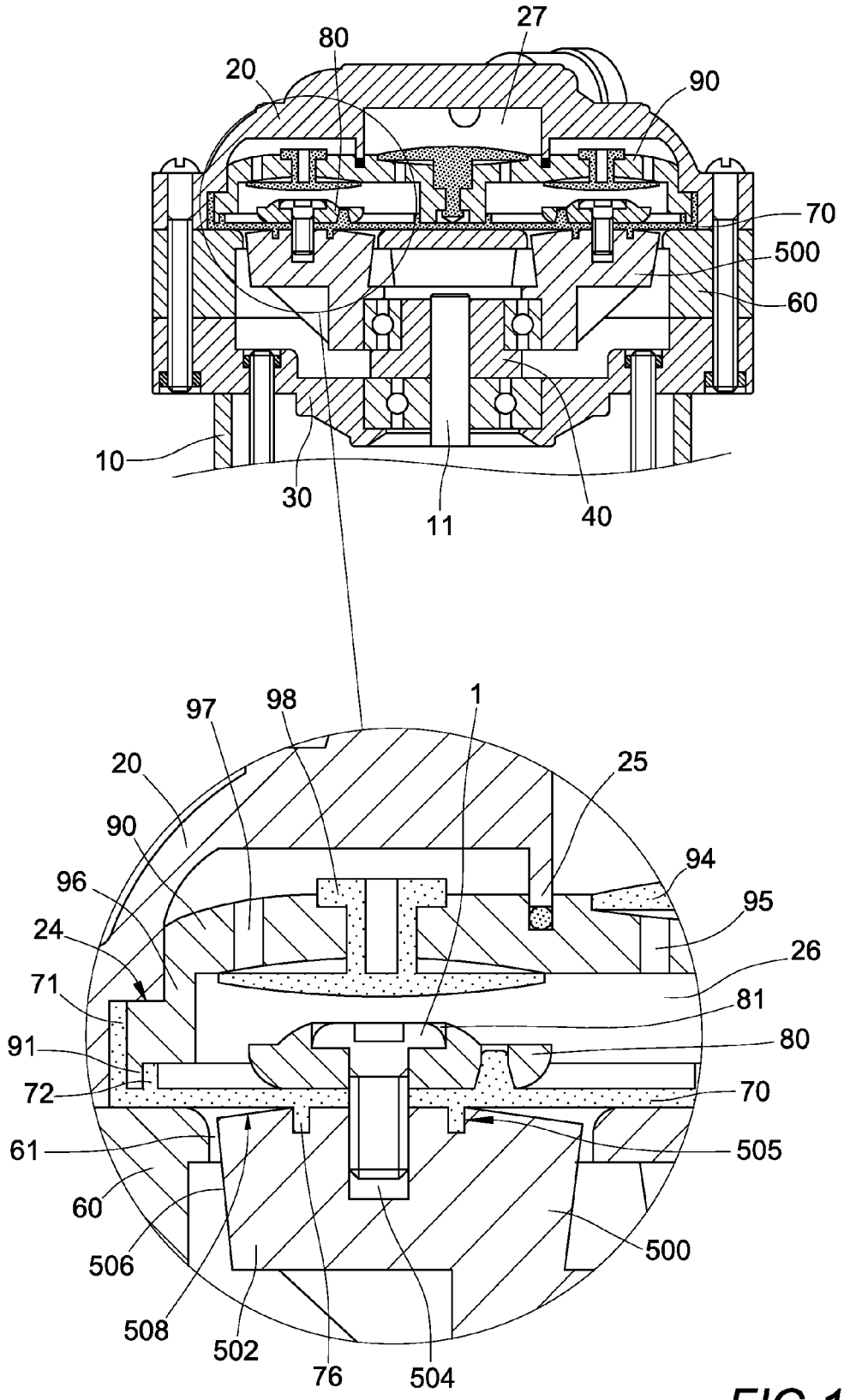
FIG. 115 is a cross sectional view showing the assembly of a diaphragm membrane and a pump head body for the ninth exemplary embodiment of the present invention, which is installed in a conventional four-compression-chamber diaphragm pump.

Please refer to FIGS. 113 through 115, which are illustrative figures of the four-compression-chamber diaphragm pump with multiple effects of a variation of for the ninth exemplary embodiment of the present invention.

In this variation, the cylindrical eccentric roundel 52 is modified into an inverted frustoconical eccentric roundel 502 in an eccentric roundel mount 500.

The frustoconical eccentric roundel 502 includes an integral inverted frustoconical flank 506 and a sloped top ring 508 such that the outer diameter of the frustoconical eccentric roundel 502 is enlarged but still smaller than the inner diameter of the operating hole 61 in the pump head body 60, as well as the sloped top ring 508 extending between an annular positioning groove 505 and the inverted frustoconical flank 506.

Figure 116:
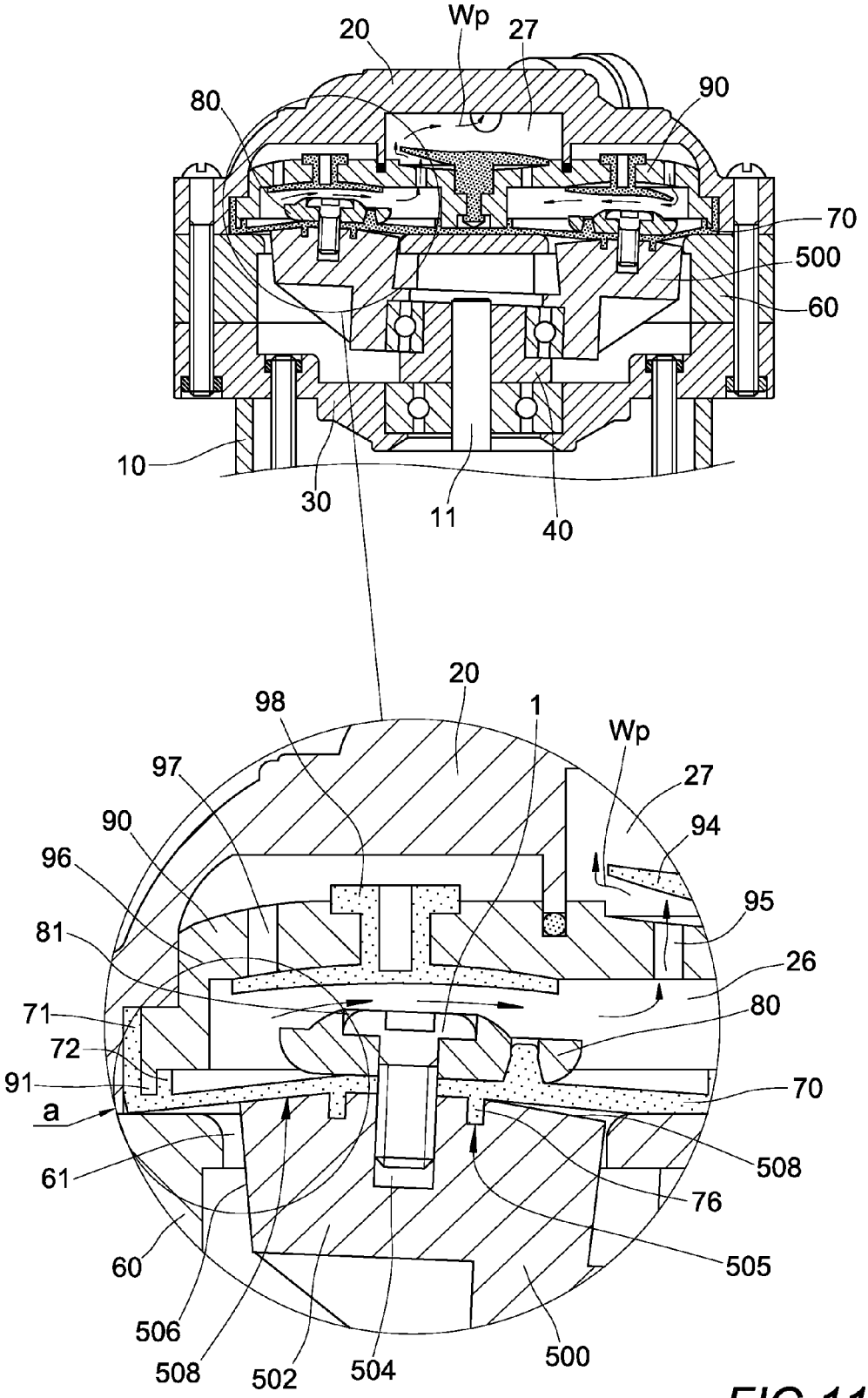
FIG. 116 is operation illustrative view for the ninth exemplary embodiment of the present invention.
Figure 117:
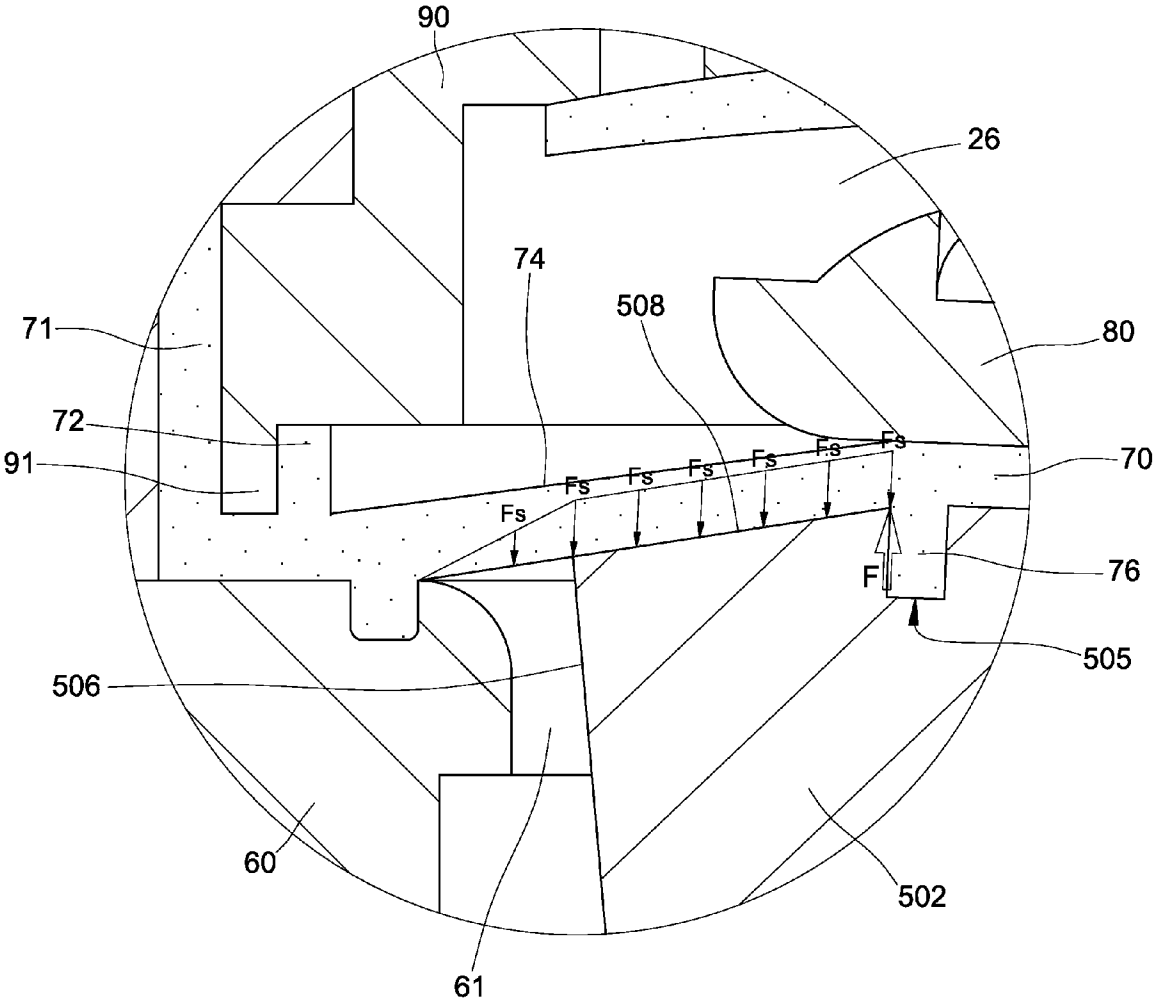
FIG. 117 is a partially enlarged view taken from circled-portion-a of previous FIG. 116.
Figure 118:
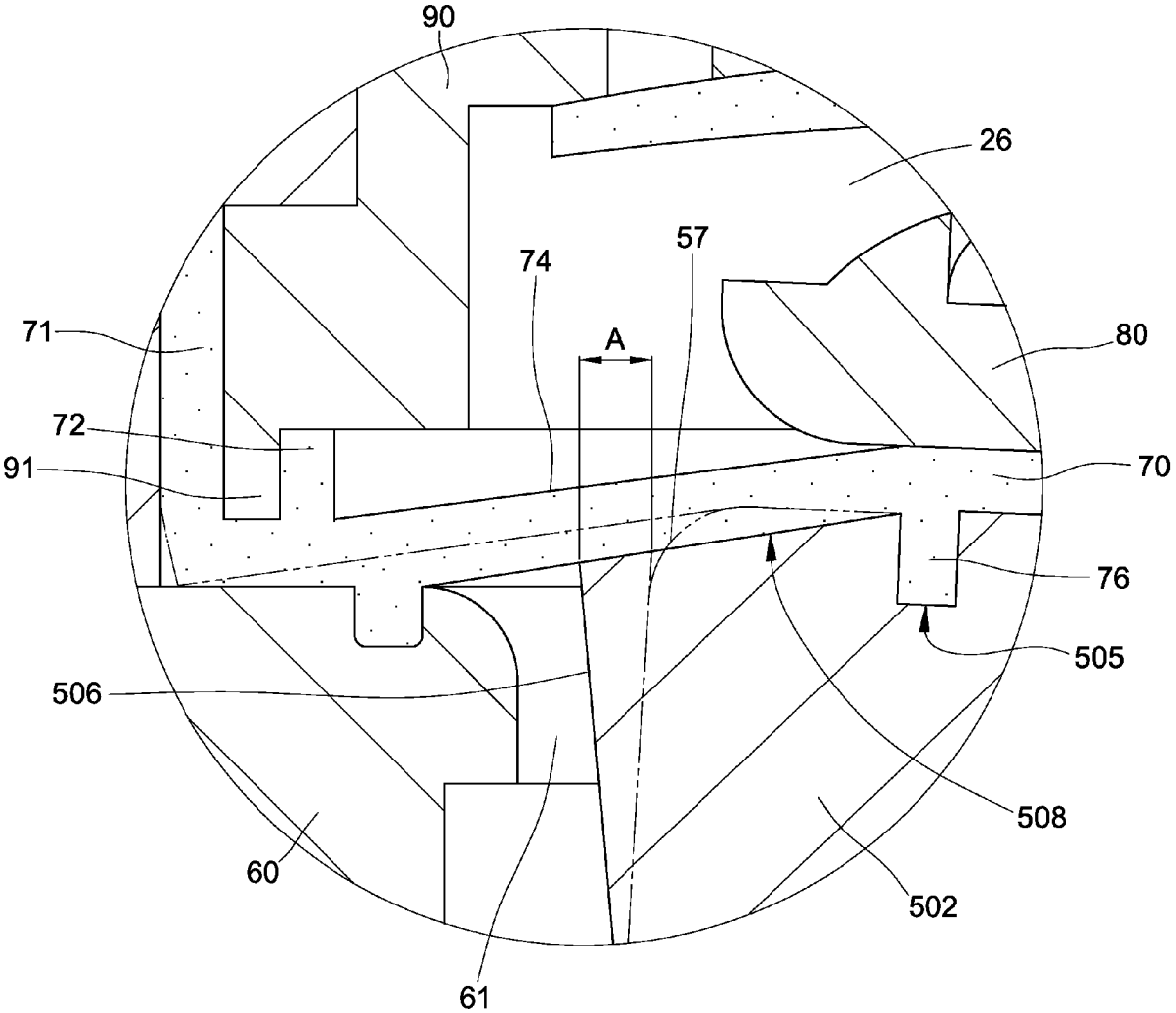
FIG. 118 is a cross sectional illustrative view showing a comparison between the cylindrical eccentric roundel acting on the diaphragm membrane for the conventional four-compression-chamber diaphragm pump and for the present invention in the ninth exemplary embodiment of the present invention.
Figure 119:
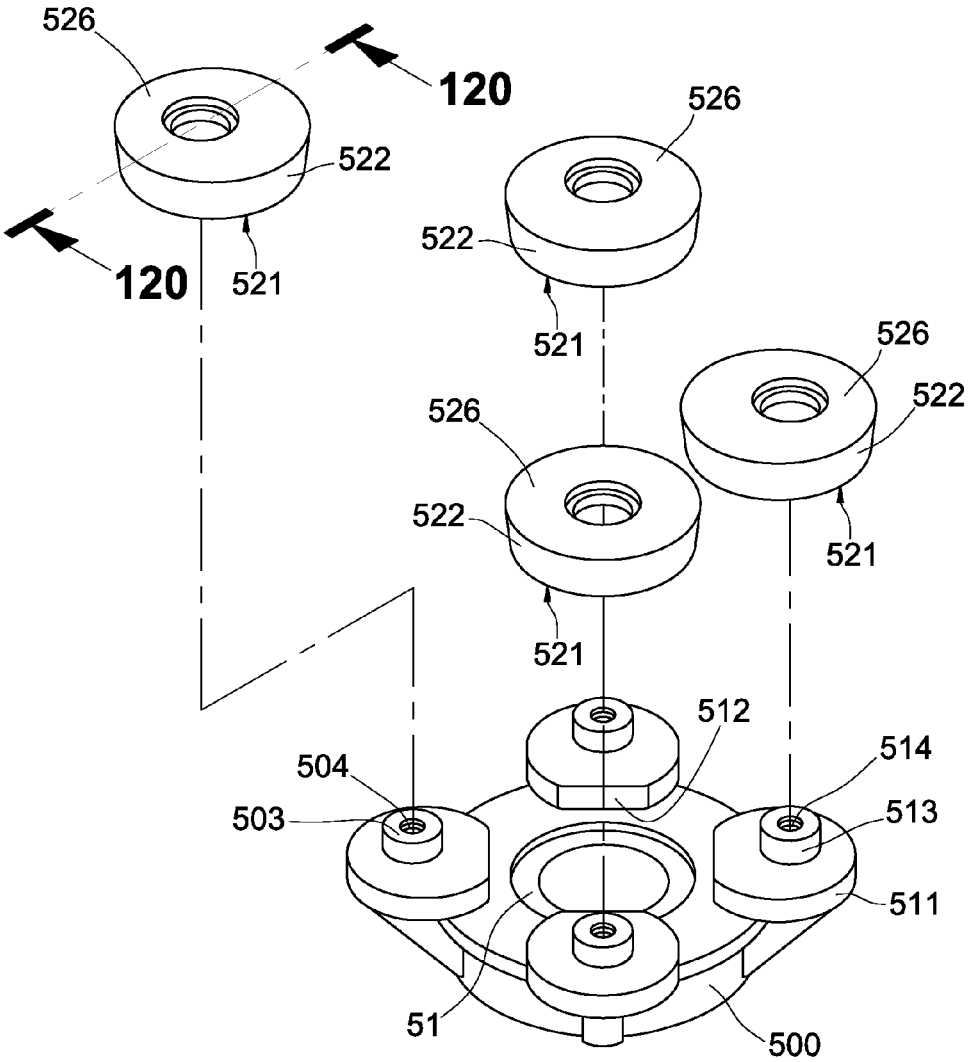
FIG. 119 is a perspective exploded view showing a modified cylindrical eccentric roundel for the ninth exemplary embodiment of the present invention.
Figure 120:
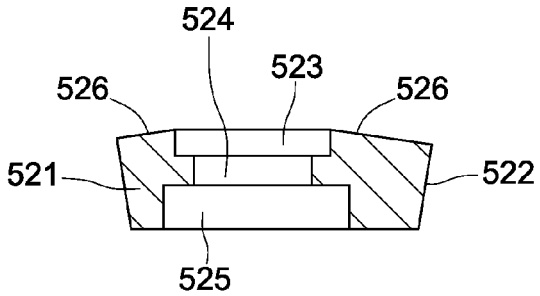

FIGS. 116 through 118 are illustrative figures showing the operation of the "four-compression-chamber diaphragm pump with multiple effects" in a modified mode of for the ninth exemplary embodiment of the present invention.

Firstly, when the motor 10 is powered on, the wobble plate 40 is driven to rotate by the motor output shaft 11 so that the four frustoconical eccentric roundels 502 on the eccentric roundel mount 500 constantly move in a sequential up-and-down reciprocal stroke.

Secondly, the four piston acting zones 74 in the diaphragm membrane 70 are sequentially driven by the up-and-down reciprocal stroke of the four frustoconical eccentric roundels 502 to move in up-and-down displacement.

Thirdly, when the frustoconical eccentric roundel 502 in the present invention moves in an up stroke so that piston acting zone 74 is displaced upwardly, the acting force F will obliquely pull the partial portion between the corresponding annular positioning protrusion 76 and outer raised rim 71 of the diaphragm membrane 70.

Consequently, the inclusion of the sloped top ring 508 in the eccentric roundel mount 500 eliminates breakage of the diaphragm membrane 70 caused by the high frequency squeezing phenomena that would otherwise result from the rounded shoulder 57 in the conventional tubular eccentric roundel 502 (as indicated in FIG. 118 by a dotted line), and also causes the rebounding force Fs of the diaphragm membrane 70 caused by the acting force F to be tremendously reduced. Meanwhile, by means of the inverted frustoconical flank 506, the possibility of collision between the frustoconical eccentric roundel 502 and the operating hole 61 in the pump head body 60 is eliminated even though the outer diameter of the frustoconical eccentric roundel 502 is enlarged.

Moreover, under the same acting force F, the rebounding force Fs is inversely proportional to the contact area. By means of the enlarged outer diameter of the inverted frustoconical eccentric roundel 502, the contact area of the sloped top ring 508 with the bottom side of the diaphragm membrane 70 is increased (as indicated by ring A shown in FIG. 118) so that all distributed components of the rebounding force Fs for the inverted frustoconical eccentric roundels 502 of the present invention are further reduced.

The inverted frustoconical eccentric roundel 502 of this embodiment of the present invention therefore provides at least some of the following benefits:

1. The durability of the diaphragm membrane 70 for sustaining the high frequency pumping action is substantially increased as a result of the inverted frustoconical eccentric roundel 502.

2. The power consumption of the four-compression-chamber diaphragm pump is tremendously diminished due to less current being wasted as a result of the high frequency squeezing phenomena.

3. The working temperature of the four-compression-chamber diaphragm pump is tremendously reduced due to less power consumption.

4. The undesirable bearing noise resulting from aged lubricant in the four-compression-chamber diaphragm pump, which is exacerbated by accelerated aging due to a high working temperature, is mostly eliminated.

5. The service lifespan of the four-compression-chamber diaphragm pump is further prolonged because all distributed components of the rebounding force Fs for the inverted frustoconical eccentric roundels 502 of the present invention are reduced.

Figure 121:
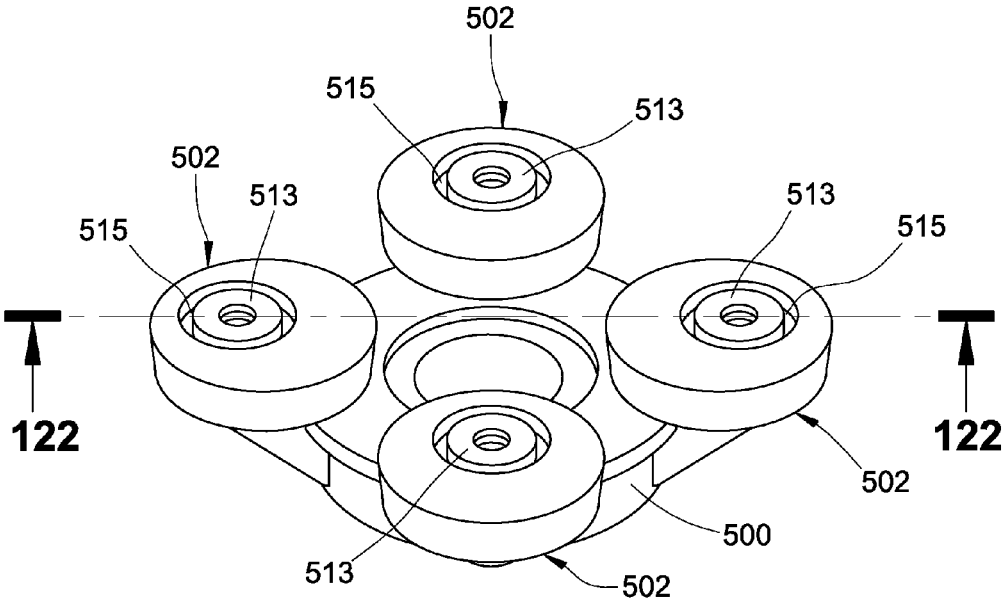
Figure 122:
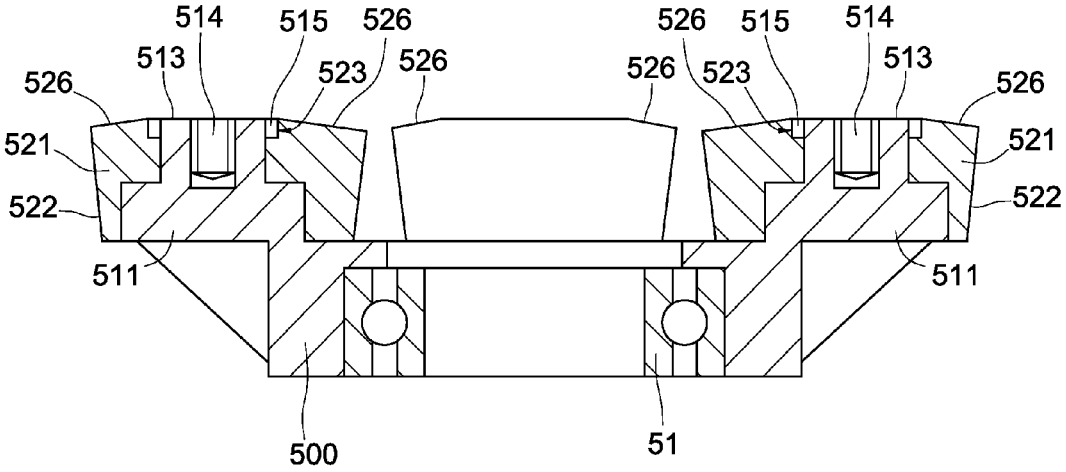

FIGS. 119 through 122 are illustrative figures of four-compression-chamber diaphragm pump with multiple effects in an adapted mode of for the ninth exemplary embodiment of the present invention, in which the cylindrical eccentric roundel 52 is replaced by a combinational eccentric roundel 502 in an eccentric roundel mount 500. The combinational eccentric roundel 502 includes a roundel mount 511 and an inverted frustoconical roundel yoke 521 in detachable separation such that the outer diameter of the frustoconical roundel yoke 521 is enlarged but still smaller than the inner diameter of the operating hole 61 in the pump head body 60, wherein the roundel mount 511, which has two layers and a includes bottom-layer base with a positional crescent 512 facing inwardly and a top-layer protruding cylinder 513 with a central female-threaded bore 514. The inverted frustoconical roundel yoke 521 is sleeved over the corresponding roundel mount 511 and includes an upper bore 523, a middle bore 524 and a lower bore 525 stacked as a three-layered integral hollow frustoconical structure, as well as an inverted frustoconical flank 522 and a sloped top ring 526 extending from the upper bore 523 to the inverted frustoconical flank 522 such that the bore diameter of the upper bore 523 is bigger than the outer diameter of the protruding cylinder 513, such that the bore diameter of the middle bore 524 is equivalent to the outer diameter of the protruding cylinder 513, and such that the bore diameter of the lower bore 525 is equivalent to the outer diameter of the bottom-layer base in the roundel mount 511. A positioning annular groove 515 is formed between the protruding cylinder 513 and the inside wall of the upper bore 523 when the frustoconical roundel yoke 521 is sleeved over the roundel mount 511 (as shown in FIGS. 121 and 122).

Figure 123:
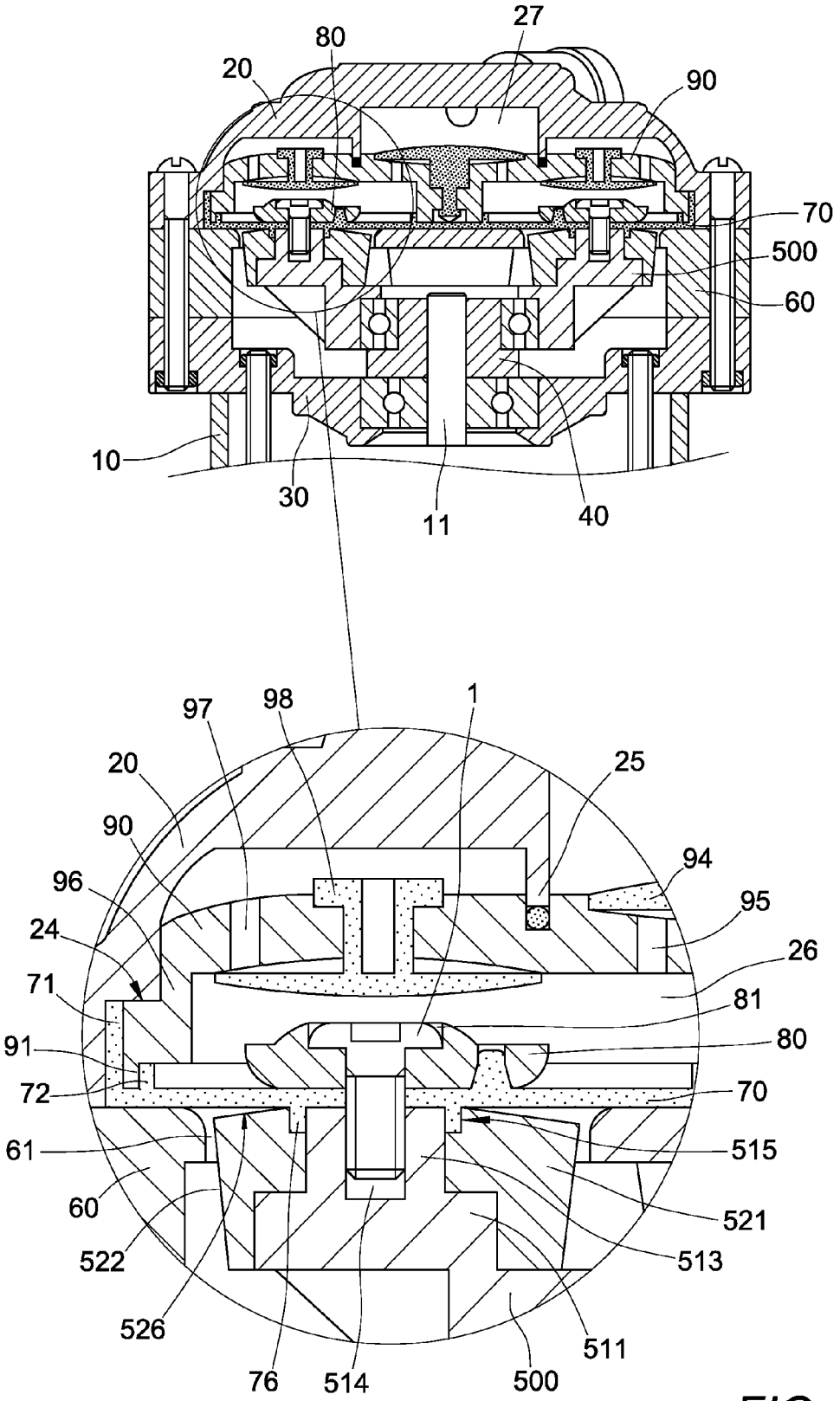
Figure 124:
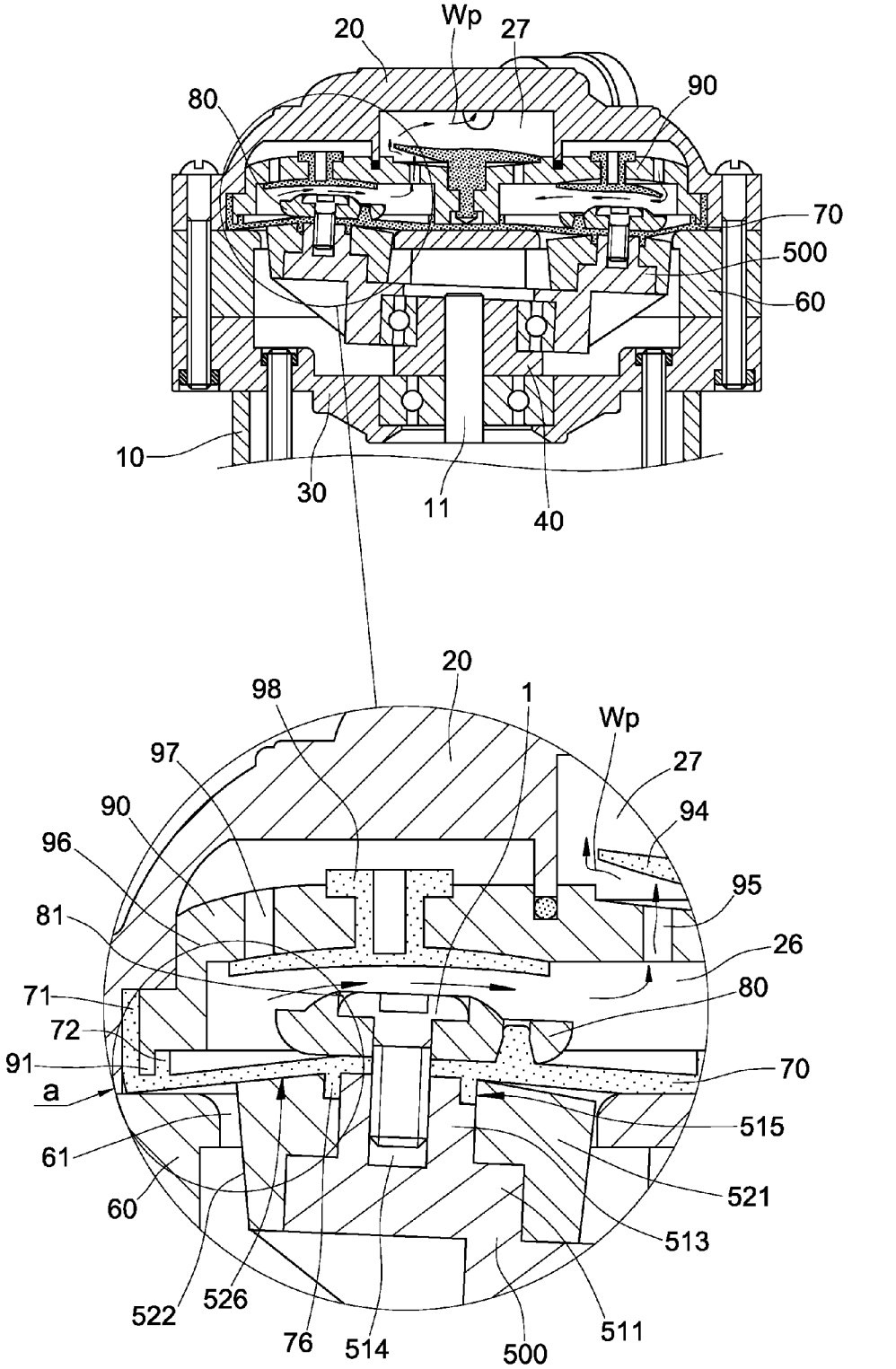
Figure 126:
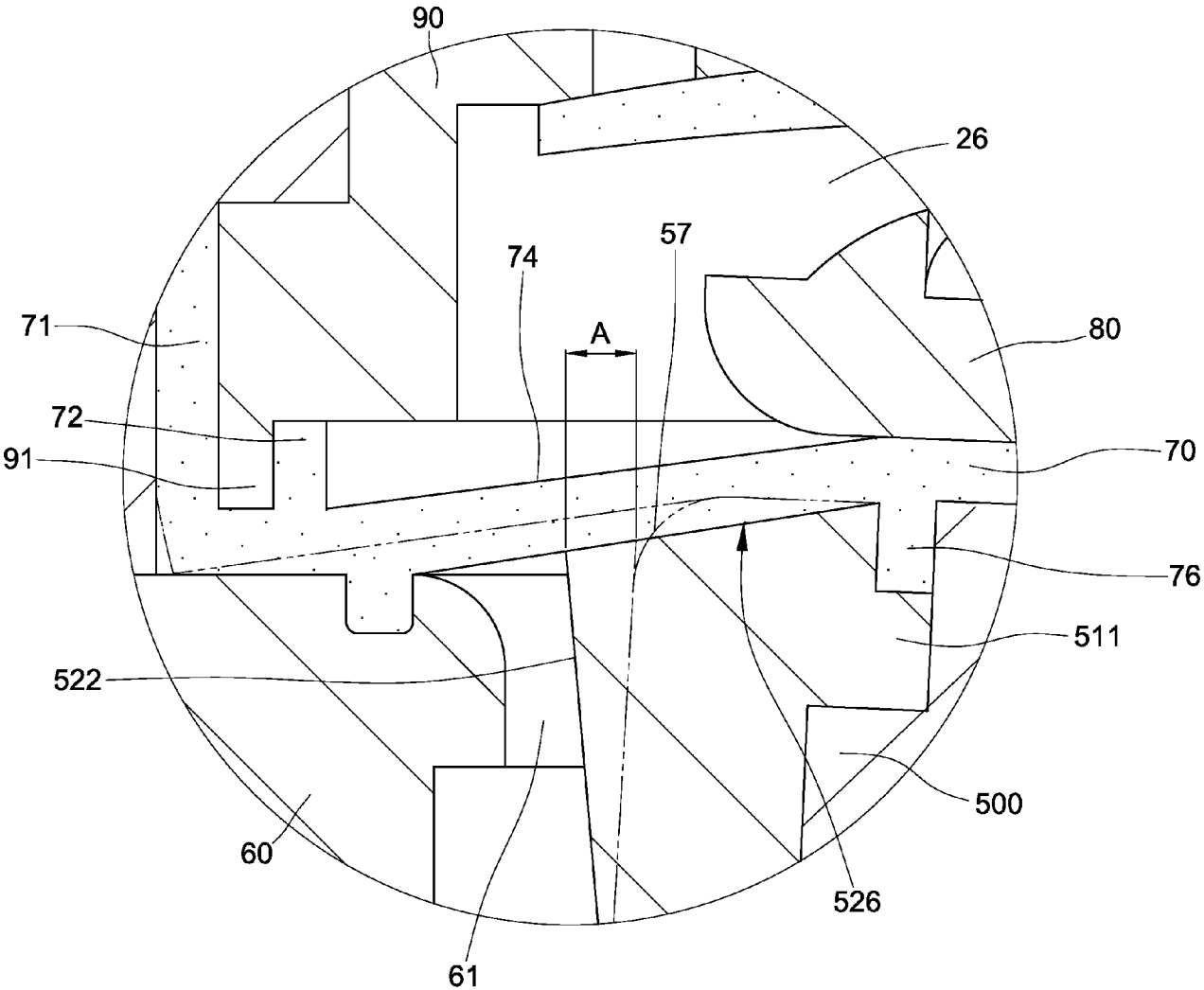

FIGS. 123 and 126 illustrate the manner in which the four-compression-chamber diaphragm pump with multiple effects an adapted mode of for above-described adaptation of the ninth exemplary embodiment of the present invention is assembled.

Firstly, the frustoconical roundel yoke 521 is fitted over the roundel mounts 511.

Secondly, all four annular positioning protrusions 76 of the diaphragm membrane 70 are inserted into four corresponding positioning annular grooves 515 in the four combinational eccentric roundels 502 of the eccentric roundel mount 500.

Finally, each fastening screw 1 is inserted through a corresponding tiered hole 81 of the pumping piston 80 and each corresponding acting zone hole 75 in the piston acting zones 74 of the diaphragm membrane 70, and then the fastening screw 1 is securely screwed into the four corresponding female-threaded bores 514 in the four roundel mounts 511 of the eccentric roundel mount 500 to firmly assembly the diaphragm membrane 70 and four pumping pistons 80 four four (as shown in FIG. 123).

Figure 125:
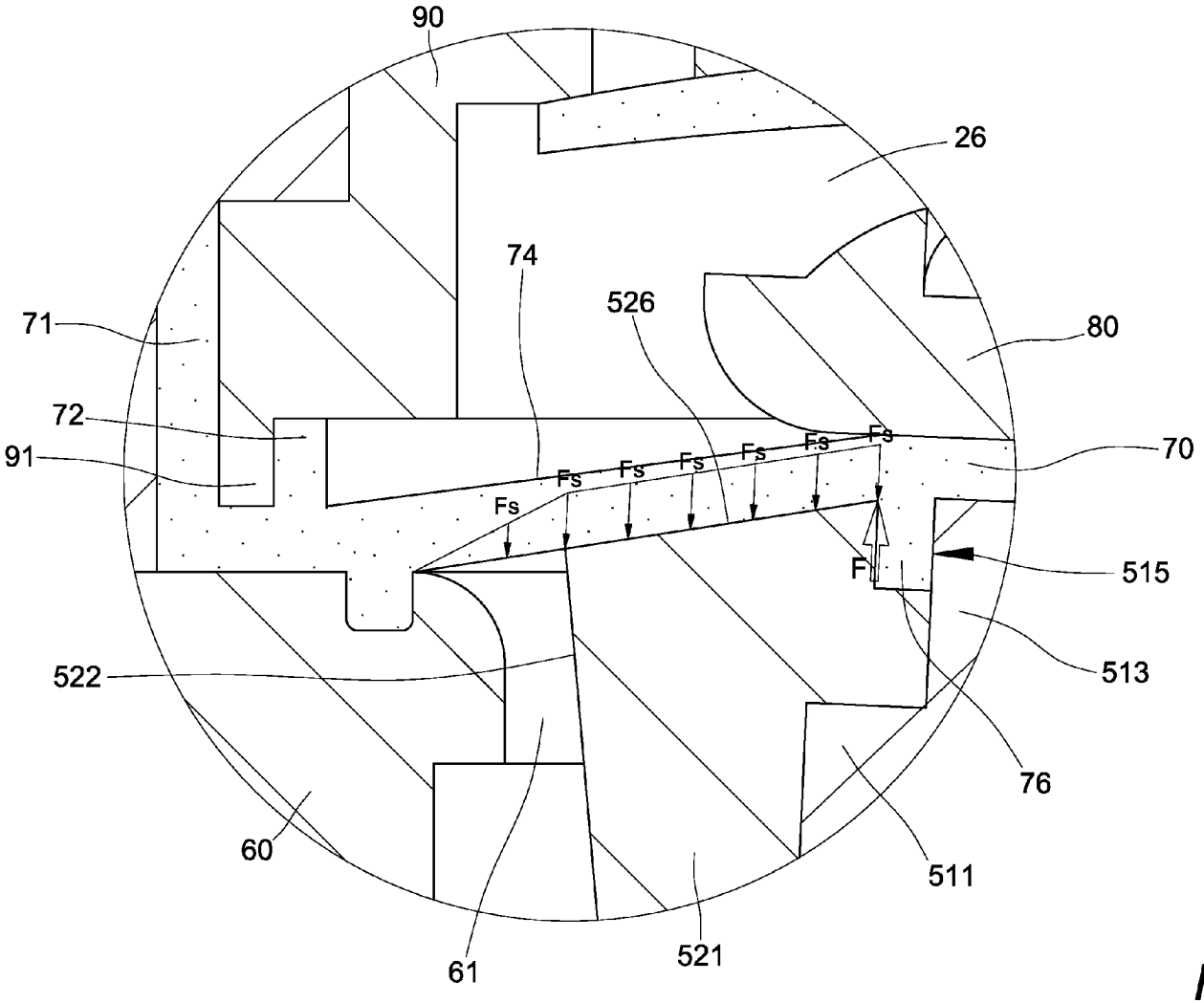

FIGS. 125 and 126 illustrate the operation of the above-described adaptation of the four-compression-chamber diaphragm pump with multiple effects of the ninth exemplary embodiment of the present invention.

Firstly, when the motor 10 is powered on, the wobble plate 40 is driven to rotate by the motor output shaft 11 so that four combinational eccentric roundels 502 on the eccentric roundel mount 50 constantly move in a sequential up-and-down reciprocal stroke.

Secondly, the four piston acting zones 74 in the diaphragm membrane 70 are sequentially driven by the up-and-down reciprocal stroke of the four combinational eccentric roundels 502 to move in up-and-down displacement.

Thirdly, when the combinational eccentric roundel 502 in the present invention moves in an up stroke to displace the piston acting zone 74 upwardly, the acting force F will obliquely pull the partial portion between corresponding annular positioning protrusion 76 and outer raised rim 71 of the diaphragm membrane 70.

Consequently, the inclusion of the sloped top ring 526 in the inverted frustoconical roundel yoke 521 of the eccentric roundel mount 500 eliminates susceptibility to breakage of the diaphragm membrane 70 caused by the high frequency squeezing phenomena that would otherwise result from the rounded shoulder 57 in the conventional tubular eccentric roundel indicated in FIG. 125 by a dotted line, and also causes the rebounding force Fs of the diaphragm membrane 70 caused by the acting force F to be tremendously reduced (as shown in FIG. 126).

Moreover, under the same acting force F, the rebounding force Fs is inversely proportional to the contact area. By means of the enlarged outer diameter of the inverted frustoconical roundel yoke 521, the contact area of the sloped top ring 508 with the bottom side of the diaphragm membrane 70 is increased (as indicated by ring A shown in FIG. 113) so that all distributed components of the rebounding force Fs for the inverted frustoconical roundel yoke 521 of the present invention are further reduced.

The fabrication of this adaptation of the four-compression-chamber diaphragm pump with multiple effects of the ninth exemplary embodiment of the present invention is as follows:

Firstly, the roundel mount 511 and eccentric roundel mount 500 are fabricated together as an integral body.

Secondly, the frustoconical roundel yoke 521 is independently fabricated as a separate entity.

Finally, the frustoconical roundel yoke 521 and the integral body of the roundel mount 511 are assembled with eccentric roundel mount 500 to become a united entity and form the assembled eccentric roundel 502.

Thereby, the contrivance of the combinational eccentric roundel 502 not only meets the requirement of mass production but also reduces the overall manufacturing cost.

The eccentric roundel 502 with frustoconical roundel yoke 521 of the present invention provides at least some of the following benefits:

1. The durability of the diaphragm membrane 70 for sustaining the high frequency pumping action is substantially increased by including the inverted frustoconical roundel yoke 521.

2. The power consumption of the four-compression-chamber diaphragm pump is tremendously reduced due to less current being wasted as a result of the high frequency squeezing phenomena.

3. The working temperature of the four-compression-chamber diaphragm pump is tremendously reduced due to the reduction in power consumption.

4. The undesired bearing noise resulting from temperature-accelerated aging of the lubricant in the four-compression-chamber diaphragm pump is mostly eliminated.

5. The service lifespan of the four-compression-chamber diaphragm pump is further prolonged because all distributed components of the rebounding force Fs for the inverted frustoconical roundel yoke 521 of the present invention are further reduced.

6. The manufacturing cost of the four-compression-chamber diaphragm pump is reduced because the present invention is suitable for mass production.

As described above, the present invention substantially achieves a vibration reducing effect in the four-compression-chamber diaphragm pump by means of a simple newly devised mating means for the pump head body and diaphragm membrane without increasing overall cost, so that it solves all issues of vibration-induced noise and resonant shaking that occurs in the conventional four-compression-chamber diaphragm pump. Additionally, by means of simple sloped top ring for various cylindrical eccentric roundels of the present invention, the service lifespan of the diaphragm membrane in the four-compression-chamber diaphragm pump can be doubled, which has valuable industrial applicability.

What is claimed is:

1. A four-compression-chamber diaphragm pump with multiple effects, said four-compression-chamber diaphragm pump including a motor, a pump head body fixed to a motor housing, a roundel mount situated on a lower side of the pump head body and four eccentric roundels each having a top face and a fastening bore formed in the top face, the eccentric roundels being mounted on the roundel mount to extend through four operating holes in the pump head body, a diaphragm membrane fixed to the four eccentric roundels through the four operating holes and situated on an upper side of the pump head body, and four pumping pistons arranged to be moved in a pumping action upon movement of the diaphragm membrane, wherein:

the roundel mount is situated on a wobble plate such that rotation of the wobble plate by the motor causes the roundel mount to wobble, resulting in sequential up and down movement of the four eccentric roundels, the sequential up and down movement of the four eccentric roundels causing sequential, reciprocating movement of four piston acting zones in the diaphragm membrane and the four pumping pistons, the diaphragm membrane further includes four annular downwardly-projecting positioning protrusions each arranged to be inserted into a respective annular positioning groove in a top surface of each of said eccentric roundels, and a section of the top face of each eccentric roundel is inclined relative to horizontal to form a sloped top ring between a respective said annular positioning groove and a vertical or inverted frustoconical flank of the respective eccentric roundel to increase a linearity of a distribution of components of a rebounding force of the diaphragm membrane that occurs in response to application of an acting force during operation of the diaphragm pump, the pump head body includes at least one first curved vibration-reducing positioning structure at each operating hole on the upper side of the pump head body, the diaphragm membrane includes at least one second curved vibration-reducing positioning structure at a respective position on the diaphragm membrane that corresponds to a position of said at least one first vibration-reducing positioning structure on the pump head body, the at least one first positioning structure mates with the corresponding at least one second positioning structure to reduce a moment arm generated during pumping by movement of the diaphragm membrane, thereby generating less torque during said movement to decrease a strength of vibrations and vibration noise, the at least one first curved vibration-reducing positioning structure includes either at least one of a basic curved groove, at least one of a curved slot, at least one curved set of openings, at least one of a curved protrusion, or at least one curved set of protrusions, and is further circumferentially-disposed around an upper side of each operating hole in the pump head body; and the at least one second curved vibration-reducing positioning structure includes either at least one of a basic curved protrusion, at least one of a curved protrusion, at least one curved set of protrusions, at least one of a curved groove, or at least one curved set of openings, and is further circumferentially-disposed around each concentric annular positioning protrusion at the bottom side of the diaphragm membrane at a position corresponding to a position of each first curved vibration-reducing positioning structure in the pump head body so that each second curved vibration-reducing positioning structure at the bottom side of the diaphragm membrane is mated with each corresponding first curved vibration-reducing positioning structure at the upper side of the pump head body upon assembly of the pump head body and the diaphragm membrane, whereby the moment arm generated by the movement of the diaphragm membrane in response to up-and-down movement of the four pumping pistons extends between the mated first curved vibration-reducing positioning structure and second curved vibration-reducing positioning structure and a periphery of the annular position grooves to thereby reduce vibrations resulting from said movement of the diaphragm.

2. The four-compression-chamber diaphragm pump with multiple effects as claimed in claim 1, wherein said motor includes an output shaft, said wobble plate includes an integral protruding cam-lobed shaft and a piston valvular assembly, and wherein:

said output shaft of said motor extends through a shaft coupling hole in said wobble plate to cause said wobble plate to rotate;

said integral protruding cam-lobed shaft of said wobble plate extends through a central bearing of said eccentric roundel mount;

said pump head body is secured to an upper chassis of said motor to encompass the wobble plate and eccentric roundel mount therein, said pump head body including said four operating holes disposed at locations corresponding to locations of said plurality of eccentric roundels, each operating hole having an inner diameter slightly bigger than an outer diameter of a corresponding one of said eccentric roundels for respectively receiving the corresponding one of the eccentric roundels;

said diaphragm membrane is made of a semi-rigid elastic material and placed on the pump head body, said diaphragm membrane including at least one raised rim as well as a plurality of evenly spaced radial raised partition ribs connected with the at least one raised rim to form said four piston acting zones, wherein each piston acting zone has an acting zone hole formed therein at a position corresponding to a position of a fastening bore in a respective one of the eccentric roundels;

each pumping piston has a tiered hole and a fastening member extends through the tiered hole of each pumping piston, through the acting zone hole of each corresponding piston acting zone in the diaphragm membrane, and into a respective fastening hole in a respective one of the eccentric roundels to secure the diaphragm membrane and each of the pumping pistons to the corresponding eccentric roundels in the eccentric roundel mount;

said piston valvular assembly, which covers the diaphragm membrane and is peripherally secured to the diaphragm membrane by sealing engagement, includes a central outlet mount having a central positioning bore and a plurality of equivalent sectors, each of which contains multiple evenly circumferentially-located outlet ports, a T-shaped plastic anti-backflow valve with a central positioning shank, and a plurality of circumferential inlet mounts, each of the respective inlet mounts including multiple evenly circumferentially-located inlet ports and an inverted central piston disk mounted to the respective inlet mount so that each inverted central piston disk serves as a valve for each corresponding group of multiple inlet ports, wherein the central positioning shank of the plastic anti-backflow valve mates with the central positioning bore of the central outlet mount such that said multiple outlet ports in the central round outlet mount communicate with the plurality of inlet mounts, and a hermetic preliminary water-pressurizing chamber is formed in each inlet mount and corresponding piston acting zone in the diaphragm membrane upon the diaphragm membrane being peripherally secured to the piston valvular assembly such that one end of each of the preliminary water-pressuring chamber is communicable with each corresponding one of said inlet ports; and a pump head cover, which covers the pump head body to encompass the piston valvular assembly, the pumping pistons and the diaphragm membrane therein, includes a water inlet orifice, and a water outlet orifice, said pump head cover being hermetically attached to the assembly of the diaphragm membrane and the piston valvular assembly, wherein a high-pressured water chamber is configured between a cavity formed by an inside wall of an annular rib ring and the central outlet mount of the piston valvular assembly.

3. The four-compression-chamber diaphragm pump with multiple effects as claimed in claim 1, wherein each said first curved vibration-reducing positioning structure includes either at least one curved groove or at least one curved slot in the pump head body and each said second curved vibration-reducing positioning structure includes at least one curved protrusion extending from the diaphragm membrane.

4. The four-compression-chamber diaphragm pump with multiple effects as claimed in claim 1, wherein each said first curved vibration-reducing positioning structure includes at least one curved protrusion extending from the pump head body and each said second curved vibration-reducing positioning structure includes either at least one curved groove or at least one curved slot in the diaphragm membrane.

5. The four-compression-chamber diaphragm pump with multiple effects as claimed in claim 1, wherein each said first curved vibration-reducing positioning structure includes a pair of curved grooves in the pump head body and each said second curved vibration-reducing positioning structure includes a pair of curved protrusions extending from the diaphragm membrane.

6. The four-compression-chamber diaphragm pump with multiple effects as claimed in claim 1, wherein each said first curved vibration-reducing positioning structure includes a pair of curved protrusions extending from the pump head body and each said second curved vibration-reducing positioning structure includes a pair of curved grooves in the diaphragm membrane.

7. The four-compression-chamber diaphragm pump with multiple effects as claimed in claim 1, wherein each said first curved vibration-reducing positioning structure is a curved set of openings in the pump head body and each said second curved vibration-reducing positioning structure is a curved set of protrusions extending from the diaphragm membrane.

8. The four-compression-chamber diaphragm pump with multiple effects as claimed in claim 7, wherein said curved set of openings are round or are substantially square shaped openings.

9. The four-compression-chamber diaphragm pump with multiple effects as claimed in claim 7, wherein said curved set of openings are curved perforated segments.

10. The four-compression-chamber diaphragm pump with multiple effects as claimed in claim 7, wherein said curved set of openings includes a pair of curved perforated segments.

11. The four-compression-chamber diaphragm pump with multiple effects as claimed in claim 1, wherein each said first curved vibration-reducing positioning structure is a curved set of protrusions extending from the pump head body and each said second curved vibration-reducing positioning structure is a curved set of openings in the diaphragm membrane.

12. The four-compression-chamber diaphragm pump with multiple effects as claimed in claim 11, wherein said curved set of protrusions are round or are substantially square shaped protrusions.

13. The four-compression-chamber diaphragm pump with multiple effects as claimed in claim 11, wherein said curved set of openings are curved perforated segments.

14. The four-compression-chamber diaphragm pump with multiple effects as claimed in claim 11, wherein said curved set of openings includes a pair of curved perforated segments.

15. The four-compression-chamber diaphragm pump with multiple effects as claimed in claim 1, wherein each said first curved vibration-reducing positioning structure includes at least one indented ring in the pump head body and each said second curved vibration-reducing positioning structure includes at least one annular protrusion projecting from the diaphragm membrane.

16. The four-compression-chamber diaphragm pump with multiple effects as claimed in claim 1, wherein each said first curved vibration-reducing positioning structure includes a pair of indented rings in the pump head body and each said second curved vibration-reducing positioning structure includes a pair of ring structures projecting from the diaphragm membrane.

17. The four-compression-chamber diaphragm pump with multiple effects as claimed in claim 1, wherein each said first curved vibration-reducing positioning structure includes a pair of ring structures projecting from the pump head body and each said second curved vibration-reducing positioning structure includes a pair of indented rings in the diaphragm membrane.

18. The four-compression-chamber diaphragm pump with multiple effects as claimed in claim 1, wherein each said eccentric roundel is a cylindrical eccentric roundel.

19. The four-compression-chamber diaphragm pump with multiple effects as claimed in claim 1, wherein each said eccentric roundel is an inverted frustoconical eccentric roundel, and wherein a largest diameter of the inverted frustoconical eccentric roundel is smaller than an inner diameter of a corresponding one of said operating holes in the pump head body.

20. The four-compression-chamber diaphragm pump with multiple effects as claimed in claim 19, wherein said inverted frustoconical eccentric roundels each includes a mounting portion fixed to the roundel mount and a separable inverted frustoconical roundel yoke mounted on the roundel mount to form a two-layered eccentric roundel structure.

21. The four-compression-chamber diaphragm pump with multiple effects as claimed in claim 20, wherein the mounting portion of each of the inverted frustoconical eccentric roundels is integrally fabricated with the roundel mount, and the inverted frustoconical roundel yokes are separately fabricated.

22. The four-compression-chamber diaphragm pump with multiple effects as claimed in claim 1, wherein the mounting portion of each of the inverted frustoconical eccentric roundels includes a base with an inwardly-facing positioning surface and a cylinder with a central female-threaded bore extending upwardly from the base, and wherein each of the inverted frustoconical yokes includes an upper bore, a middle bore, and a lower bore, wherein a diameter of the middle bore is approximately equal to a diameter of the mounting portion cylinder, a diameter of the upper bore is larger than the diameter of the mounting portion cylinder, and a diameter of the lower bore is approximately equal to a diameter of the mounting portion base, said lower bore being fitted over the base, said middle bore being sleeved over the cylinder, and said annular positioning groove being defined by a space between said cylinder and an inner wall of said upper bore.

23. The four-compression-chamber diaphragm pump with multiple effects as claimed in claim 1, wherein at least one raised rim of said diaphragm membrane is an inner raised rim, said diaphragm membrane includes a parallel outer raised rim, said wobble plate comprises a piston valvular assembly that includes a downwardly extending raised rim, and said downwardly extending raised rim of said piston valvular assembly extends between said inner and outer raised rims of said diaphragm membrane to provide a peripheral seal when said diaphragm membrane is peripherally secured to said piston valvular assembly.

24. The four-compression-chamber diaphragm pump with multiple effects as claimed in claim 1, wherein respective fastening bores formed in said eccentric roundels are threaded bores and each pumping piston has a fastening member extending therethrough into a one of said respective fastening bores and said fastening members are screws.

25. The four-compression-chamber diaphragm pump with multiple effects as claimed in claim 1, wherein said motor is a brushed motor.

26. The four-compression-chamber diaphragm pump with multiple effects as claimed in claim 1, wherein said motor is a brushless motor.

* * * * *